US009187855B2

(12) United States Patent
Gilboe et al.

(10) Patent No.: US 9,187,855 B2
(45) Date of Patent: Nov. 17, 2015

(54) MODULAR LAUNDRY SYSTEM WITH WORK SURFACE

(75) Inventors: Kevin James Gilboe, Stevensville, MI (US); Lorraine L. Achterberg, St. Joseph, MI (US); James William Kendall, Mount Prospect, IL (US)

(73) Assignee: Whirlpool Corporation, Benton Harbor, MI (US)

( * ) Notice: Subject to any disclaimer, the term of this patent is extended or adjusted under 35 U.S.C. 154(b) by 1218 days.

(21) Appl. No.: 12/497,034

(22) Filed: Jul. 2, 2009

(65) Prior Publication Data

US 2009/0293552 A1 Dec. 3, 2009

Related U.S. Application Data

(63) Continuation of application No. 11/323,220, filed on Dec. 30, 2005, now abandoned, and a continuation-in-part of application No. 11/323,221, filed on Dec. 30, 2005, now Pat. No. 7,624,600, which is a continuation-in-part of application No. 10/971,671, filed on Oct. 22, 2004, now Pat. No. 7,513,132.

(51) Int. Cl.
*D06F 39/12* (2006.01)
*D06F 29/00* (2006.01)

(52) U.S. Cl.
CPC ..... *D06F 29/00* (2013.01); *D06F 39/12* (2013.01)

(58) Field of Classification Search
None
See application file for complete search history.

(56) References Cited

U.S. PATENT DOCUMENTS

| | | | |
|---|---|---|---|
| 88,281 | A | 3/1869 | Montigny |
| 315,725 | A | 4/1885 | Caughy |
| 380,949 | A | 4/1888 | Shannon |
| 496,655 | A | 5/1893 | Hilton |
| 502,237 | A | 7/1893 | Proctor |
| 602,494 | A | 4/1898 | Briggs |
| 699,922 | A | 5/1902 | Hyson et al. |
| 707,409 | A | 8/1902 | Guitar |
| 870,805 | A | 11/1907 | Trager |
| 900,347 | A | 10/1908 | Berry |
| 916,849 | A | 3/1909 | Darrow |
| 970,174 | A | 9/1910 | Booton |
| 1,000,933 | A | 8/1911 | North |
| 1,078,882 | A | 11/1913 | Scott |
| 1,255,399 | A | 2/1918 | Ferren |
| 1,278,072 | A | 9/1918 | Ossry |
| 1,317,829 | A | 10/1919 | Shroyer |
| 1,369,933 | A | 3/1921 | Nelson |
| 1,482,742 | A | 2/1924 | Gilchrist |
| 1,485,991 | A | 3/1924 | Mulley |
| 1,532,973 | A | 4/1925 | Adelson |
| 1,590,390 | A | 6/1926 | Miller |
| 1,665,118 | A | 4/1928 | Thompson et al. |
| 1,691,042 | A | 11/1928 | Bell |
| 1,720,165 | A | 7/1929 | Bloom et al. |
| 1,728,458 | A | 9/1929 | Verduce |
| 1,752,797 | A | 4/1930 | Hutchinson, Jr. |
| 1,767,157 | A | 6/1930 | Steele |
| 1,900,793 | A | 11/1931 | Broughton |
| 1,994,044 | A | 3/1935 | Michelet |
| 2,060,065 | A | 11/1936 | Gill et al. |
| 2,102,449 | A | 12/1937 | Zimmerman |
| 2,140,961 | A | 12/1938 | Lendle |
| 2,287,646 | A | 12/1938 | Steele |
| D113,031 | S | 1/1939 | Baer et al. |
| 2,202,811 | A | 6/1940 | Carney et al. |
| 2,230,793 | A | 2/1941 | Borah |
| 2,256,425 | A | 9/1941 | Damiano |
| 2,279,984 | A | 4/1942 | Goodwin |
| 2,284,572 | A | 5/1942 | Holder |
| D132,963 | S | 7/1942 | Salomon |
| 2,295,718 | A | 9/1942 | Dahlberg |
| 2,312,220 | A | 2/1943 | Snyder |
| 2,326,062 | A | 8/1943 | Parker |
| 2,339,495 | A | 1/1944 | McMann |
| 2,346,133 | A | 4/1944 | Hayes |
| 2,355,835 | A | 8/1944 | Whalen |
| 2,369,366 | A | 2/1945 | O'Neill |
| 2,402,477 | A | 6/1946 | Williams |
| 2,412,270 | A | 12/1946 | Johnston |
| 2,419,319 | A | 4/1947 | Lankton |
| 2,422,825 | A | 6/1947 | Davis, Jr. |
| 2,434,404 | A | 1/1948 | Goodwin |
| 2,434,886 | A | 1/1948 | Pugh |
| 2,624,137 | A | 1/1948 | Gysin |
| 2,435,439 | A | 2/1948 | Goodwin et al. |
| 2,447,480 | A | 8/1948 | Stubbs |

(Continued)

FOREIGN PATENT DOCUMENTS

| | | |
|---|---|---|
| BE | 1013066 | 8/2001 |
| CA | 2330236 | 11/2001 |

(Continued)

OTHER PUBLICATIONS

Casenave, Phillipe, WO 2004/110214A1, Dec. 2004, English translation.*

(Continued)

*Primary Examiner* — Jason Ko

(57) ABSTRACT

A modular laundry system comprises at least two horizontally arranged laundry appliances. Each of the at least two laundry appliances have a top, and a worksurface extends over the tops of the at least two laundry appliances. The worksurface can form a continuous surface above the at least two laundry appliances.

23 Claims, 67 Drawing Sheets

(56) References Cited

U.S. PATENT DOCUMENTS

| | | | |
|---|---|---|---|
| 2,463,218 | A | 3/1949 | Travis |
| 2,475,106 | A | 7/1949 | Mohr et al. |
| 2,478,531 | A | 8/1949 | Harris et al. |
| 2,482,412 | A | 9/1949 | Gershon |
| 2,486,058 | A | 10/1949 | Patterson et al. |
| 2,499,078 | A | 2/1950 | Shaw |
| 2,641,072 | A | 2/1950 | Maher |
| 2,499,455 | A | 3/1950 | Brochu |
| 2,526,030 | A | 10/1950 | Kagan |
| 2,543,579 | A | 2/1951 | Kauffmann, II |
| 2,547,238 | A | 4/1951 | Tremblay |
| 2,547,382 | A | 4/1951 | Freeman |
| 2,548,437 | A | 4/1951 | Mantagas |
| 2,566,488 | A | 9/1951 | Gould |
| 2,570,529 | A | 10/1951 | Dolan |
| 2,576,067 | A | 11/1951 | Chandler |
| 2,587,111 | A | 2/1952 | Cashen, Jr. |
| 2,602,315 | A | 7/1952 | Shoop et al. |
| 2,645,863 | A | 7/1953 | Morrison |
| 2,650,442 | A | 9/1953 | Johnson |
| D170,556 | S | 10/1953 | Sterling |
| 2,654,386 | A | 10/1953 | Wotring |
| 2,657,566 | A | 11/1953 | Richterkessing |
| 2,664,646 | A | 1/1954 | Bourner |
| 2,665,183 | A | 1/1954 | Battles |
| 2,668,091 | A | 2/1954 | Clark |
| 2,687,566 | A | 8/1954 | Hall |
| 2,707,837 | A | 5/1955 | Robinson et al. |
| 2,707,874 | A | 5/1955 | Glover, Jr. |
| 2,719,422 | A | 10/1955 | Golden |
| 2,728,481 | A | 12/1955 | Robinson et al. |
| 2,731,316 | A | 1/1956 | Cohen |
| 2,732,700 | A | 1/1956 | Dunn |
| 2,737,573 | A | 3/1956 | Olthuis |
| 2,742,708 | A | 4/1956 | McCormick |
| 2,742,710 | A | 4/1956 | Richterkessing |
| 2,758,387 | A | 8/1956 | Stann |
| 2,759,277 | A | 8/1956 | Malnick |
| 2,813,534 | A | 11/1956 | Low |
| 2,773,373 | A | 12/1956 | Corson |
| 2,919,340 | A | 12/1956 | Jacobs |
| D179,475 | S | 1/1957 | Emile et al. |
| 2,778,705 | A | 1/1957 | Barker |
| 2,786,730 | A | 3/1957 | Thurston |
| 2,787,849 | A | 4/1957 | Lacey |
| 2,903,711 | A | 4/1957 | Kesling |
| 2,799,948 | A | 7/1957 | Morrison |
| 2,807,503 | A | 9/1957 | Buterbaugh |
| 2,813,353 | A | 11/1957 | McMillan |
| 2,817,157 | A | 12/1957 | McCormick |
| 2,817,501 | A | 12/1957 | Schubert |
| 2,843,945 | A | 7/1958 | Whyte |
| 2,861,355 | A | 11/1958 | Douglas |
| 3,001,844 | A | 5/1959 | Spring |
| 2,893,807 | A | 7/1959 | Earle |
| 2,895,618 | A | 7/1959 | Nathan |
| 2,895,782 | A | 7/1959 | Fragale |
| 2,960,780 | A | 11/1960 | Stilwell, Jr. |
| 2,967,670 | A | 1/1961 | McRoberts |
| 2,979,932 | A | 4/1961 | Hughes |
| 2,983,050 | A | 5/1961 | Alaback |
| 2,985,967 | A | 5/1961 | Pataillot et al. |
| 3,000,108 | A | 9/1961 | Jones et al. |
| 3,022,589 | A | 2/1962 | Kleinman |
| 3,026,699 | A | 3/1962 | Rhodes |
| 3,030,792 | A | 4/1962 | Bader |
| 3,031,871 | A | 5/1962 | Bailey |
| 3,059,653 | A | 10/1962 | Ingolia |
| 3,061,942 | A | 11/1962 | Scofield |
| 3,086,657 | A | 4/1963 | Myers et al. |
| D195,518 | S | 6/1963 | Bullock et al. |
| 3,170,417 | A | 2/1965 | Avidiya |
| 3,173,730 | A | 3/1965 | Collins |
| 3,197,886 | A | 8/1965 | Brame et al. |
| 3,209,560 | A | 10/1965 | Shelton |
| 3,220,230 | A | 11/1965 | Jacobs et al. |
| 3,220,790 | A | 11/1965 | White |
| 3,230,961 | A | 1/1966 | Benkert et al. |
| 3,245,161 | A | 4/1966 | Adiletta et al. |
| 3,256,616 | A | 6/1966 | McGoldrick |
| 3,316,659 | A | 5/1967 | Lauck |
| 3,320,780 | A | 5/1967 | Frahm |
| 3,331,226 | A | 7/1967 | Fink |
| 3,344,532 | A | 10/1967 | Bigler |
| 3,356,841 | A | 12/1967 | Horan |
| 3,399,783 | A | 9/1968 | Injeski |
| 3,402,477 | A | 9/1968 | Hubbard |
| 3,406,645 | A | 10/1968 | Monroe |
| 3,417,481 | A | 12/1968 | Rumsey, Jr. |
| 3,418,665 | A | 12/1968 | Long |
| 3,427,831 | A | 2/1969 | Frauendorf |
| 3,432,939 | A | 3/1969 | Eichholz |
| 3,469,603 | A | 9/1969 | Nagel |
| 3,490,254 | A | 1/1970 | Mason |
| 3,500,666 | A | 3/1970 | Calcaterra |
| 3,506,321 | A | 4/1970 | Hampel |
| 3,512,379 | A | 5/1970 | Buckley et al. |
| 3,522,817 | A | 8/1970 | Raymond |
| 3,527,352 | A | 9/1970 | Lapa |
| 3,537,110 | A | 11/1970 | Horie |
| 3,555,701 | A | 1/1971 | Hubbard |
| 3,559,427 | A | 2/1971 | Baker |
| 3,563,624 | A | 2/1971 | Stice |
| 3,579,851 | A | 5/1971 | Elmy |
| 3,606,506 | A | 9/1971 | Ungaro |
| 3,619,830 | A | 11/1971 | Harris et al. |
| 3,670,425 | A | 6/1972 | Benjamin et al. |
| 3,688,706 | A | 9/1972 | Merryweather |
| 3,717,173 | A | 2/1973 | Nyberg et al. |
| 3,724,095 | A | 4/1973 | Laue et al. |
| 3,739,496 | A | 6/1973 | Buckley et al. |
| 3,743,372 | A | 7/1973 | Ruggerone |
| 3,744,402 | A | 7/1973 | Piegza et al. |
| 3,744,435 | A | 7/1973 | Tracy et al. |
| 3,745,676 | A | 7/1973 | Dikoff |
| 3,774,742 | A | 11/1973 | Magnanelli |
| 3,793,744 | A | 2/1974 | Saita |
| 3,811,198 | A | 5/1974 | Baltes |
| 3,840,998 | A | 10/1974 | Marcussen |
| 3,866,336 | A | 2/1975 | Bereza |
| 3,926,315 | A | 12/1975 | Bernard |
| 3,958,586 | A | 5/1976 | Schnelle |
| 3,981,404 | A | 9/1976 | Goeke |
| 3,983,583 | A | 10/1976 | Herman et al. |
| 4,002,383 | A | 1/1977 | Holloway, Jr. |
| 4,086,709 | A | 5/1978 | Jackson |
| 4,091,155 | A | 5/1978 | Behr |
| 4,094,414 | A | 6/1978 | Thiot et al. |
| 4,109,397 | A | 8/1978 | Daily |
| 4,120,180 | A | 10/1978 | Jedora |
| D251,165 | S | 2/1979 | Moody |
| 4,171,545 | A | 10/1979 | Kann |
| 4,180,919 | A | 1/1980 | Baltes |
| 4,221,441 | A | 9/1980 | Bain |
| 4,243,197 | A | 1/1981 | Wright |
| D258,293 | S | 2/1981 | Macowski |
| 4,262,605 | A | 4/1981 | Sokol |
| 4,510,778 | A | 4/1985 | Cotton |
| 4,557,058 | A | 12/1985 | Ozawa et al. |
| D283,474 | S | 4/1986 | Appel |
| 4,602,446 | A | 7/1986 | Guion |
| 4,617,743 | A | 10/1986 | Barnard |
| 4,621,003 | A | 11/1986 | O'Kane |
| D286,958 | S | 12/1986 | Gualtieri |
| 4,625,432 | A | 12/1986 | Baltes |
| 4,637,321 | A | 1/1987 | Hasler et al. |
| 4,653,200 | A | 3/1987 | Werner |
| 4,663,538 | A | 5/1987 | Cotton et al. |
| 4,682,424 | A | 7/1987 | Irving |
| 4,713,949 | A | 12/1987 | Wilcox |
| 4,723,583 | A | 2/1988 | Lowe et al. |
| 4,734,826 | A | 3/1988 | Wilson et al. |
| 4,760,929 | A | 8/1988 | Fedorchak |
| 4,799,743 | A | 1/1989 | Kikuchi et al. |

(56) References Cited

U.S. PATENT DOCUMENTS

| | | | |
|---|---|---|---|
| 4,819,341 | A | 4/1989 | Gayso |
| 4,856,206 | A | 8/1989 | Klein |
| 4,857,703 | A | 8/1989 | Wilkins |
| 4,863,222 | A | 9/1989 | Posso |
| 4,894,935 | A | 1/1990 | Kretz |
| D306,240 | S | 2/1990 | Newhouse |
| 4,901,871 | A | 2/1990 | Ohm et al. |
| 4,908,957 | A | 3/1990 | Acosta, Sr. et al. |
| 4,919,368 | A | 4/1990 | Garrett |
| 4,926,514 | A | 5/1990 | Leuenberger |
| 4,995,681 | A | 2/1991 | Parnell |
| D315,068 | S | 3/1991 | Miller |
| 5,018,628 | A | 5/1991 | Schenck et al. |
| 5,019,126 | A | 5/1991 | Post |
| 5,046,844 | A | 9/1991 | Milton |
| 5,058,403 | A | 10/1991 | Barnes |
| 5,062,219 | A | 11/1991 | Harris et al. |
| 5,121,698 | A | 6/1992 | Kelley |
| D328,171 | S | 7/1992 | Hikawa |
| 5,136,792 | A | 8/1992 | Janecke |
| 5,147,090 | A | 9/1992 | Mandell et al. |
| 5,152,077 | A | 10/1992 | Liang |
| D331,257 | S | 11/1992 | Breen et al. |
| 5,165,181 | A | 11/1992 | Acosta, Sr. et al. |
| 5,181,685 | A | 1/1993 | Ostapowicz |
| 5,203,044 | A | 4/1993 | Jung, Jr. |
| D336,706 | S | 6/1993 | Lechman et al. |
| 5,241,766 | A | 9/1993 | Walz et al. |
| 5,253,378 | A | 10/1993 | Jung, Jr. |
| 5,253,493 | A | 10/1993 | Ohashi |
| 5,253,932 | A | 10/1993 | Nesovic |
| 5,279,047 | A | 1/1994 | Janecke |
| 5,290,998 | A | 3/1994 | Couch et al. |
| 5,294,009 | A | 3/1994 | Maurer et al. |
| 5,301,376 | A | 4/1994 | Herbert |
| 5,305,484 | A | 4/1994 | Fitzpatrick et al. |
| 5,315,726 | A | 5/1994 | Borenstein |
| 5,315,773 | A | 5/1994 | Iwami et al. |
| 5,337,905 | A | 8/1994 | Gast |
| D350,646 | S | 9/1994 | Bescher et al. |
| 5,369,892 | A | 12/1994 | Dhaemers |
| 5,381,574 | A | 1/1995 | VonPless |
| 5,402,657 | A | 4/1995 | Henry, Jr. |
| 5,411,164 | A | 5/1995 | Smith et al. |
| 5,452,531 | A | 9/1995 | Graville et al. |
| 5,461,887 | A | 10/1995 | VonPless |
| 5,466,058 | A | 11/1995 | Chan |
| D365,224 | S | 12/1995 | Pohlman |
| 5,486,041 | A | 1/1996 | Sykes |
| 5,518,309 | A | 5/1996 | St-Pierre |
| 5,528,912 | A | 6/1996 | Weber |
| 5,546,678 | A | 8/1996 | Dhaemers |
| 5,555,640 | A | 9/1996 | Ou |
| D374,954 | S | 10/1996 | Katz et al. |
| 5,568,691 | A | 10/1996 | Rubin |
| 5,570,598 | A | 11/1996 | Haven |
| 5,609,047 | A | 3/1997 | Hellman, Jr. et al. |
| 5,653,221 | A | 8/1997 | Luken et al. |
| 5,664,339 | A | 9/1997 | Swanson et al. |
| 5,666,743 | A | 9/1997 | Dawson |
| 5,702,010 | A | 12/1997 | Liang |
| 5,706,678 | A | 1/1998 | Sasaki |
| 5,733,022 | A | 3/1998 | Whetstone |
| 5,743,025 | A | 4/1998 | Jordan, Jr. |
| 5,755,040 | A | 5/1998 | Ou |
| D395,639 | S | 6/1998 | Ham et al. |
| 5,778,573 | A | 7/1998 | Nottingham et al. |
| 5,787,615 | A | 8/1998 | Hensel et al. |
| D398,906 | S | 9/1998 | Fynn et al. |
| 5,806,207 | A | 9/1998 | Merrigan |
| 5,815,961 | A | 10/1998 | Estes et al. |
| 5,836,486 | A | 11/1998 | Ohsugi |
| D401,782 | S | 12/1998 | Mitchell |
| 5,858,521 | A | 1/1999 | Okuda et al. |
| 5,900,258 | A | 5/1999 | Engler |
| D410,351 | S | 6/1999 | Magnusson et al. |
| 5,951,127 | A | 9/1999 | Smith |
| 5,957,557 | A | 9/1999 | Langer et al. |
| 5,967,342 | A | 10/1999 | Steffine |
| 5,974,980 | A | 11/1999 | Kent |
| 5,983,808 | A | 11/1999 | Weil |
| 5,987,773 | A | 11/1999 | Lipscy |
| D417,701 | S | 12/1999 | Jack |
| 5,996,983 | A | 12/1999 | Laurenzi |
| 6,000,158 | A | 12/1999 | Zoellner |
| 6,016,610 | A | 1/2000 | Sears |
| 6,036,150 | A | 3/2000 | Lehrman |
| 6,082,841 | A | 7/2000 | Smith et al. |
| 6,101,741 | A | 8/2000 | Sears |
| D431,130 | S | 9/2000 | Thompson et al. |
| D431,934 | S | 10/2000 | Chininis |
| 6,131,929 | A | 10/2000 | Haley |
| 6,134,806 | A | 10/2000 | Dhaemers |
| 6,135,583 | A | 10/2000 | Simon et al. |
| 6,138,979 | A | 10/2000 | Morman |
| D433,248 | S | 11/2000 | Hellwig et al. |
| 6,151,795 | A | 11/2000 | Hoffman et al. |
| D435,741 | S | 1/2001 | Schlereth |
| D436,952 | S | 1/2001 | Goto |
| D438,047 | S | 2/2001 | Chavez |
| 6,189,346 | B1 | 2/2001 | Chen et al. |
| 6,219,876 | B1 | 4/2001 | Blum |
| 6,253,472 | B1 | 7/2001 | Gast |
| 6,263,591 | B1 | 7/2001 | La Porte |
| 6,263,708 | B1 | 7/2001 | Yarmosky |
| 6,267,462 | B1 | 7/2001 | Krause et al. |
| D446,891 | S | 8/2001 | Kim |
| 6,279,876 | B1 | 8/2001 | Massie |
| 6,311,945 | B1 | 11/2001 | D'Angelo |
| 6,353,954 | B1 | 3/2002 | Dunsbergen et al. |
| 6,374,644 | B1 | 4/2002 | Rhode et al. |
| 6,375,686 | B1 | 4/2002 | Kim |
| D457,749 | S | 5/2002 | Doane |
| D457,991 | S | 5/2002 | Baldwin et al. |
| D457,992 | S | 5/2002 | Baldwin et al. |
| 6,386,378 | B1 | 5/2002 | Scharing |
| 6,397,502 | B1 | 6/2002 | Chen |
| D459,844 | S | 7/2002 | Baldwin et al. |
| 6,427,259 | B1 | 8/2002 | Cawthon |
| D463,631 | S | 9/2002 | Baldwin et al. |
| 6,448,306 | B1 | 9/2002 | Lever et al. |
| D465,308 | S | 11/2002 | Resuello et al. |
| 6,475,594 | B2 | 11/2002 | Johnston et al. |
| 6,482,242 | B2 | 11/2002 | Yarmosky |
| 6,484,645 | B2 | 11/2002 | Allen |
| 6,510,280 | B1 | 1/2003 | Chen |
| D474,566 | S | 5/2003 | Baldwin et al. |
| 6,572,208 | B2 | 6/2003 | Albaizar et al. |
| 6,585,225 | B1 | 7/2003 | Lake |
| 6,588,238 | B1 | 7/2003 | Reason |
| 6,604,473 | B2 | 8/2003 | Felsenthal |
| 6,611,972 | B2 | 9/2003 | Underbrink et al. |
| 6,618,887 | B2 | 9/2003 | Kim et al. |
| D489,496 | S | 5/2004 | Sneddon |
| 6,732,552 | B2 | 5/2004 | Kim et al. |
| D492,073 | S | 6/2004 | Sneddon |
| 6,745,496 | B2 | 6/2004 | Cassella |
| D492,507 | S | 7/2004 | Moon et al. |
| D495,453 | S | 8/2004 | Baldwin et al. |
| 6,793,991 | B2 | 9/2004 | Thuma et al. |
| 6,796,055 | B2 | 9/2004 | Baltes |
| D497,162 | S | 10/2004 | Neal et al. |
| 6,845,569 | B1 | 1/2005 | Kim |
| 6,846,871 | B2 | 1/2005 | Patel et al. |
| D501,615 | S | 2/2005 | Chen |
| D502,577 | S | 3/2005 | Baldwin et al. |
| 6,860,032 | B2 | 3/2005 | Meyer |
| 6,866,336 | B2 | 3/2005 | De Gaillard |
| 6,868,621 | B1 | 3/2005 | Grimm et al. |
| D504,038 | S | 4/2005 | Perella et al. |
| 6,883,257 | B2 | 4/2005 | Couch et al. |
| 6,886,373 | B2 | 5/2005 | Carrubba et al. |
| 6,889,399 | B2 | 5/2005 | Steiner et al. |
| 6,889,449 | B2 | 5/2005 | Silver |

(56) References Cited

U.S. PATENT DOCUMENTS

| | | | |
|---|---|---|---|
| D506,090 | S | 6/2005 | Ben-Or |
| 6,910,292 | B2 | 6/2005 | Prows |
| D508,346 | S | 8/2005 | Petruccelli |
| D519,692 | S | 4/2006 | Jun |
| 7,036,243 | B2 | 5/2006 | Doh et al. |
| 7,062,871 | B1 | 6/2006 | Smidt |
| 7,065,904 | B2 | 6/2006 | Lee et al. |
| D524,079 | S | 7/2006 | Grosfillex |
| D526,453 | S | 8/2006 | Jun |
| 7,100,316 | B2 | 9/2006 | Obileye |
| D532,455 | S | 11/2006 | Beardslee |
| D534,215 | S | 12/2006 | Nakata |
| 7,171,761 | B1 | 2/2007 | Hunts |
| 7,191,546 | B2 | 3/2007 | Maruca |
| 7,207,197 | B2 | 4/2007 | North |
| D541,563 | S | 5/2007 | LaBonia, Jr. et al. |
| 7,213,792 | B2 | 5/2007 | Choi |
| 7,251,905 | B2 | 8/2007 | Doh et al. |
| 2002/0017117 | A1 | 2/2002 | Sunshine et al. |
| 2002/0043604 | A1 | 4/2002 | Cooper et al. |
| 2002/0137631 | A1 | 9/2002 | Falder et al. |
| 2003/0019798 | A1 | 1/2003 | Capps et al. |
| 2003/0074105 | A1 | 4/2003 | Capps et al. |
| 2003/0196460 | A1 | 10/2003 | Lyu et al. |
| 2003/0222085 | A1 | 12/2003 | Kaczmarek |
| 2004/0022405 | A1 | 2/2004 | Caron et al. |
| 2004/0034924 | A1 | 2/2004 | Underbrink et al. |
| 2004/0040084 | A1 | 3/2004 | Underbrink et al. |
| 2004/0040476 | A1 | 3/2004 | Diers |
| 2004/0134237 | A1 | 7/2004 | Sunshine et al. |
| 2004/0144140 | A1 | 7/2004 | Lee |
| 2004/0154194 | A1 | 8/2004 | Prows |
| 2004/0160150 | A1 | 8/2004 | Hay et al. |
| 2004/0181979 | A1 | 9/2004 | Compeau et al. |
| 2004/0182288 | A1 | 9/2004 | Goldberg et al. |
| 2004/0194339 | A1 | 10/2004 | Johnson et al. |
| 2004/0221411 | A1 | 11/2004 | Blum et al. |
| 2004/0221624 | A1 | 11/2004 | Fumagalli |
| 2004/0226320 | A1 | 11/2004 | Bongini |
| 2004/0245899 | A1 | 12/2004 | Cho |
| 2004/0263032 | A1 | 12/2004 | Cho |
| 2005/0017605 | A1 | 1/2005 | Bauer |
| 2005/0035076 | A1 | 2/2005 | Schober et al. |
| 2005/0040070 | A1 | 2/2005 | Adams |
| 2005/0040184 | A1 | 2/2005 | Noyes et al. |
| 2005/0056059 | A1 | 3/2005 | Usherovich et al. |
| 2005/0072194 | A1 | 4/2005 | Ryohke et al. |
| 2005/0120585 | A1 | 6/2005 | Lee et al. |
| 2005/0120757 | A1 | 6/2005 | Jackson |
| 2005/0126035 | A1 | 6/2005 | Lee et al. |
| 2005/0132593 | A1 | 6/2005 | Doh et al. |
| 2005/0132594 | A1 | 6/2005 | Doh et al. |
| 2005/0132604 | A1 | 6/2005 | Hong et al. |
| 2005/0155393 | A1 | 7/2005 | Wright et al. |
| 2005/0275325 | A1 | 12/2005 | Yang |
| 2005/0284867 | A1 | 12/2005 | Sander et al. |
| 2007/0028479 | A1 | 2/2007 | Hunts |
| 2007/0051864 | A1 | 3/2007 | Bartell et al. |
| 2007/0113419 | A1 | 5/2007 | Belgard |

FOREIGN PATENT DOCUMENTS

| | | |
|---|---|---|
| DE | 662984 | 7/1938 |
| DE | 945683 | 7/1956 |
| DE | 2402065 | 7/1975 |
| DE | 8033429 | 5/1982 |
| DE | 3131532 A1 | 3/1983 |
| DE | 3211316 | 9/1983 |
| DE | 3213420 | 10/1983 |
| DE | 3409972 | 9/1985 |
| DE | 3417481 | 11/1985 |
| DE | 3904423 | 8/1990 |
| DE | 9104422 | 7/1991 |
| DE | 4105112 | 8/1992 |
| DE | 4228469 | 5/1993 |
| DE | 9419048 | 3/1995 |
| DE | 19514821 | 11/1995 |
| DE | 29606946 | 8/1996 |
| DE | 19604370 | 6/1997 |
| DE | 29704672 | 7/1997 |
| DE | 19716825 | 4/1998 |
| DE | 19750946 | 10/1998 |
| DE | 19832675 | 1/2000 |
| DE | 19838630 | 3/2000 |
| DE | 19922647 | 11/2000 |
| DE | 20101254 | 4/2001 |
| DE | 10055918 | 5/2002 |
| DE | 20302572 | 4/2003 |
| DE | 10223539 | 12/2003 |
| EP | 0050395 | 4/1982 |
| EP | 0265704 | 5/1988 |
| EP | 355701 | 2/1990 |
| EP | 0449060 | 10/1991 |
| EP | 1146161 | 10/2001 |
| EP | 1205129 | 5/2002 |
| EP | 1227182 | 7/2002 |
| EP | 1288367 | 3/2003 |
| EP | 1371307 | 12/2003 |
| EP | 1431442 | 6/2004 |
| EP | 1444922 | 8/2004 |
| EP | 1467015 | 10/2004 |
| EP | 1495697 | 1/2005 |
| EP | 1731654 | 12/2006 |
| FR | 1116286 | 5/1956 |
| FR | 2510881 | 2/1983 |
| FR | 2595937 | 9/1987 |
| FR | 2604196 | 3/1988 |
| FR | 2626016 | 7/1989 |
| FR | 2646674 | 11/1990 |
| FR | 2760761 | 9/1998 |
| GB | 326511 | 3/1930 |
| GB | 336679 | 10/1930 |
| GB | 384352 | 12/1932 |
| GB | 442615 | 2/1936 |
| GB | 582959 | 12/1946 |
| GB | 617965 | 2/1949 |
| GB | 618803 | 2/1949 |
| GB | 855965 | 12/1960 |
| GB | 1355656 | 6/1974 |
| GB | 1399827 | 7/1975 |
| GB | 2164552 | 3/1986 |
| GB | 2221970 | 2/1990 |
| GB | 2297982 | 8/1996 |
| GB | 2407860 | 5/2005 |
| JP | 64009000 | 1/1989 |
| JP | 01223998 | 9/1989 |
| JP | 02307414 | 12/1990 |
| JP | 03012196 | 1/1991 |
| JP | 03275099 | 12/1991 |
| JP | 426455 | 1/1992 |
| JP | 04187194 | 7/1992 |
| JP | 04220210 | 8/1992 |
| JP | 04220211 | 8/1992 |
| JP | 04220212 | 8/1992 |
| JP | 04220213 | 8/1992 |
| JP | 04220214 | 8/1992 |
| JP | 04237000 | 8/1992 |
| JP | 05277298 | 10/1993 |
| JP | 671100 | 3/1994 |
| JP | 06343794 | 12/1994 |
| JP | 07116395 | 5/1995 |
| JP | 07194661 | 8/1995 |
| JP | 07213792 | 8/1995 |
| JP | 07227495 | 8/1995 |
| JP | 08047599 | 2/1996 |
| JP | 8191998 | 7/1996 |
| JP | 8192000 | 7/1996 |
| JP | 08299070 | 11/1996 |
| JP | 09010492 | 1/1997 |
| JP | 09149826 | 6/1997 |
| JP | 10057699 | 3/1998 |
| JP | 11146995 | 6/1999 |
| JP | 2000218093 | 8/2000 |

(56) References Cited

FOREIGN PATENT DOCUMENTS

| | | |
|---|---|---|
| JP | 2000218095 | 8/2000 |
| JP | 2000225299 | 8/2000 |
| JP | 2001157800 | 6/2001 |
| JP | 2002000997 | 1/2002 |
| JP | 2002126395 | 5/2002 |
| JP | 2002136799 | 5/2002 |
| JP | 2002233693 | 8/2002 |
| JP | 2002322702 | 11/2002 |
| JP | 2003019382 | 1/2003 |
| JP | 2003114611 | 4/2003 |
| JP | 2003311097 | 11/2003 |
| KR | 200201898 | 11/2000 |
| KR | 1020040009401 | 1/2004 |
| WO | 8803579 | 5/1988 |
| WO | 9317601 | 9/1993 |
| WO | 9627309 | 9/1996 |
| WO | 9629458 | 9/1996 |
| WO | 9829595 | 7/1998 |
| WO | 0026463 | 5/2000 |
| WO | 03035961 | 5/2003 |
| WO | 2004063452 | 7/2004 |
| WO | 2004099308 | 11/2004 |
| WO | 2004109021 | 12/2004 |
| WO | 2004110214 | 12/2004 |
| WO | 2005001191 | 1/2005 |
| WO | 2005045121 | 5/2005 |
| WO | 2006073885 | 7/2006 |

OTHER PUBLICATIONS

Fragaria, Ezio, DE 9419048U1, Mar. 1995, English machine translation.*

Duerr et al., DE 19922647, Nov. 2000, English machine translation.*

NPL: Better Lifestyle Products; Rolling Mobile Laundry Ironing Center; Jul. 28, 2005; http://www.betterlifestyleproducts.com/mobile-laundry-center.html.

NPL: Bosch; Bosch Laundry Vertical Stacking Kit with Pull-Out Tray; Jul. 26, 2006; http://www.bosch appliances.com/customer_care/1492_423.asp.

NPL: Thor Appliance Company; Washing Machine—APEX by Thor; Jul. 26, 2005 http://thorappliances.com/apex/index.php, http://thorappliances.com/apex/images/apexzoom2.jpg, http://thorappliances.com/apex/apexAnatomy.php.

* cited by examiner

MODULAR LAUNDRY SYSTEM WITH WORK SURFACE

CROSS-REFERENCE TO RELATED APPLICATIONS

This application is a continuation of U.S. patent application Ser. No. 11/323,220, filed Dec. 30, 2005, now abandoned, and a continuation-in-part of U.S. patent application Ser. No. 11/323,221, filed Dec. 30, 2005, now U.S. Pat. No. 7,624,600, issued Dec. 1, 2009, which is a continuation-in-part of U.S. patent application Ser. No. 10/971,671, filed Oct. 22, 2004, now U.S. Pat. No. 7,513,132, issued Apr. 7, 2009, all of which are incorporated herein by reference in their entirety.

BACKGROUND OF THE INVENTION

1. Field of the Invention

The invention relates to a modular laundry system comprising at least one laundry appliance and an associated worksurface and/or an optional shelf module that can be configured to spatially and functionally optimize a household laundry area.

2. Description of the Related Art

Most homeowners utilize laundry appliances, such as a washer and a dryer, to clean clothing and other fabric items. The laundry appliances are located in a household laundry area that can be a dedicated laundry room, a laundry closet, or part of another room or hallway of the home. A common complaint of homeowners is that the laundry area tends to be an afterthought when the home is designed. Many feel that the laundry area is small, poorly arranged, and inefficient.

Regardless of size, the laundry area is not optimized for performing functions other than the conventional washing and drying done in the washer and dryer, such as flat drying, hang drying, ironing, hand steaming, spot pre-treatment, stain removal, and the like. Laundry areas contain, at most, the washer and dryer and possibly a built-in sink and storage cabinets. This configuration meets the basic needs of doing laundry but neither provides facilities for performing other functions nor optimizes the process of doing laundry. Examples of functional deficiencies of the laundry area follow.

For example, some clothes need to be hung or laid flat to dry after washing, but there is usually no dedicated space for these items. Consequently, some people hang clothes along the top of doors, on door knobs, on hooks attached to the washer, and in other creative locations. Furthermore, to touch up a wrinkled clothing item, people have to set up the ironing board and the iron, usually outside the laundry room, and then let the iron cool and return the ironing board and the iron to its storage location after ironing. This process is extremely inconvenient and time consuming, especially if only one garment needs to be touched up. In addition, storage is a common shortcoming in laundry areas; detergents, fabric softeners, stain pre-treatment aids, delicate garment bags, and the like are often stored in locations distant from where they are actually used.

Additionally, the laundry area typically does not provide flat surfaces that can be employed for, for example, applying stain pre-treatments, flat drying clothing items, or for folding clothes after they have been dried. Conventional laundry appliances provide a flat surface, but the surface is not particularly suited for some of these tasks. Further, the space between horizontally arranged laundry appliances can be annoying if such tasks are conducted on top of the laundry appliances, and clothing items can fall in the space between the laundry appliances. These examples are only a few of the many deficiencies of the laundry area.

To address some of these problems, a hodgepodge of different gadgets, such as sweater racks, accordion hanging racks, rolling shelves, and rolling laundry carts that store ironing boards and the like, have been made commercially available. However, these solutions are not ideal; some are inconvenient to store when not in use, others are not dimensioned to optimize the space of the laundry area, and all are not aesthetically coherent with the laundry appliances.

SUMMARY OF THE INVENTION

A modular laundry system according to the invention comprises a first laundry appliance having a housing with a closed top, a second laundry appliance having a housing with a closed top, and horizontally arranged in an adjacent relationship with the first laundry appliance to form a gap between the closed tops such that the closed tops collectively define a discontinuous upper surface having a width and a depth, and a single-piece rigid worksurface having a width and depth commensurate with the width and depth of the discontinuous upper surface and mountable to the first and second laundry appliances to rest on the closed tops and span the gap to form a continuous surface above the discontinuous upper surface.

DESCRIPTION OF EMBODIMENTS OF THE INVENTION

Figure 1:
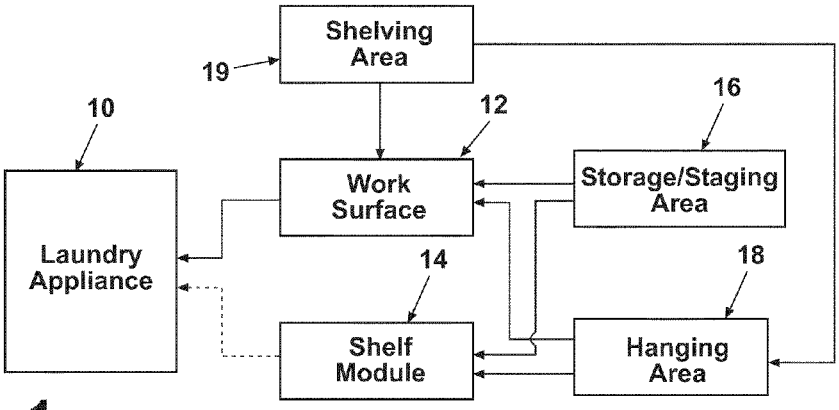
FIG. 1 is a schematic diagram of a modular laundry system including a laundry appliance with at least one of a worksurface and an optional shelf module, each having an optional storage/staging and/or hanging area and the worksurface having an optional shelving area.

A modular laundry system according to one embodiment of the invention comprises at least one laundry appliance 10 and a worksurface 12. The modular laundry system can optionally comprise a shelf module 14 in addition to the worksurface 12 or instead of the worksurface 12. Each of the worksurface 12 and the shelf module 14 can optionally have at least one of a storage/staging area 16 and a hanging area 18. The worksurface 12 can further include a shelving area 19, which is inherent in the shelf module 14. According to one embodiment of the invention, the modular laundry system comprises two laundry appliances 10 and at least one of the worksurface 12 and the shelf module 14, which can be selected and configured to provide desired laundry care functionality within a given laundry area. The laundry area is a space of a home in which the laundry appliance 10 conventionally resides. The laundry area can be, for example, a dedicated laundry room, a shared room, such as a combined laundry and utility room or a combined laundry room and garage, a closet, or part of another room or hallway of the home.

The laundry appliance 10 is a conventional appliance for washing and drying fabric items, such as clothes and linens. Examples of the laundry appliance 10 include, but are not limited to, a washing machine, including top-loading, front-loading, vertical axis, and horizontal axis washing machines, a dryer, such as a tumble dryer, including top-loading dryers and front-loading dryers, a combination washing machine and dryer, a tumbling refreshing machine, an extractor, a combination washer and dryer, and a non-aqueous washing apparatus. An exemplary non-aqueous washing apparatus is disclosed in U.S. Patent Application Publication No. 2005/0155393, which is incorporated herein by reference in its entirety. The non-aqueous washing apparatus of the incorporated application publication comprises a wash unit and a reclamation unit, and the laundry appliance 10 can be the wash unit. When the laundry system comprises two of the laundry appliances 10, a first laundry appliance and a second laundry appliance, the first and second laundry appliances 10 can be the same type of laundry appliance, such as two washing machines, or different types of laundry appliances, such as a washing machine and a dryer.

The worksurface 12 is generally a horizontally-disposed element having an upper surface upon which various laundry-related tasks or functions can be performed including, but not limited to, sorting clothes, loading and unloading of clothes into a laundry appliance 10, folding clothes, ironing, spot cleaning, scrubbing, and the like. The worksurface 12 can also be used for performing non-laundry-related tasks or functions. The worksurface 12 is disposed above a top of at least one of the laundry appliances 10 and/or at least one other module of a modular laundry system. For example, the worksurface 12 can be disposed on top of a single laundry appliance 10, two laundry appliances 10 and a module, or three laundry appliances 10. When the worksurface 12 is provided on more than one supporting structure, i.e., more than one laundry appliance 10, more than one shelf module 14, more than one other module, or combinations of the laundry appliance 10, the shelf module 14, and the other module, the worksurface 12 preferably forms a generally continuous surface above the supporting structures. The generally continuous surface extends across interfaces between the supporting structures to effectively form a unitary surface for performing functions or tasks. The continuous surface can include seams, such as those inherently present when the worksurface 12 is formed by multiple interconnected pieces, as will be described in more detail below. The worksurface 12 can have any suitable longitudinal length (i.e. width), such as the longitudinal length of one or more laundry appliances 10 alone or in conjunction with the shelf module 14 and/or another module or structure.

Exemplary modules of the modular laundry system are disclosed in application Ser. No. 11/323,125, filed concurrently herewith, and titled "Modular Laundry System with Horizontal Modules," application Ser. No. 11/322,715, filed concurrently herewith, and titled "Modular Laundry System with Horizontal Module Spanning Two Laundry Appliances," application Ser. No. 11/323,221, filed concurrently herewith, and titled "Modular Laundry System with Horizontally Arranged Cabinet Module," application Ser. No. 11/322,739, filed concurrently herewith, and titled "Modular Laundry System with Horizontal and Vertical Modules," application Ser. No. 11/323,075, filed concurrently herewith, and titled "Modular Laundry System with Vertical Module," application Ser. No. 11/323,147, filed concurrently herewith, and titled "Modular Laundry System with Cabinet Module," and application Ser. No. 11/322,742, filed concurrently herewith, and titled "Laundry Module for Modular Laundry System," which are incorporated herein by reference in their entirety. Other exemplary modules are disclosed in application Ser. No. 11/323,867, filed concurrently herewith, and titled "Vertical Laundry Module," application Ser. No. 11/322,943, filed concurrently herewith, and titled "Vertical Laundry Module with Backsplash," application Ser. No. 11/322,502, filed concurrently herewith, and titled "Non-Tumble Clothes Dryer," application Ser. No. 11/323,270, filed concurrently herewith, and titled "Ironing Station," and application Ser. No. 11/322,944, filed concurrently herewith, and titled "Sink Station with Cover," which are incorporated herein by reference in their entirety.

The shelf module 14 comprises at least one shelf that can be stowed or retracted into a storage position when not in use and extended to provide a generally horizontally-disposed surface upon which various laundry-related tasks can be performed including, but not limited to, sorting clothes, loading and unloading of clothes into a laundry appliance 10, folding, ironing, spot cleaning, scrubbing, and the like. The shelf of the shelf module 14 can be selectively positionable by a user so that the shelf can be stored and retrieved, respectively, to optimize the space used by the shelf module 14 within the laundry workspace.

The storage/staging area 16 is generally an enclosed (storage) or exposed (staging) region which can store cleaning (e.g., detergent, spot cleaners, etc.), pressing (e.g., starch), and other laundry-related products (e.g., fabric softener). When the storage/staging area 16 is exposed, the products are staged in a visible displayed fashion to make them readily-accessible to a user of the laundry appliance 10. The storage/staging area 16 is preferably associated with the worksurface 12 to store/stage the laundry-related products in a manner easily-accessible by a user adjacent to the worksurface 12 and who is typically performing laundry-related tasks on the worksurface 12, possibly requiring easy and immediate access to the laundry-related products in the storage/staging area 16.

The hanging area 18 is generally a mechanical implement for hanging clothes, whether draped over the hanging area 18 or arranged on a clothes hanger in a manner which would be apparent to one skilled in the art. Examples of the implements employed in the hanging area 18 according to the invention include, but are not limited to, a suspended horizontal rod supported at each end or in a cantilevered fashion by a medial center support. The hanging area 18 can also, according to the invention, be placed on a stand which surrounds at least one laundry appliance 10. The hanging area 18 can also include a vertically-adjustable stand which allows the clothes-hanging implement to be adjusted vertically with respect to ground level, the surrounding area, or an adjacent one or more laundry appliances 10 to allow the hanging area 18 to be extended so that clothing of varying lengths can be hung, or to store the hanging area 18 in a retracted position adjacent one or more laundry appliances 10 so that the hanging area 18 can be stored and selectively extended for use by a user.

The shelving area 19 of the worksurface 12 can comprise at least one shelf that can be stowed or retracted into a storage position when not in use and extended to provide a generally horizontally-disposed surface upon which various laundry-related tasks can be performed including, but not limited to, sorting clothes, loading and unloading of clothes into a laundry appliance 10, folding, ironing, spot cleaning, scrubbing, and the like. When in the stowed or retracted position, the shelf need not be concealed from view; rather, the shelf is positioned in a location different than when in use. Additionally, the shelf can be a static shelf with a fixed position. The shelving area 19 can also be integrated with the hanging area 18.

Figure 2:
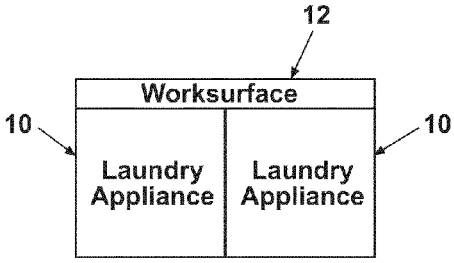
FIG. 2 is a schematic diagram of the modular laundry system shown in FIG. 1 comprising a pair of horizontally-disposed laundry appliances with a worksurface disposed across an upper surface of both appliances.
Figure 4:
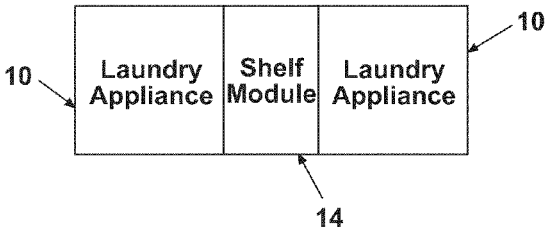
FIG. 4 is a schematic diagram of the modular laundry system shown in FIG. 1 comprising a pair of horizontally-disposed laundry appliances having a shelf module disposed between the laundry appliances.
Figure 3:
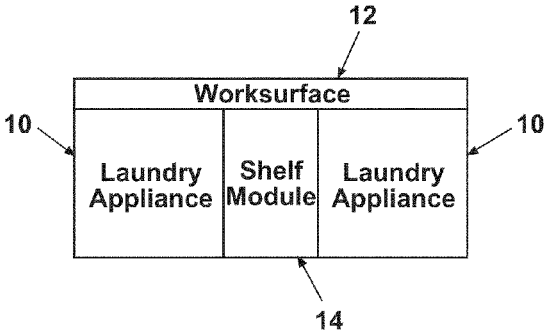
FIG. 3 is a schematic diagram of the modular laundry system shown in FIG. 1 comprising a pair of horizontally-disposed laundry appliances having a shelf module disposed between the laundry appliances and a worksurface disposed across an upper surface of both the laundry appliances and the shelf module.
Figure 5:
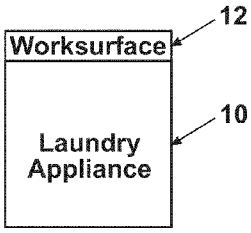
FIG. 5 is a schematic diagram of the modular laundry system shown in FIG. 1 comprising a single laundry appliance with a worksurface disposed horizontally across an upper surface of the laundry appliance.

Turning to the drawings, various configurations of the modular laundry system are shown by example in the schematic of FIG. 1 and the diagrams shown in FIGS. 2-5. FIG. 1 is a schematic diagram of a modular laundry system including a laundry appliance 10 with at least one worksurface 12 and/or an optional shelf module 14, each having an optional storage/staging area 16 and/or hanging area 18. FIG. 2 is a schematic diagram of the modular laundry system shown in FIG. 1 comprising a pair of horizontally-disposed laundry appliances 10 with a worksurface 12 disposed across an upper surface of both appliances 10. FIG. 3 is a schematic diagram of the modular laundry system shown in FIG. 1 comprising a pair of horizontally-disposed laundry appliances 10 having a shelf module 14 disposed between the laundry appliances 10 and a worksurface 12 disposed across an upper surface of both the laundry appliances 10 and the shelf module 14. FIG. 4 is a schematic diagram similar to FIG. 3, except that the modular laundry system of FIG. 4 does not include the worksurface 12. FIG. 5 is a schematic diagram of the modular laundry system shown in FIG. 1 comprising one laundry appliance 10 and a worksurface 12 disposed across the laundry appliance 10. It will be understood that these configurations are for illustrative purposes only, and that other configurations will be contemplated by one skilled in the art, and the particular examples selected for FIGS. 2-5 shall not be interpreted to limit the scope of the invention.

Figure 6:
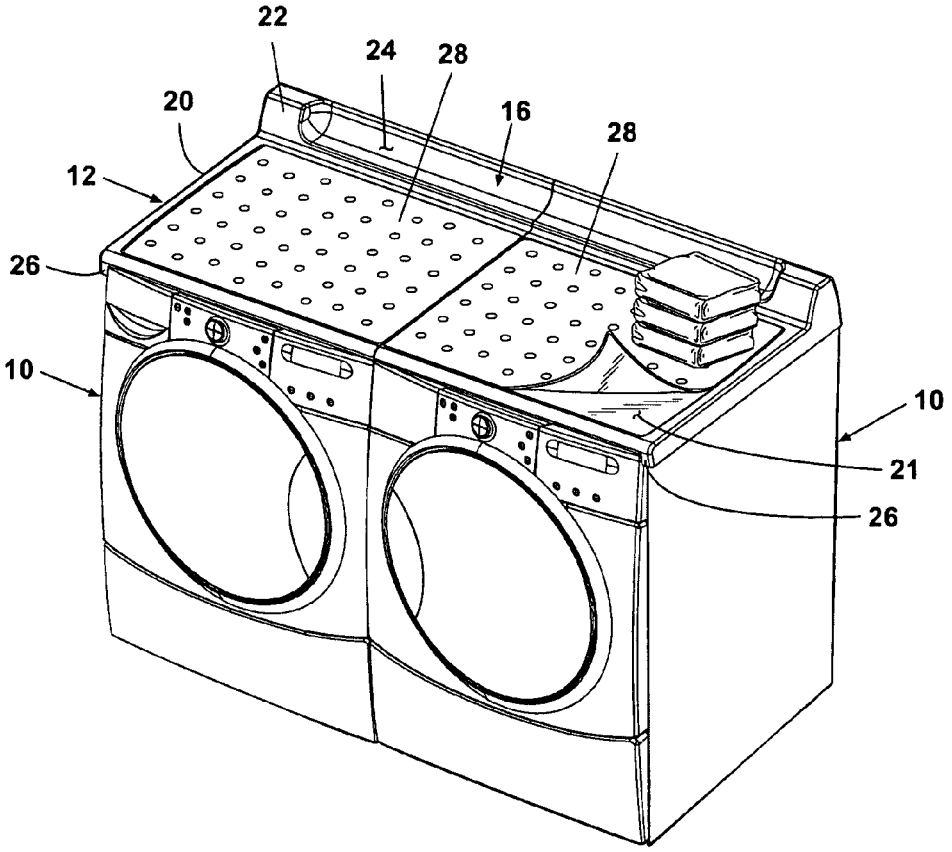
FIG. 6 is a perspective view of the modular laundry system shown in FIG. 1 comprising a pair of horizontally-disposed laundry appliances with a worksurface disposed across an upper surface of both appliances, in a similar configuration to that shown in FIG. 2.

Beginning with FIG. 6, various configurations for the modular laundry system are set forth in the drawings. It will be understood that the various examples of the laundry appliances 10, worksurfaces 12, and shelf modules 14 in one drawing can be interchanged with and substituted for examples of these components shown in other figures so that several additional combinations of these basic components of the invention are contemplated in this invention.

In addition, for simplicity of description and explanation, components of the laundry appliances 10, worksurfaces 12, shelf modules 14, the storage/staging area 16, the hanging area 18, and the shelving area 19 that are common between the various embodiments shown in the Figures herein are referred to with the same reference numerals.

FIG. 6 is a perspective view of the modular laundry system shown in FIG. 1 comprising a pair of horizontally-disposed laundry appliances 10 with a worksurface 12 disposed across an upper surface of both appliances 10, in a similar configuration to that shown in FIG. 2. The laundry appliances 10 in FIG. 6 are front-loading appliances, and while the worksurface 12 can be utilized with any type of laundry appliance 10, the front-loading laundry appliances 10 are ideally suited for use with the worksurface 12 because the worksurface 12, which is disposed on top of the laundry appliance 10, does not interfere with providing access to the interior of the laundry appliance 10. The various functions of the components 12, 14, 16, 18, and 19 are set forth above and will not be repeated embodiment-to-embodiment herein.

The worksurface 12 comprises a generally horizontal body 20 that can be rigid or flexible. For example, when the body 20 is flexible, the body 20 can be made of a flexible polymeric material, such as silicone or a flexible polyvinyl chloride. The body 20 can be made of any suitable material and can optionally comprise, such as by being made of, coated with, or impregnated with, a hygienic material, such as an antimicrobial, antibacterial, antifungal, or similar substance. The horizontal body 20 of the current embodiment has a backsplash 22 extending upwardly from a rear portion thereof. In the example shown in FIG. 6, the backsplash has a depth sufficient for the storage/staging area 16 to be formed therein as a recess 24. The recess 24 preferably extends substantially the width of the worksurface 12 to allow for as many laundry-related items to be stored within the storage/staging area 16 formed by the recess 24. Alternatively, the recess 24 can be broken up into non-contiguous segments or provided with dividers (not shown) to provide for additional organization of the storage/staging area 16 formed by the recess 24.

The worksurface 12 also has a pair of depending flanges 26 located at either longitudinal end of the worksurface 12. The flanges 26 preferably extend the length of each longitudinal end of the worksurface 12 and preferably define a space therebetween having a width into which the abutted laundry appliances 10 can fit. In one embodiment, the worksurface 12 can act as a retainer to hold the pair of laundry appliances 10 (and any items located therebetween) together. As will be described in more detail below, the underside of the worksurface 12 can be provided with a vibration dampener to reduce any noise caused by vibration between the laundry appliances 10 and/or the worksurface 12 during operation of either of the laundry appliances 10 and to prevent transference of vibrations from one of the laundry appliances 10 to the other of the laundry appliances 10 or from one of the laundry appliances 10 to the worksurface 12. In addition, a depending flange (not shown) can also be provided on a rear longitudinal edge of the worksurface 12 to assist in alignment of the rear surfaces of the adjacent (and typically abutted) laundry appliances 10. Similarly, a depending flange (not shown) can also be provided on a front longitudinal edge of the worksurface 12 to assist in alignment of the front surfaces of the adjacent (and typically abutted) laundry appliances 10.

The body 20 of the worksurface 12 can be configured as a unitary body, or as a "leaf-type" structure comprising multiple interconnected pieces allowing for various pieces having a width corresponding to, e.g., a width of a single laundry appliance 10, the width of another worksurface 12, or the width of a shelf module 14, or some other width, to be connected in leaf-type fashion and which is described in greater detail herein with respect to the exemplary embodiments shown in FIGS. 42-45.

An upper surface of the worksurface 12 can be provided with a functional insert 28 (shown as two rectangular components in FIG. 6). The functional insert 28 can be made of any suitable materials, including, but not limited to, polymers, such as rubber, fabrics, and composites of different types of materials. The functional insert 28 can optionally be textured according to the type of function to be performed thereon and can have any of a variety of functional coatings, such as anti-friction or anti-slip coatings. The functional insert 28 can also be entirely made of or impregnated with anti-friction or anti-slip materials. Further, the functional insert 28 can comprise a hygienic material or beneficial substrate, such as an antimicrobial, antibacterial, antifungal, or similar substance embedded therein or coated therewith. The functional insert 28 can be permanently coupled to the worksurface 12 or removable from the worksurface 12, such as for cleaning or replacement. According to one embodiment, the functional insert can be removed and placed in a dishwasher for cleaning. Dishwasher cleaning of the functional insert 28 ensures that the functional insert 28 is completely washed and sanitized. In addition, the functional insert 28 can be reversible with opposing surfaces configured for performing differing functions or tasks to allow for a plurality of different functions or tasks to be performed on the functional insert 28. For example, one side of the functional insert 28 can be provided with a surface suitable for scrubbing or handwashing an item of clothing while the reverse side of the functional insert 28 can be provided with a surface suitable for ironing. The functional insert 28 can also be used, for example, to cut fabric according to sewing patterns. For this task, the functional insert 28 can be adapted to receive pins for pinning the sewing patterns and fabric in place on the functional insert 28. In addition, the worksurface 12 can be provided with additional modular functional inserts 28 which can be substituted onto the worksurface 12 to provide for even greater flexibility in performing laundry-related functions on the worksurface 12. Preferably, the horizontal body 20 of the worksurface 12 comprises an insert recess 21 formed on the upper surface thereof into which the functional insert(s) 28 can be placed to provide for a pleasing appearance to the worksurface 12 with the functional inserts 28 provided thereon. Additionally, the insert recess 21 in the upper surface of the worksurface 12 can position the functional insert(s) 28 on the worksurface 12 and prevent the functional insert(s) 28 from the sliding off of the upper surface of the worksurface 12.

Figure 7:
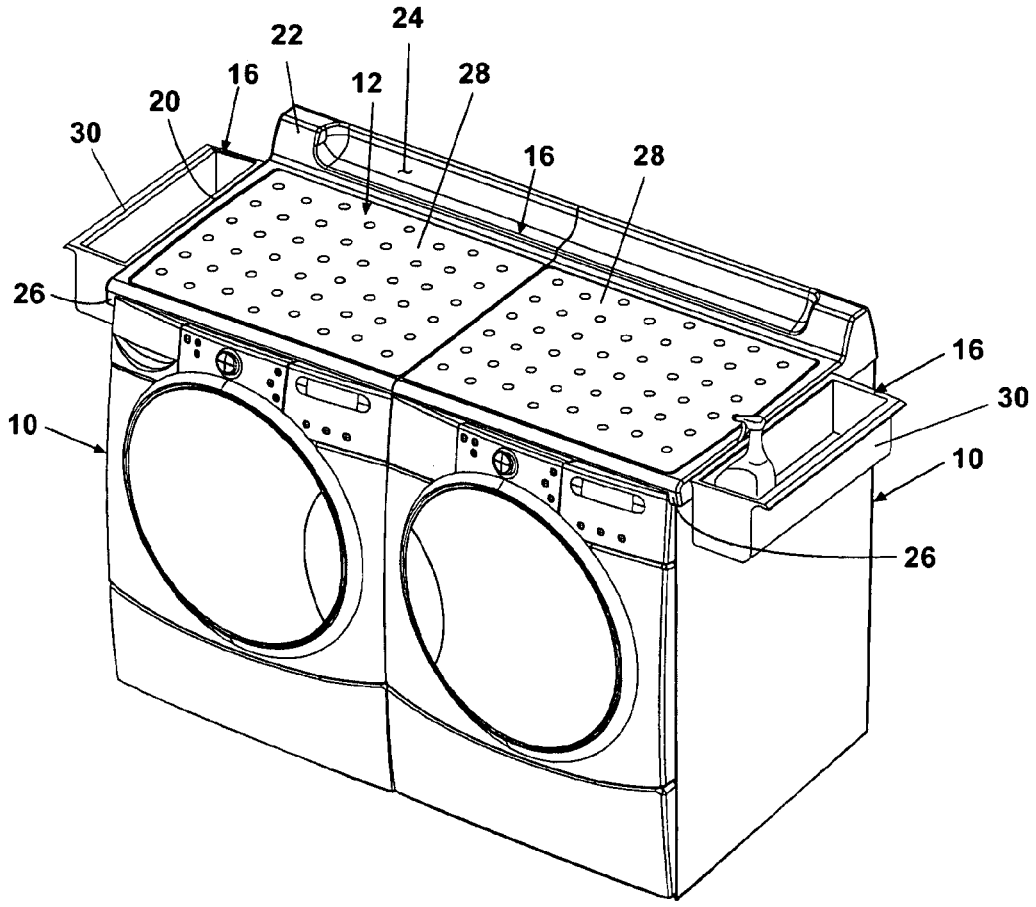
FIG. 7 is a perspective view of another embodiment of the modular laundry system similar to that shown in FIG. 6 whereby the worksurface is provided with a saddle-bag-type staging area.

FIG. 7 is a perspective view of another embodiment of the modular laundry system similar to that shown in FIG. 6 whereby the worksurface 12 is provided with an additional storage/staging area 16 comprising a saddle-bag staging bin 30. The saddle-bag staging bin 30 comprises a well attached to each longitudinal end of the worksurface 12 such that the staging bins 30 are located beyond a combined width of the laundry appliances 10. Laundry-related and non-laundry-related items can be stored in the staging bins 30 for easy access when working adjacent the laundry appliances 10 and/or the worksurface 12. The staging bin 30 can be formed integrally with the horizontal body or removably mounted thereto so that the staging bins 30 can be removed for replacement and/or cleaning. If the staging bin 30 is removably attached to the body 20 of the worksurface 12, the body 20 and the staging bin 30 can be provided with interlocking components, such as a socket and a detent, which would allow the attachment and disassembly of the staging bin 30 to the body 20 without the use of tools or a separate conventional fastener (although separate fasteners could be employed).

Figure 8:
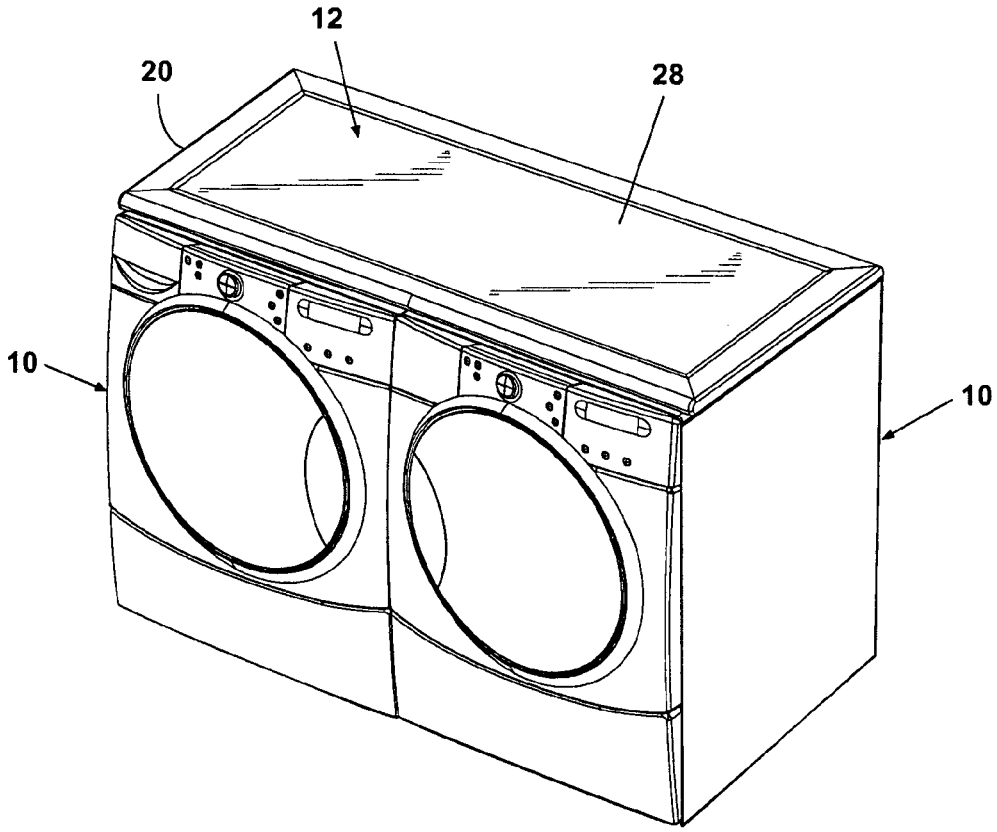
FIG. 8 is a perspective view of another embodiment of the worksurface shown in FIG. 6.
Figure 9:
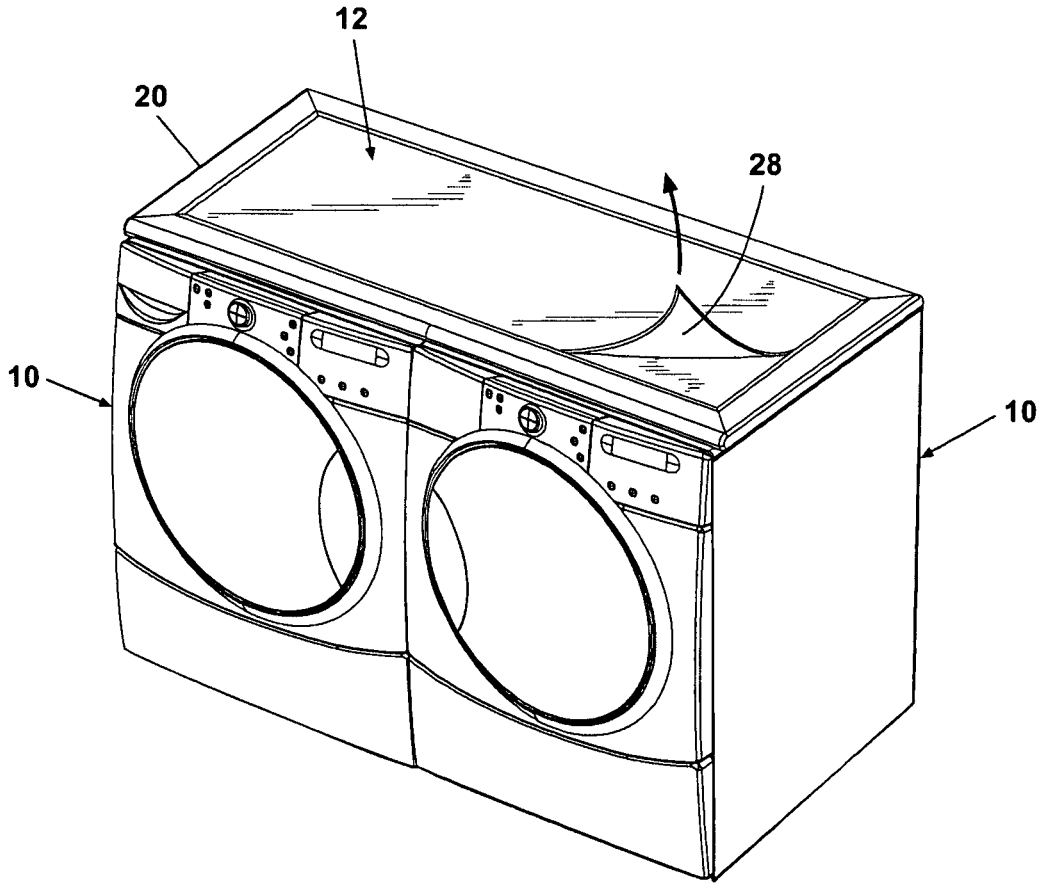
FIG. 9 is a perspective view of FIG. 8 wherein the worksurface is shown having a removable and reversible insert to allow for different types of laundry-related activities to be performed on the worksurface depending upon which side of the insert is exposed.

FIG. 8 is a perspective view of another embodiment of the worksurface 12 shown in FIG. 6. The embodiment of the worksurface shown in FIG. 8 is shown without the backsplash 22. The body 20 of the worksurface 12 is shown with a functional insert 28 provided thereon. FIG. 9 illustrates the removable and reversible nature of the functional insert 28 to allow for different types of laundry-related activities to be performed on the worksurface 12 depending upon which side of the worksurface 12 is exposed.

Figure 10:
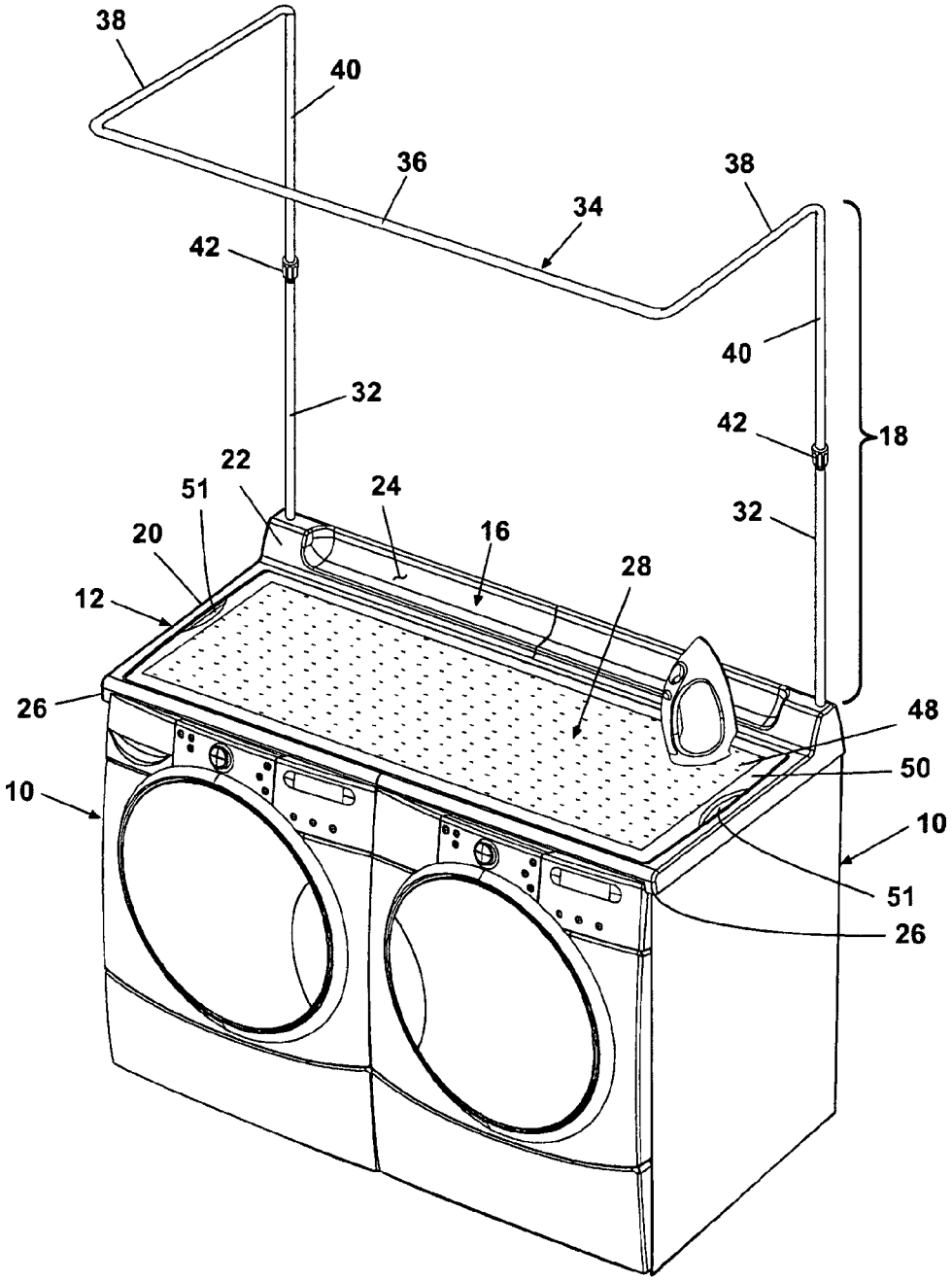
FIG. 10 is a perspective view of another embodiment of the modular laundry system similar to that shown in FIG. 6, wherein the worksurface is shown as including a reversible insert as described with respect to FIGS. 8-9, and the worksurface is provided with a rear staging area and an upwardly-extending hanging area.

FIG. 10 is a perspective view of another embodiment of the modular laundry system similar to that shown in FIG. 6, wherein the worksurface 12 is shown having a reversible functional insert 28 as described with respect to FIGS. 6-9, and the worksurface 12 is provided with a rear storage/staging area 16 and an upwardly-extending hanging area 18. The hanging area 18 comprises a cylindrical rod formed into a functional shape for hanging clothes and other laundry-related items thereon. In the example hanging area 18 shown in FIG. 10, the hanging area 18 comprises a pair of base rods 32, which are mounted to opposing longitudinal rear ends of the worksurface 12, each of which support an opposing end of a hanging rod 34. The hanging rod 34 comprises a U-shaped member formed by an elongated central rod 36 having a spacer rod 38 extending rearwardly therefrom at each longitudinal end thereof. Each spacer rod 38 terminates in a downwardly-extending extension rod 40 which, in turn, is telescopingly received in the base rod 32 by a selectively-adjustable clamp mount 42. Tightening the clamp mount 42, such as by rotation, secures the extension rod 40 at a particular height with respect to the base rod 32. Other variations on the clamp mount 42 would be apparent to one skilled in the art for retaining the extension rod 40 at a particular height with respect to the base rod 32, and the particular embodiment of the clamp rod 42 illustrated herein shall not be limiting on the scope of the invention.

Figure 11:
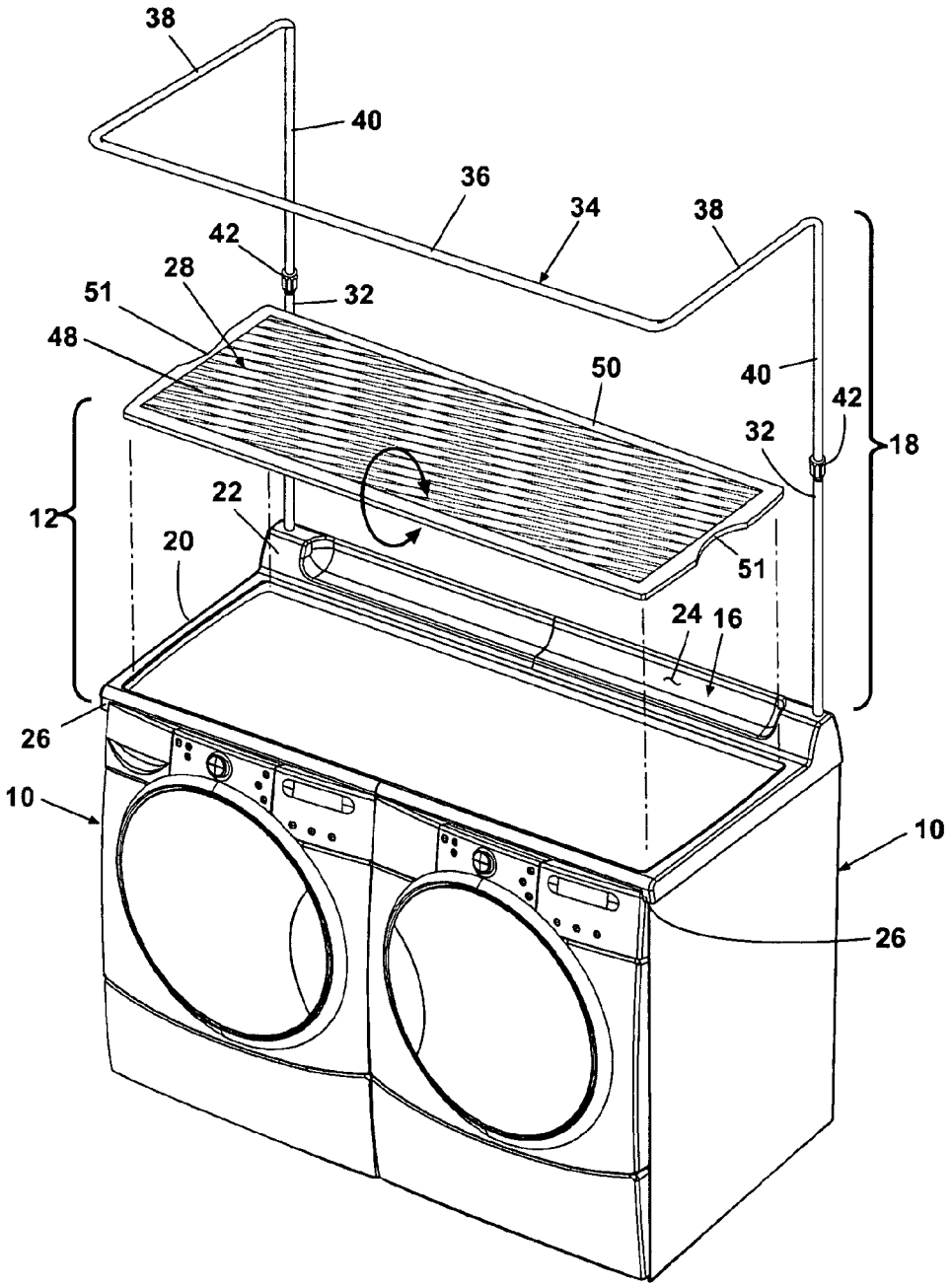
FIG. 11 is a perspective view similar to that shown in FIG. 10 illustrating the reversible nature of the insert.

FIG. 11 is a perspective view of the embodiment shown and described with respect to FIG. 10 illustrating the reversible nature of the functional insert 28 on the worksurface 12 which, in the example embodiment shown in FIGS. 10-11, extends across both horizontally-disposed laundry appliances 10. The functional insert 28 shown in FIGS. 10 and 11 comprises a mat 48 supported by a frame 50 having a pair of user graspable handles 51 that facilitate removal of the functional insert 28 and reversing the functional insert 28.

Figure 12:
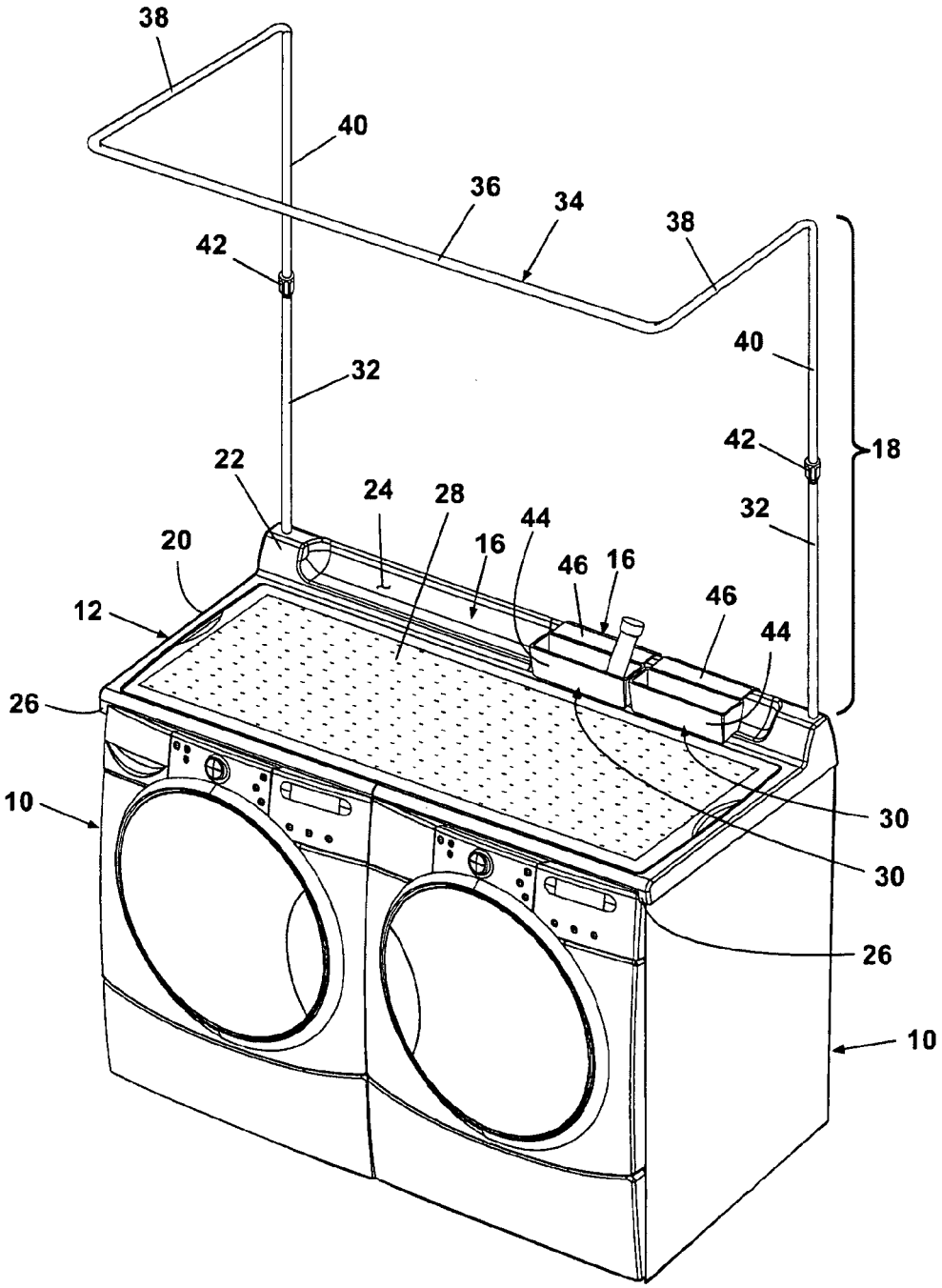
FIG. 12 is a perspective view similar to that shown in FIG. 10 illustrating the use of hanging storage compartments in a storage/staging area on the worksurface.
Figure 13:
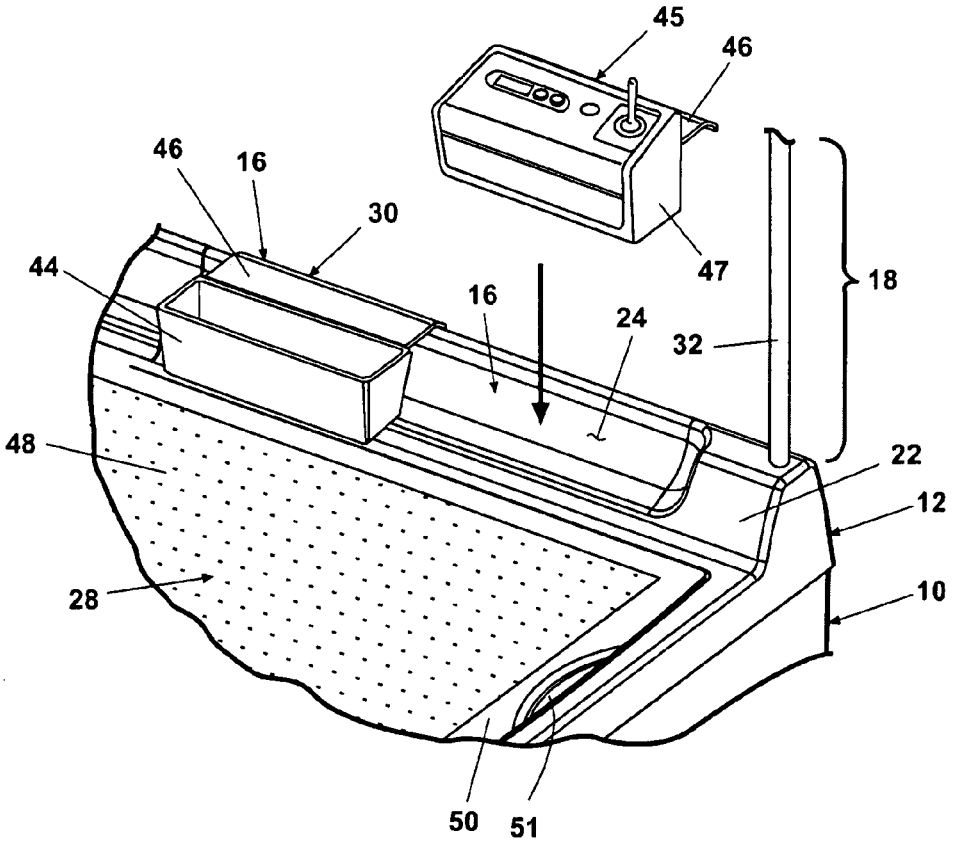
FIG. 13 is a perspective view showing one of the hanging storage compartments located in the staging area on the worksurface of FIG. 12 in greater detail and also showing a radio module located in the staging area on the worksurface.

FIG. 12 is a perspective view of the embodiment shown in FIG. 10 wherein the storage/staging area 16 further comprises at least one staging bin 30 in the staging recess 24 on the worksurface 12 extending across both horizontally-disposed laundry appliances 10. In this embodiment, the staging bin 30 comprises a well 44 with a rearwardly-extending flange 46 attached thereto. The staging bin 30 can be mounted within the staging recess 24 by hooking the flange 46 over an upper rear surface of the backsplash 22 located behind the staging recess 24. The staging bins 30 can be slid longitudinally along the staging recess 24 to further optimize the functionality of the storage/staging area 16 of the worksurface 12. FIG. 13 is a perspective view showing one of the staging bins 30 located in the storage/staging area 16 on the worksurface 12 of FIG. 12 in greater detail and also showing a radio module 45 staged in the staging recess 24. The radio module 45 comprises a body 47 sized for receipt within the staging recess 24 and a rearwardly-extending flange 46 attached thereto. Similar to the staging bin 30, the radio module 45 can be mounted within the staging recess 24 by hooking the flange 46 over an upper rear surface of the backsplash 22 located behind the staging recess 24. It is within the scope of the invention to stage modules other than the staging bin 30 and the radio module 45 in the storage recess 24.

Figure 14:
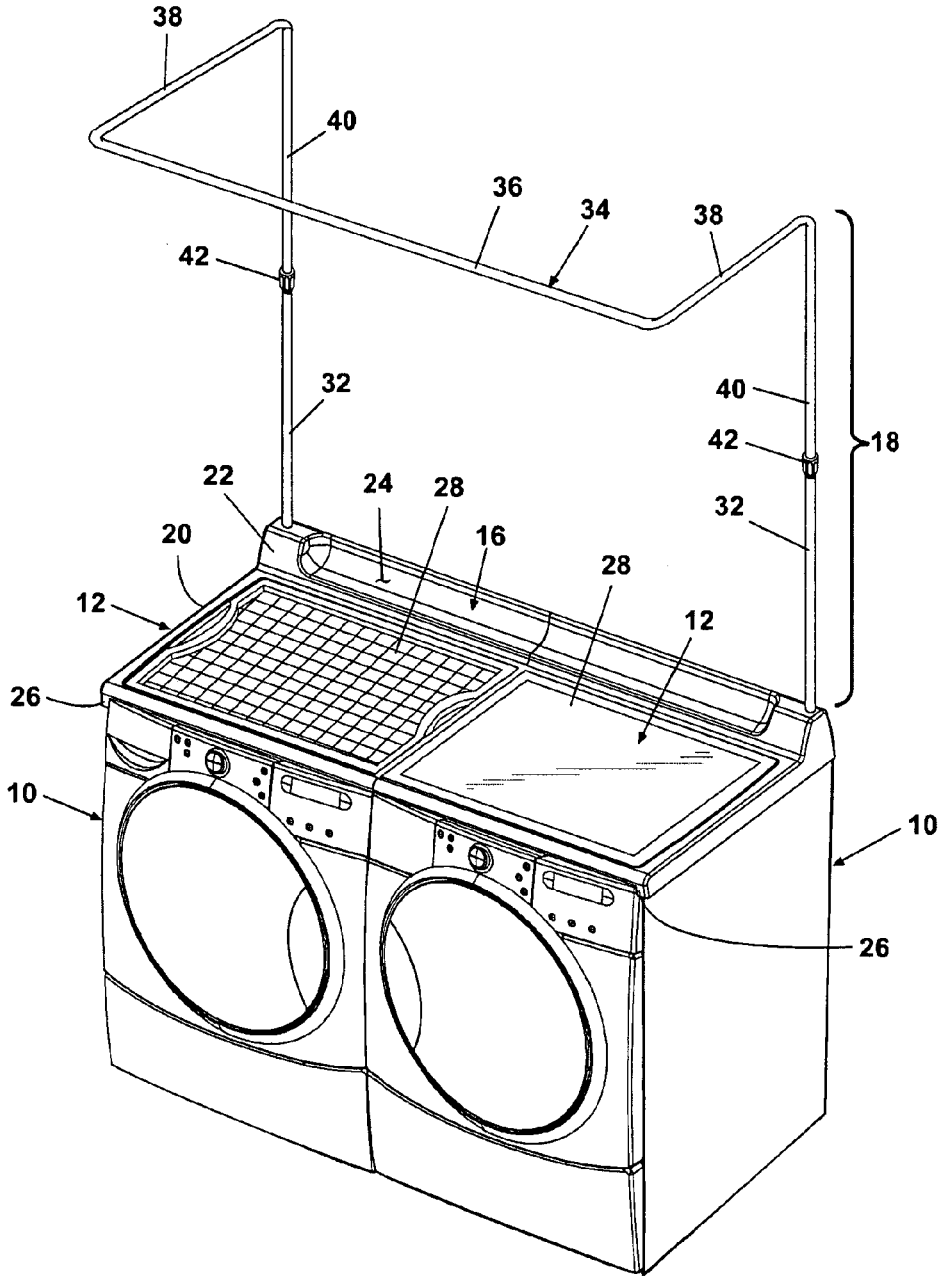
FIG. 14 is a perspective view of another embodiment of the modular laundry system similar to that shown in FIG. 10, wherein the insert is shown as a pair of adjacent, rectangular mats, each of which is reversible to expose a different functional surface of the respective insert.
Figure 15:
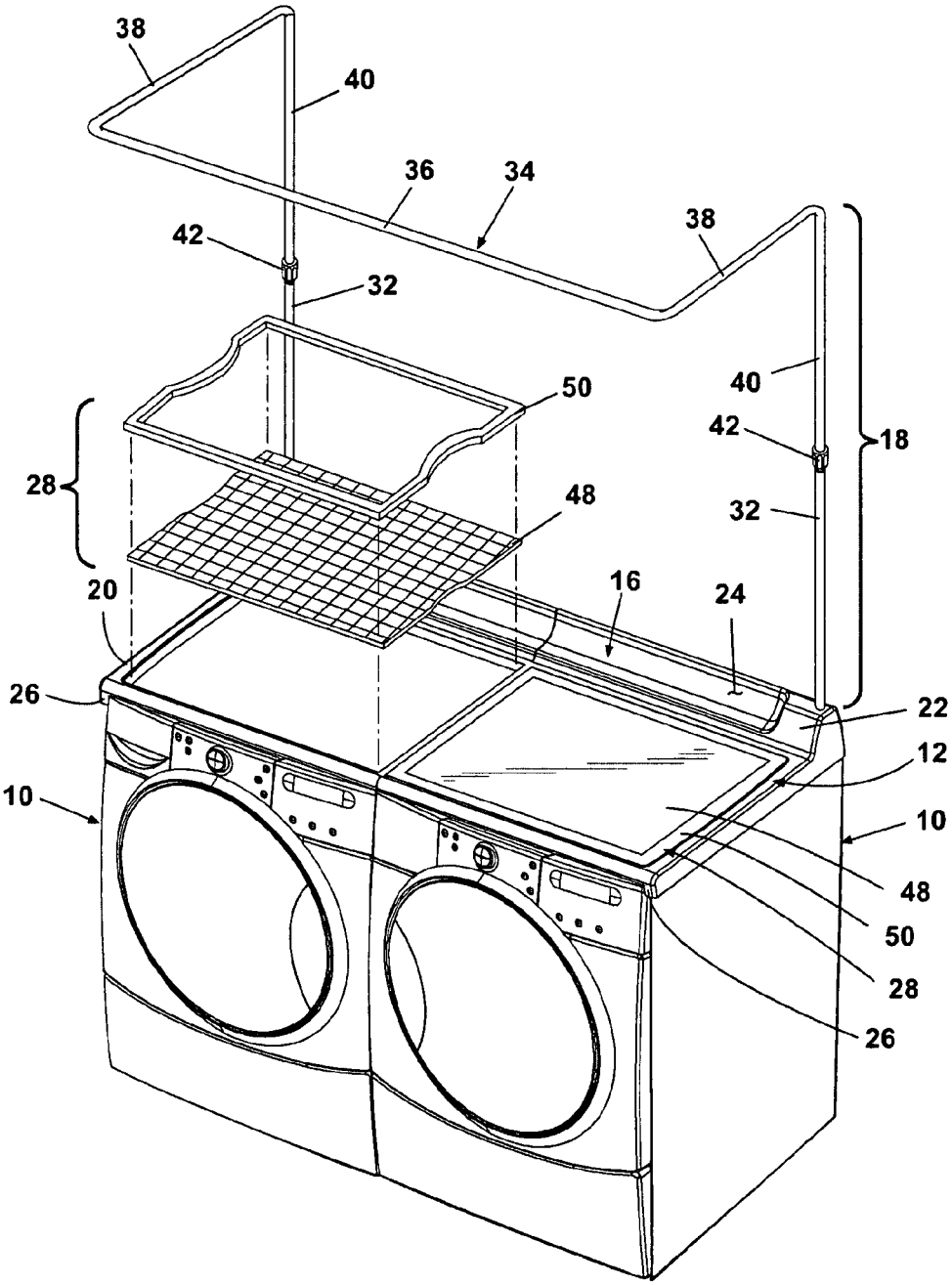
FIG. 15 is a perspective view of the embodiment shown in FIG. 14, wherein one of the reversible worksurface insert is shown in an exploded configuration.

FIG. 14 is a perspective view of another embodiment of the modular laundry system similar to that shown in FIG. 10, wherein the functional insert 28 provided on the worksurface 12 is shown as a pair of adjacent, rectangular individual functional inserts 28, each of which can be reversible to expose a different functional surface of the functional insert 28. FIG. 15 is a perspective view of the embodiment shown in FIG. 14, wherein one of the reversible functional inserts 28 of the worksurface 12 is shown in an exploded configuration. Each functional insert 28 comprises a reversible mat 48 removably mounted within a frame 50. The mat 48 can be removed from the frame 50 for cleaning or replacement with a different mat 48 having a different laundry-related functionality than the mat 48 that was initially removed. The mat 48 and frame 50 are interchangeable between longitudinal positions on the worksurface 12 and can assist a user in optimally performing laundry-related functions on the worksurface 12.

Figure 16:
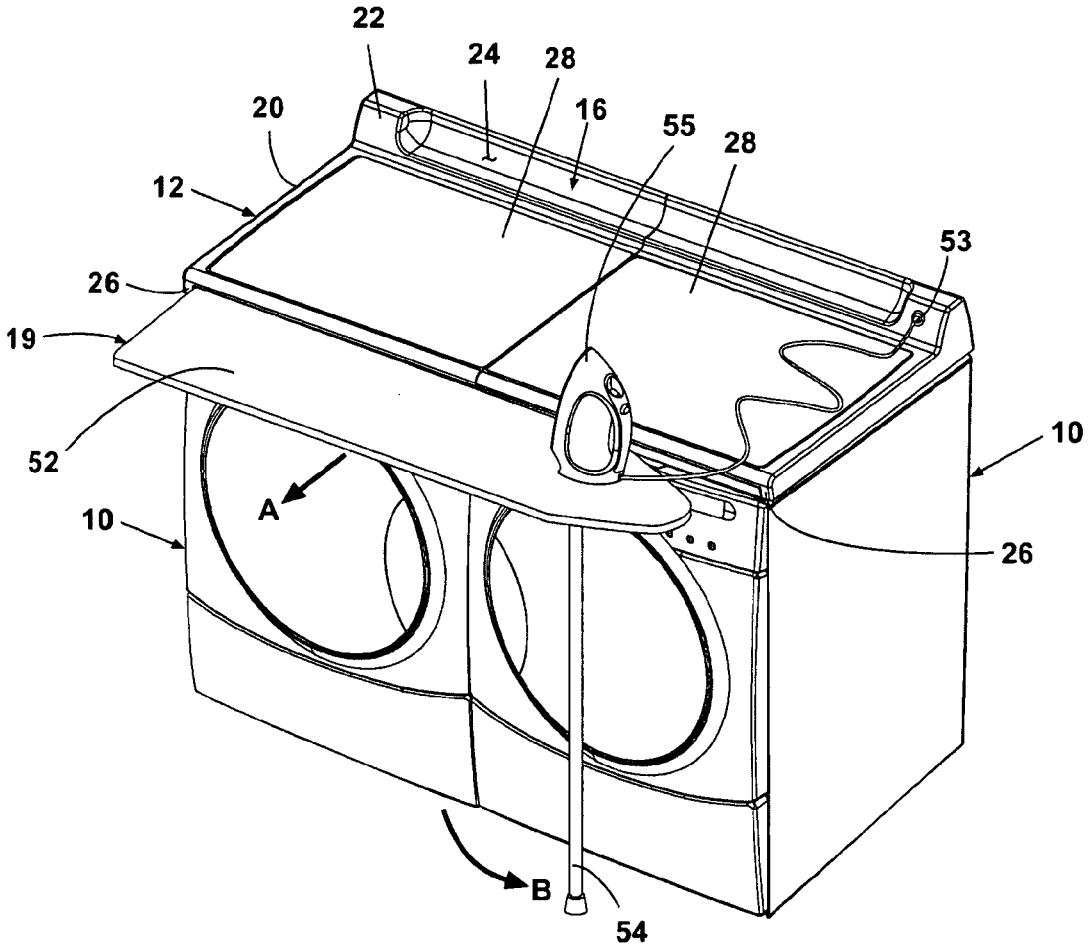
FIG. 16 is a perspective view of another embodiment of the modular laundry system similar to that shown in FIG. 6, wherein an ironing board is shown extended from the worksurface whereby arrows illustrate a first extending direction to expose the ironing board from within the worksurface and a second pivoting direction to position a supporting leg for the ironing board on a floor.

FIG. 16 is a perspective view of another embodiment of the modular laundry system similar to the embodiment shown in FIG. 16. In the embodiment shown in FIG. 16, a shelf area 19 in the form of an ironing board 52 is provided on the worksurface 12. The ironing board 52 is preferably associated with the worksurface 12 so that it can be repositioned, such as by sliding, with respect to the worksurface 12 between an extended position (as shown in FIG. 16) and a retracted position, wherein the ironing board is stowed within a recess in the underside of the worksurface 12 defined by an upper surface of the laundry appliances 10, the underside of the worksurface 12 and the flanges 26 at each longitudinal end of the worksurface 12. The ironing board 52 is shown in FIG. 16 extended from the worksurface 12 whereby arrow "A" illustrates a first extending direction to expose the ironing board 52 from within the worksurface 12 and arrow "B" illustrates a second direction by which a foldable leg 54 can be dropped from a folded position adjacent the underside of the ironing board 52 to a floor-engaging position to support the ironing board 52 on a floor.

Figure 17:
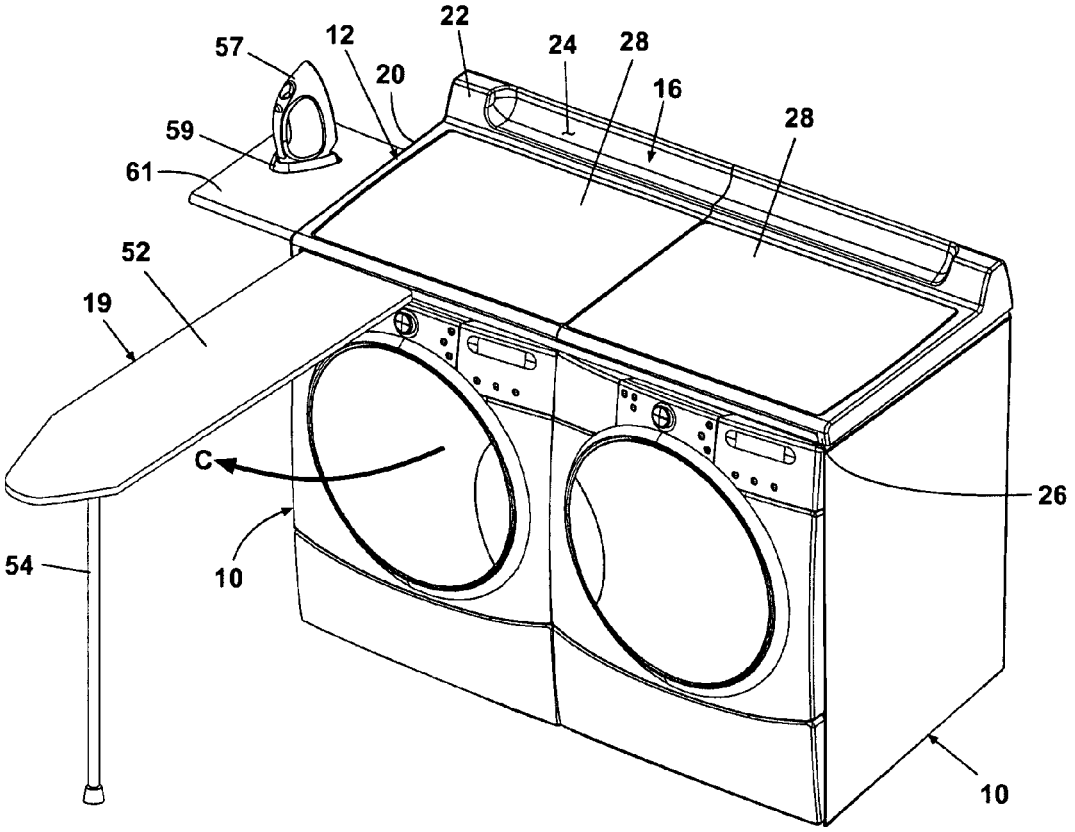
FIG. 17 is a perspective view of the embodiment of the modular laundry system shown in FIG. 16 wherein the ironing board has been rotated to a generally perpendicular position with respect to the worksurface to allow for greater functionality and usability of the workspace in which the modular laundry system resides.

FIG. 17 is a perspective view of the embodiment of the modular laundry system shown in FIG. 16 wherein the ironing board 52 is pivotally mounted to at least one of the worksurface 12 and the laundry appliances 10 so that it can be rotated with respect to the worksurface 12 between a first position that is generally parallel to the longitudinal axis of the worksurface 12 and a second position that is generally perpendicular to the longitudinal axis of the worksurface 12. The pivotal mounting of the ironing board 52 with respect to the worksurface 12 can be accomplished with known parts and need not be described to be understood by one skilled in the art. In the embodiment shown in FIG. 17, the ironing board 52 has been rotated to the second generally perpendicular position with respect to the worksurface 12 (as shown by arrow "C") to allow for greater functionality and usability of the workspace in which the modular laundry system resides.

To stow the ironing board 52 within the worksurface 12, the ironing board 52 is rotated in the reverse direction shown by arrow "C" in FIG. 17 to the first generally parallel position, the leg 54 is folded up against the ironing board 52 in the reverse direction shown by arrow "B" in FIG. 16, and, finally, the ironing board 52 is slid back along a reverse direction shown by arrow "A" in FIG. 16 into its stowed position beneath the worksurface 12.

The worksurface 12 can further comprise a power outlet 53 located anywhere on the worksurface 12, such as in the backsplash 22, as illustrated in FIG. 16. The power outlet 53 can be used to provide power to any device, including an iron 55 for use with the ironing board 52. The worksurface 12 can also or alternatively comprising a docking station 59 for a cordless iron 57, as shown in FIG. 17. The docking station 59 can be located anywhere on the worksurface 12, such as on an iron platform 61 extending laterally from the worksurface 12, and can provide a place to rest the cordless iron 57 when the cordless iron 57 is not in use. The iron platform 61 can be, for example, fixedly mounted to the worksurface 12 in the extended position of FIG. 17, slidably mounted to worksurface 12 such that the iron platform 61 is located below the upper surface of the worksurface 12 when not in use, or pivotally mounted to the worksurface 12 such that the iron platform 61 is oriented generally parallel to the side of the laundry appliance 10 when not in use. The docking station 59 can also be coupled to a source of power, such as the main power supply of the home or a battery, to recharge the cordless iron 57.

Figure 18:
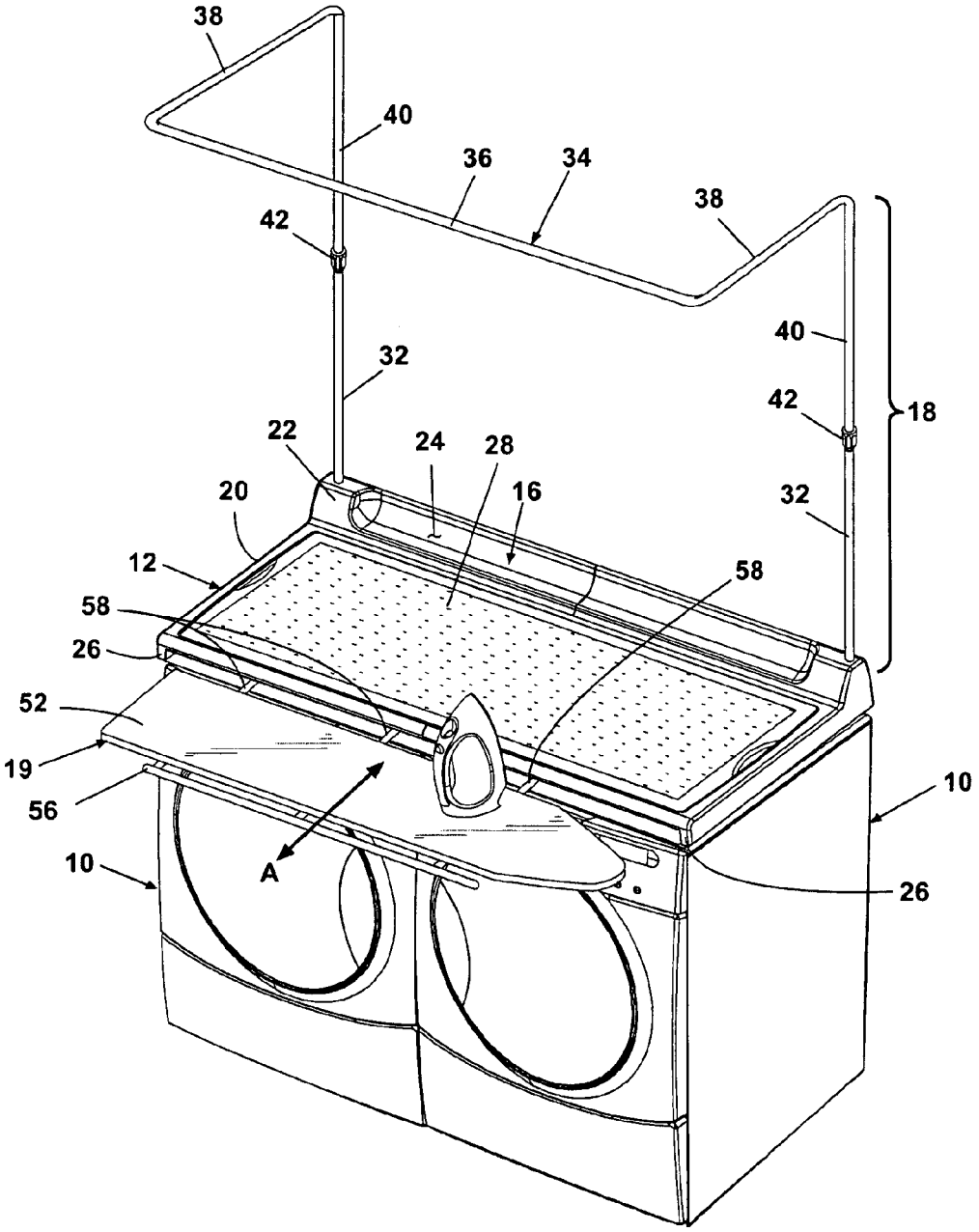
FIG. 18 is a perspective view of another embodiment of the modular laundry system similar to that shown in FIG. 16, wherein an ironing board is shown in an extended use position with respect to the worksurface.
Figure 19:
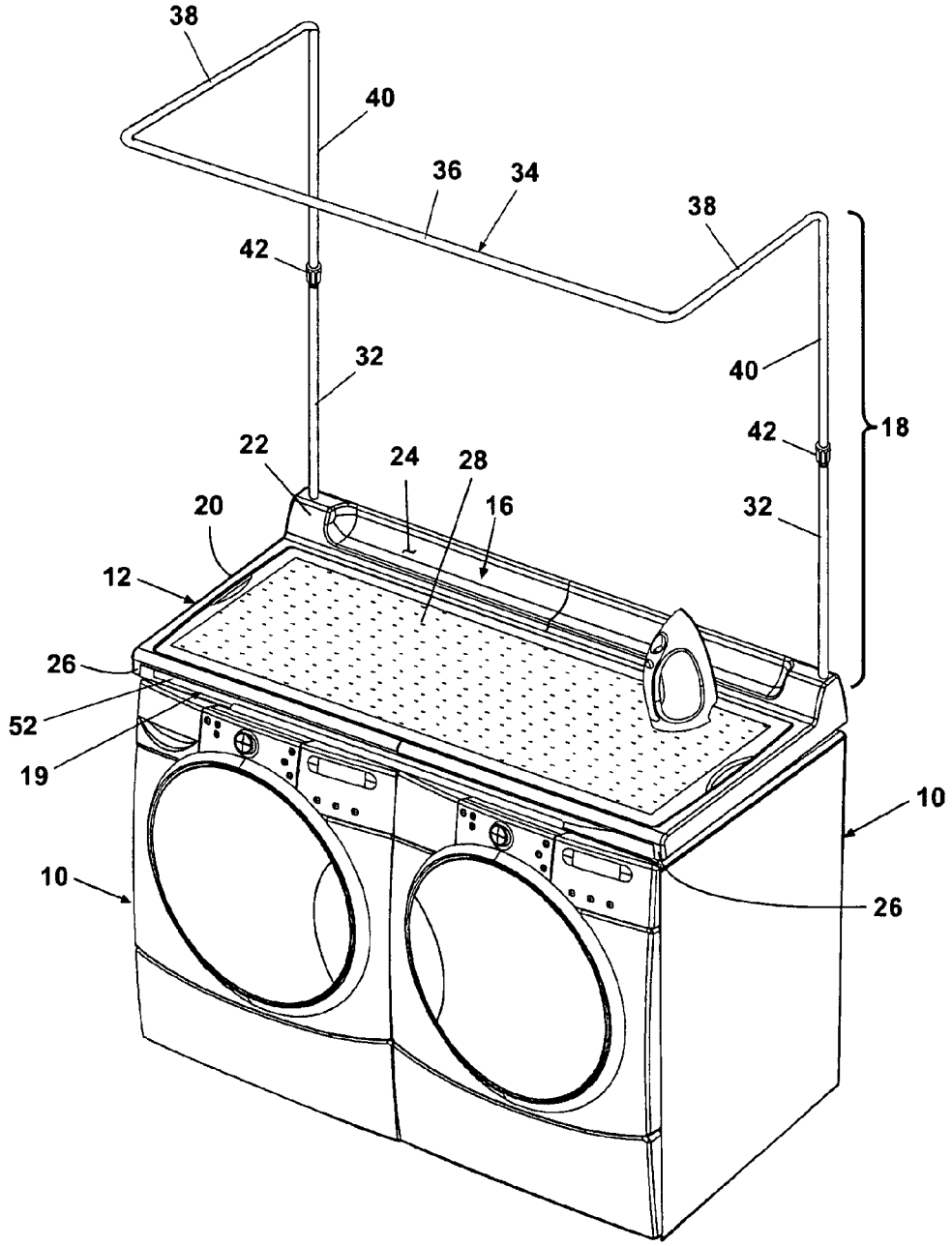
FIG. 19 is a perspective view of the embodiment of the modular laundry system shown in FIG. 18, wherein the ironing board has been slid from the extended use position located adjacent to the worksurface to a retracted, stored position located within the worksurface.

FIG. 18 is a perspective view of another embodiment of the modular laundry system having a shelf area 19 in the form of an ironing board 52, wherein the ironing board 52 has been slid in a direction shown by arrow "A" from a retracted, stored position located within the worksurface 12, as shown in FIG. 19, to an extended, use position located adjacent to the worksurface 12. In the embodiment shown in FIGS. 18 and 19, the ironing board 52 is mounted to the worksurface 12 via a mounting rack 56, which includes a set of rails 58, which allow the slidable movement of the ironing board 52 with respect to the worksurface 12. In the embodiment of the invention shown in FIGS. 18 and 19, the foldable leg 54 described with respect to the embodiment shown in FIG. 16 is not needed because the mounting rack 56 and the rails 58 support the ironing board 52 in cantilevered fashion with respect to the laundry appliances 10 and the worksurface 12. The embodiment shown in FIGS. 18 and 19 further includes the hanging area 18 similar to that of the embodiment illustrated in FIG. 10.

Figure 20:
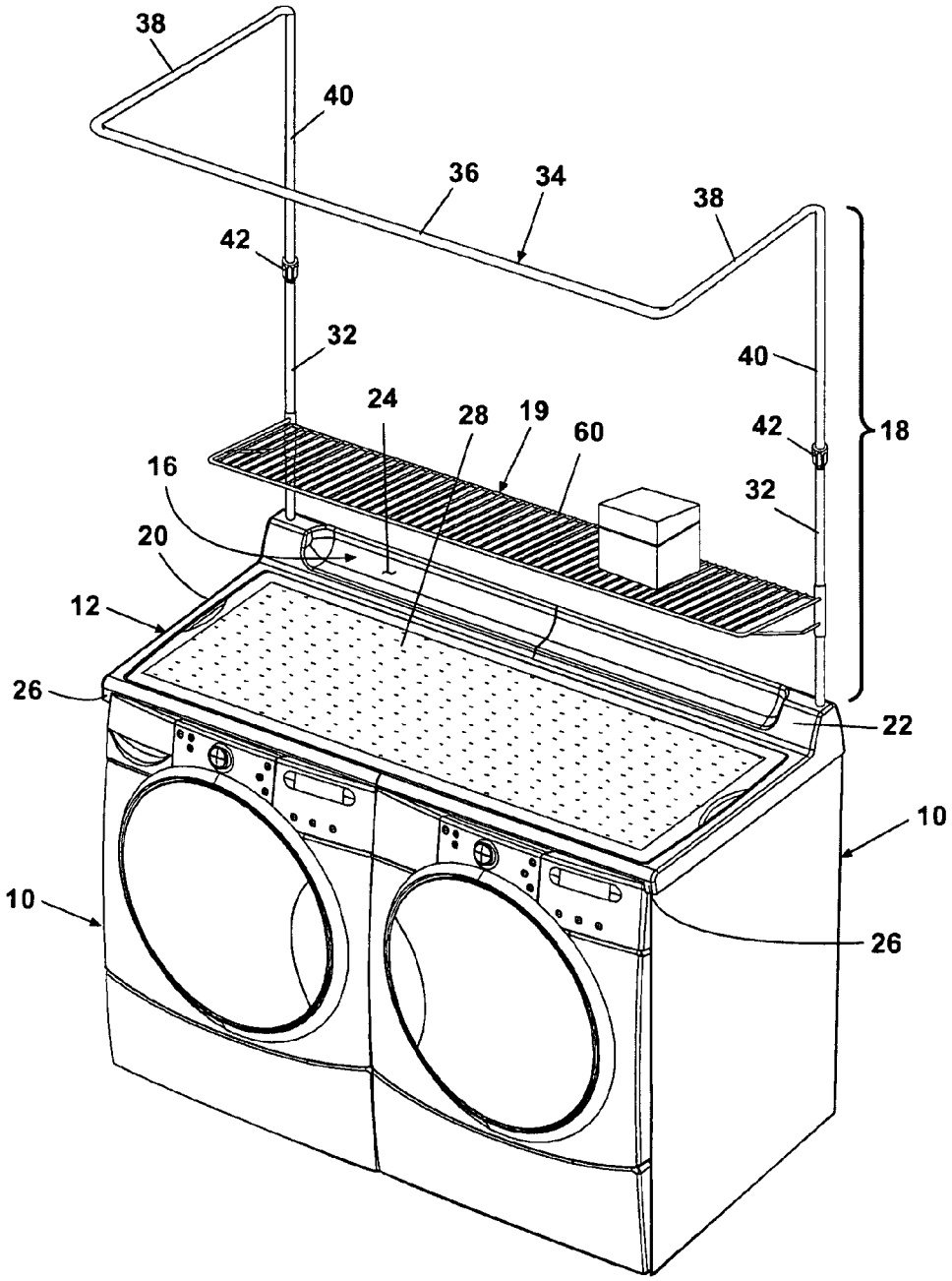
FIG. 20 is a perspective view of another embodiment of the modular laundry system shown in FIG. 10, wherein the hanging area provided above the worksurface has a first embodiment of a shelf area.
Figure 21:
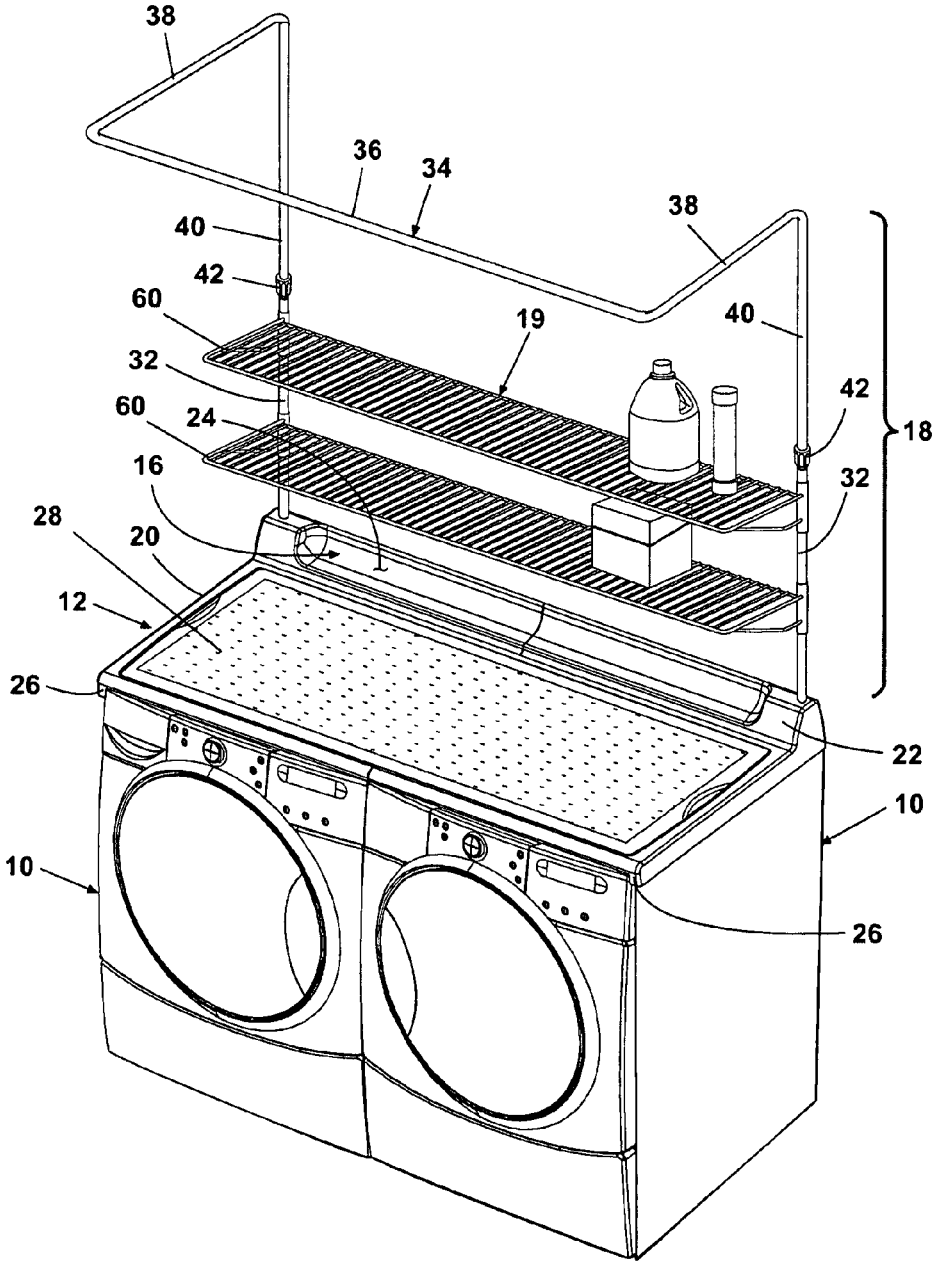
FIG. 21 is a perspective view of another embodiment of the modular laundry system shown in FIG. 20, wherein the hanging area provided above the worksurface has a second embodiment of a shelf area.
Figure 22:
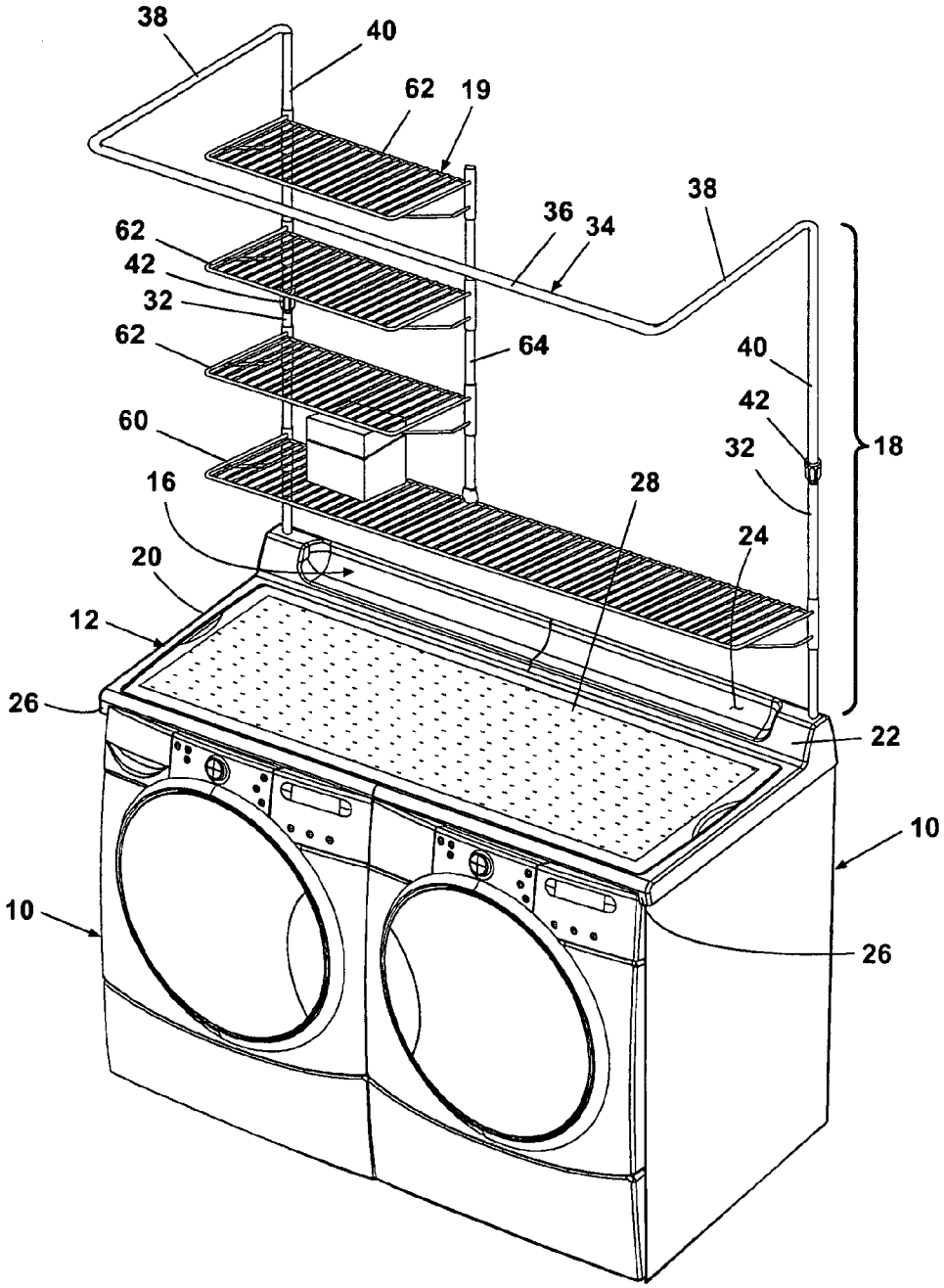
FIG. 22 is a perspective view of another embodiment of the modular laundry system shown in FIG. 20, wherein the hanging area provided above the worksurface has a third embodiment of a shelf area.

It is also contemplated that, in accordance with the invention, the hanging area 18 can also include additional components to optimize the functionality of the hanging area 18 of the modular laundry system described herein. For example, FIG. 20 is a perspective view of another embodiment of the modular laundry system, wherein the hanging area 18 provided above the worksurface 12 has a first embodiment of a shelf area 19 comprising an elongated shelf 60 extending the length between the upright members of the hanging area 18, which are the base rods 32 and the extension rods 40 in the current embodiment. FIG. 21 is a perspective view of another embodiment of the modular laundry system shown in FIG. 20, wherein the hanging area 18 provided above the worksurface 12 has a second embodiment of a shelf area 19 comprising a vertically-spaced arrangement of a plurality of full-length shelves 60 extending the length of the hanging area 18. FIG. 22 is a perspective view of another embodiment of the modular laundry system shown in FIG. 20, wherein the hanging area 18 provided above the worksurface 12 as a third embodiment of a shelf area 19 comprising at least one full-length shelf 60 and at least one vertically spaced arrangement of a partial-length shelf 62 which can be connected at one end to one of the vertical upright members of the hanging area 18 and at an opposite end by a vertical stile 64.

The provision of at least a portion of the shelving associated with the hanging area 18 allows for garments of a longer length to be hung in the portion of the hanging area 18 not occupied by the shelving 60, 62 while optimizing the storage space in the hanging area 18 as well.

Figure 23:
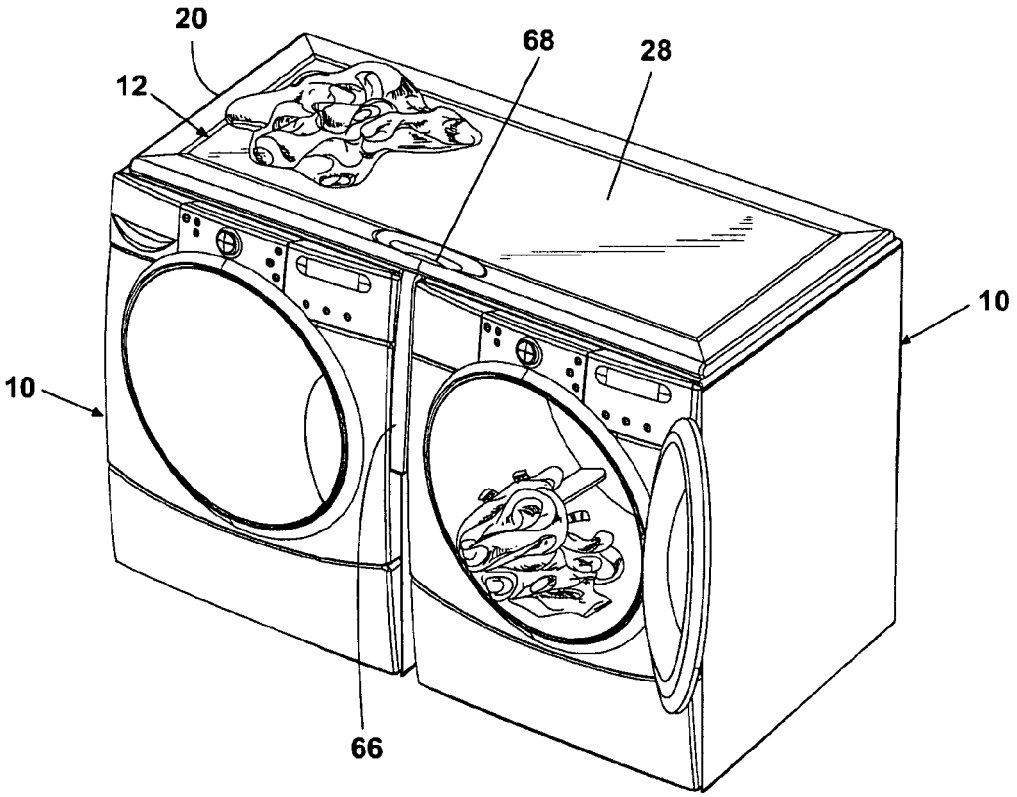
FIG. 23 is a perspective view of another embodiment of the modular laundry system shown in FIG. 8, wherein a worksurface extends across a pair of horizontally-disposed laundry appliances, and a hinge supporting the worksurface locates the worksurface at a first position located atop the horizontally-disposed laundry appliances.
Figure 24:
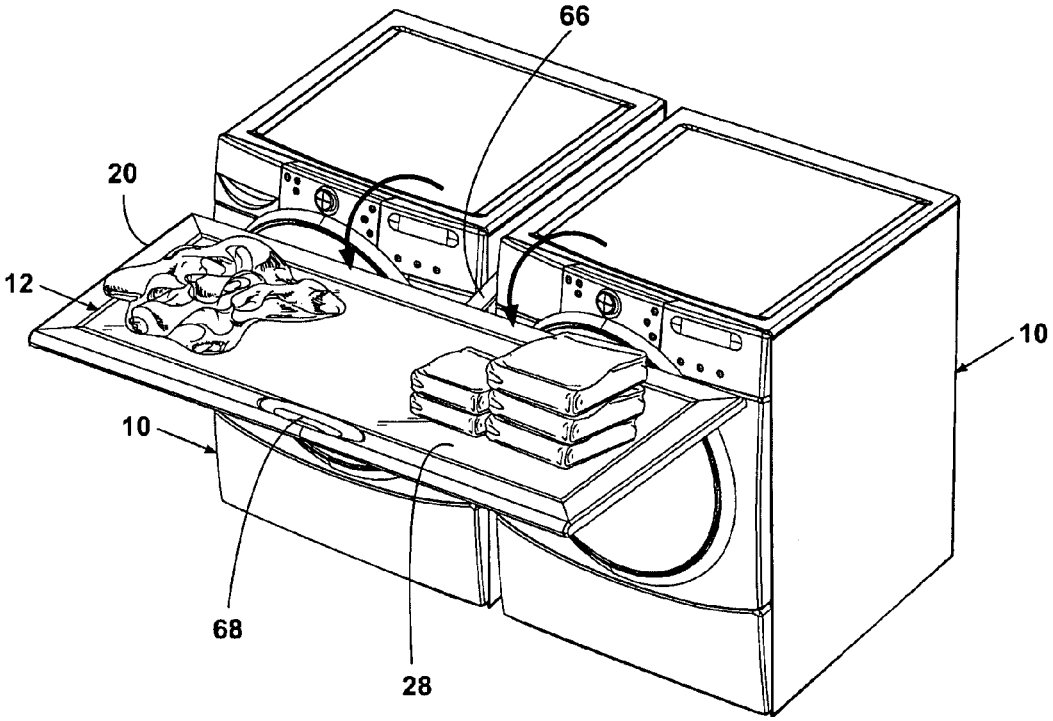
FIG. 24 is a perspective view of the embodiment of the modular laundry system shown in FIG. 23, wherein the hinge supporting the worksurface can be rotated to locate the worksurface at a second position located angularly and forwardly of the horizontally-disposed laundry appliances.

The worksurface 12 can also be moveable in and of itself. For example, FIG. 23 is a perspective view of another embodiment of the modular laundry system shown in FIG. 8, wherein the worksurface 12 extends across a pair of horizontally-disposed laundry appliances 10, and a hinge 66 is mounted in a location between the laundry appliances 10 and the underside of the worksurface 12. The hinge 66 movably mounts the worksurface 12 between a first position located atop or overlying the horizontally-disposed laundry appliances 10 and a second position, as shown in FIG. 24, located angularly and forwardly of the horizontally-disposed laundry appliances 10. A user-graspable handle 68 is provided on the worksurface 12 to assist the user in moving the worksurface 12 between the first position shown in FIG. 23 and the second position shown in FIG. 24. It is within the scope of the invention to employ hinges other than the exemplary hinge 66 of FIGS. 23 and 24 to movably support the worksurface 12.

Figure 25:
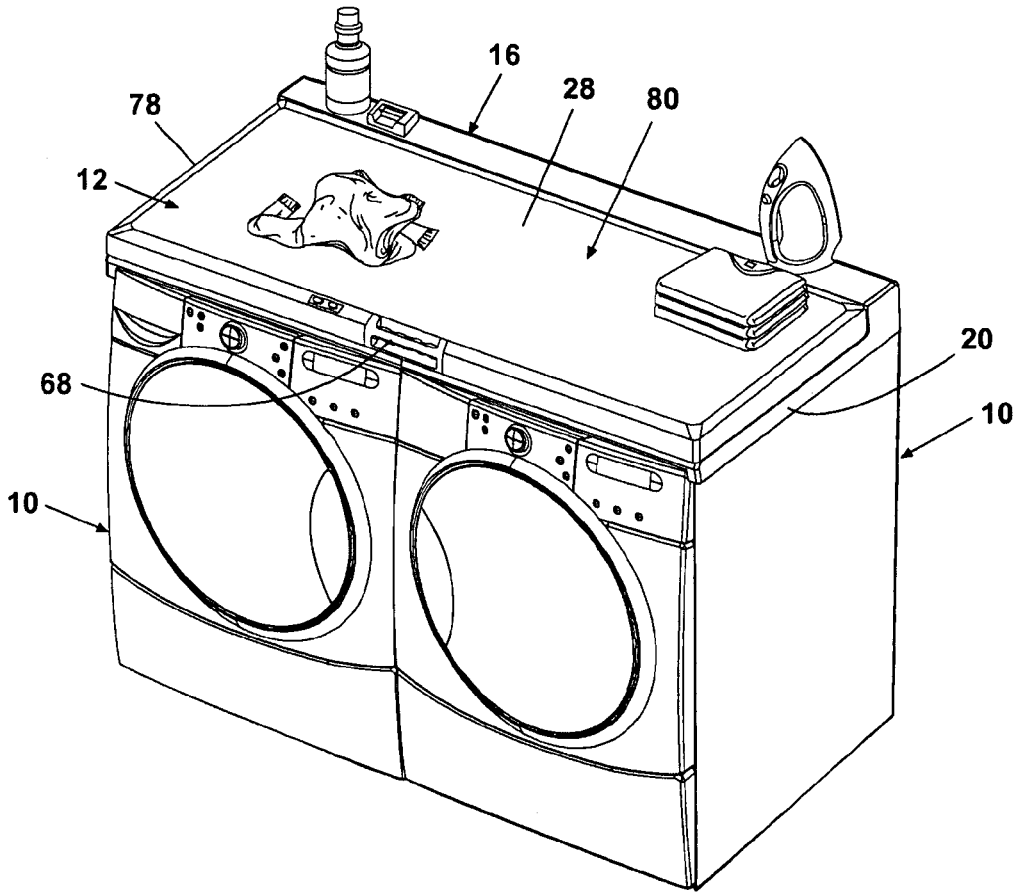
FIG. 25 is a perspective view of another embodiment of the modular laundry system shown in FIG. 8, wherein a worksurface comprises a wrinkle removing press shown in a closed position.
Figure 26:
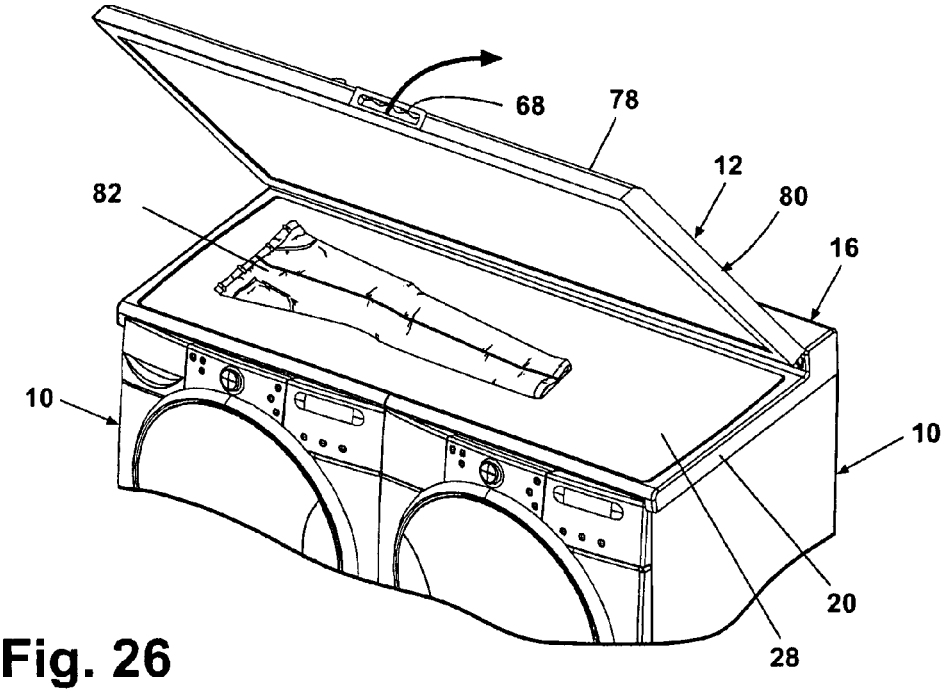
FIG. 26 is a fragmentary, perspective view of the embodiment of the modular laundry system shown in FIG. 25, wherein the wrinkle removing press has been pivoted to an open position and an article of clothing has been placed therein.
Figure 27:
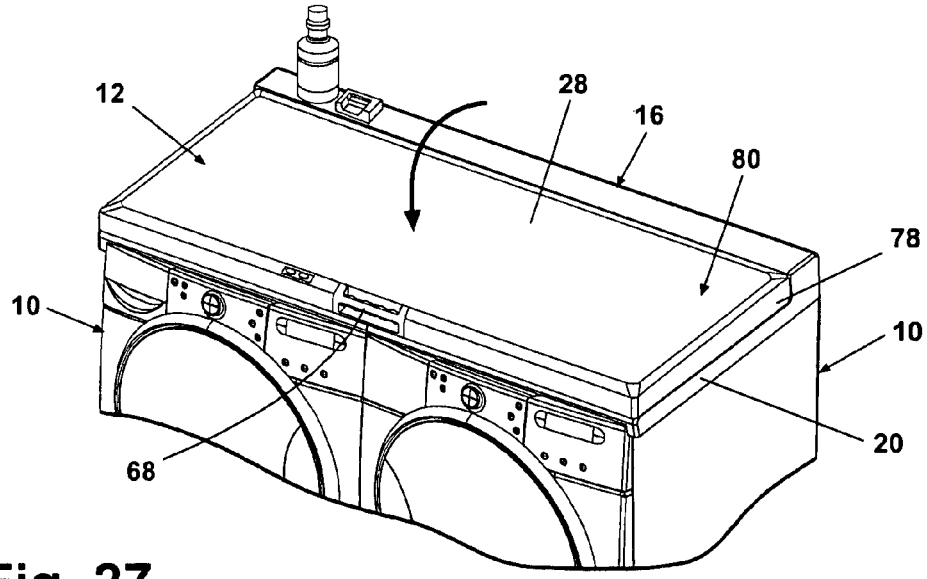
FIG. 27 is a fragmentary, perspective view of the embodiment of the modular laundry system shown in FIG. 24, wherein the wrinkle removing press has been re-pivoted to the closed position to provide a pressing function to the article of clothing placed therein.

The worksurface 12 can also have a laundry-related function built into its interior. For example, FIG. 25 is a perspective view of another embodiment of the modular laundry system shown in FIG. 8, wherein a worksurface 12 comprises a wrinkle removing press 80, which is shown in a closed position in FIG. 25. FIG. 26 shows the wrinkle removing press 80 being pivoted to an open position, and an article of clothing 82 placed therein. The actual structure and function of the press 80 is well-known and need not be described in detail and would be apparent to one skilled in the art. In general, the press 80 is a clamshell-type device which has a cover 78 that can be opened so that an article of clothing 82 placed between the cover 78 and the body 20 of the worksurface 12, as shown in FIG. 26, and closed, as illustrated by an arrow in FIG. 27, so that a laundry-related function, e.g., steaming, pressing, wrinkle removal, etc., can be performed on the clothing 82 placed therein. The worksurface 12 can include a first functional cover 28 on the body 20 to protect the body 20 from the heat generated by the press 80, and a second functional cover 28 on top of the cover 78 so that another task, such as ironing, can be performed on the worksurface 12. A user-graspable handle 68 is provided as well to assist the movement of the press 80 between the positions shown in FIGS. 25-27. FIG. 27 shows the wrinkle removing press has been re-pivoted to the closed position to provide a pressing function to the article of clothing 82 placed therein.

Figure 28:
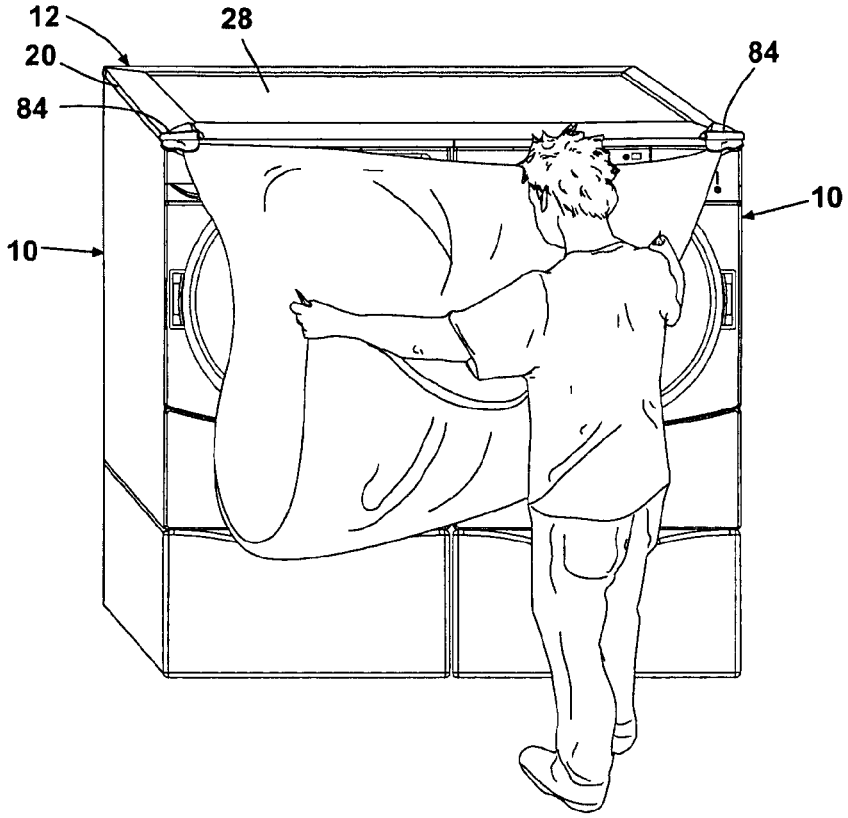
FIG. 28 is a perspective view of another embodiment of the modular laundry system shown in FIG. 8, wherein a pair of clothing-retaining clips is integrated with the worksurface to assist a user in folding operations thereon.
Figure 29:
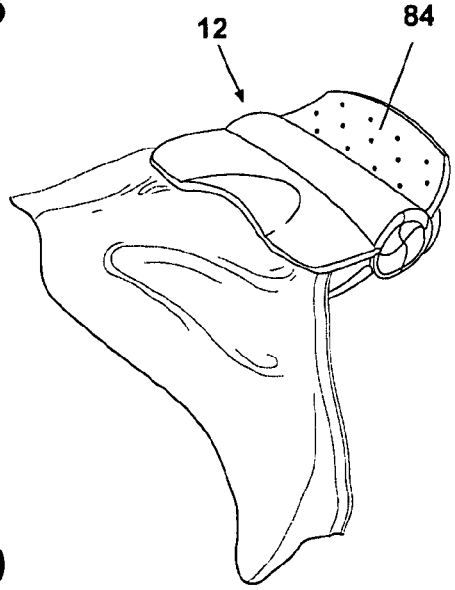
FIG. 29 is a fragmentary, perspective view of FIG. 28 showing the clothing-retaining clips in greater detail.

In addition, a folding function can be provided to the modular laundry system according to the invention. For example, FIG. 28 is a perspective view of another embodiment of the modular laundry system shown in FIG. 8, wherein a pair of clothing-retaining clips 84 are integrated with a worksurface 12 located above a pair of horizontally-disposed laundry appliances 10 to assist a user in folding operations thereon. FIG. 29 is a fragmentary, perspective view of FIG. 28 showing the clothing-retaining clips 84 in greater detail.

Figure 30:
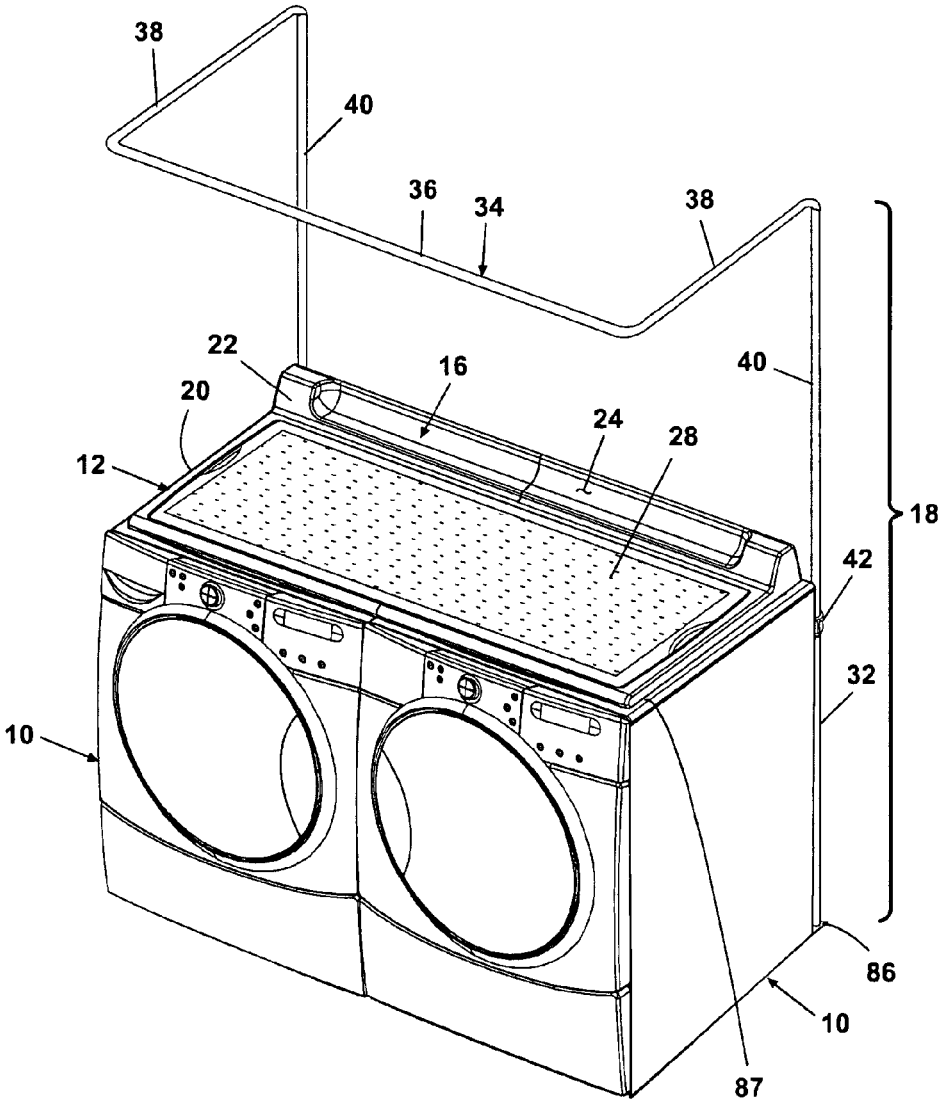
FIG. 30 is a perspective view of another embodiment of the modular laundry system shown in FIG. 10, wherein a worksurface extends across a pair of horizontally-disposed laundry appliances, and a hanging area is associated with the modular laundry system to allow articles of holding to be hung on a rod comprising a portion of the hanging area.
Figure 31:
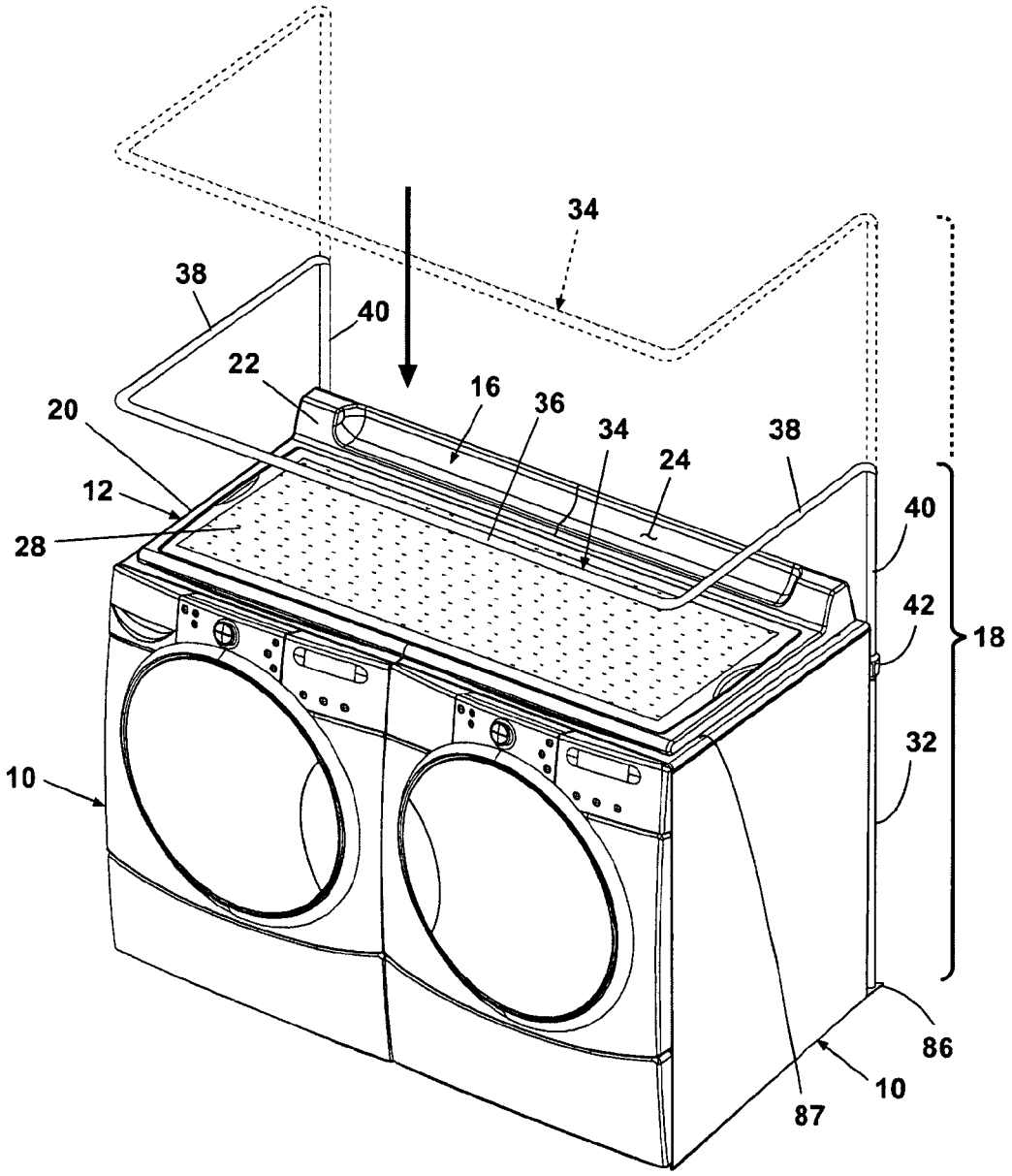
FIG. 31 is a perspective view of the embodiment of the modular laundry system shown in FIG. 30, wherein the hanging area is vertically adjustable via a selectively repositionable telescoping rod.
Figure 32:
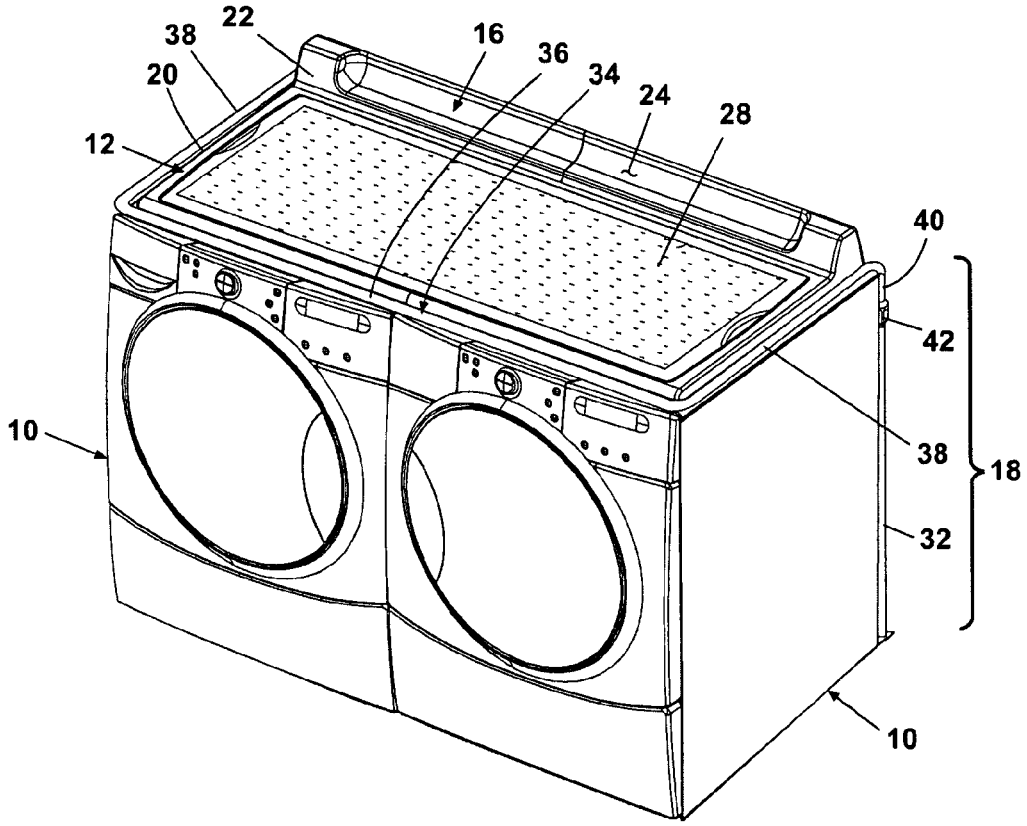
FIG. 32 is a perspective view of the embodiment of the modular laundry system shown in FIG. 30, wherein the hanging area has been completely and downwardly positioned to locate the hanging rod of the hanging area directly adjacent the worksurface extending across both horizontally-disposed laundry appliances.

Various embodiments of the hanging area 18 will now be described in further detail. FIG. 30 is a perspective view of another embodiment of the modular laundry system shown in FIG. 10, wherein a worksurface 12 extends across a pair of horizontally-disposed laundry appliances 10, and a hanging area 18 is associated with the modular laundry system. As opposed to the embodiment of the hanging area 18 shown by example in FIG. 10, which supports the hanging area 18 on the worksurface 12, the hanging area 18 comprises a base rod 32 which stands on a foot 86 on a floor surface. The remaining components 32, 34, 36, 38, 40, 42 of the hanging area 18 operate in the same manner as described earlier and need not be further described. Resting the base rod 32 on the floor surface (via the foot 86) allows for the base rod 32 to occupy a greater vertical length and can therefore telescopingly receive a longer length of the extension rod 40. As can be seen in FIG. 31, this allows for greater vertical adjustability of the extension rod 40 with respect to the base rod 32. Further, if the base rod 32 is selected so that the upper edge of the base rod 32 is generally aligned with an upper edge of the worksurface 12 (or a backsplash 22 if provided thereon), the extension rod 40 can be received wholly within the base rod 32 so that the elongated central rod 36 and the spacer rods 38 can be lowered adjacent to the worksurface 12 as shown in FIG. 32. To accommodate the central rod 36 and the spacer rods 38, the worksurface 12 includes a peripheral U-shaped recess 87 in register with and sized to receive the central rod 36 and the spacer rods 38 in a flush manner.

Figure 33A:
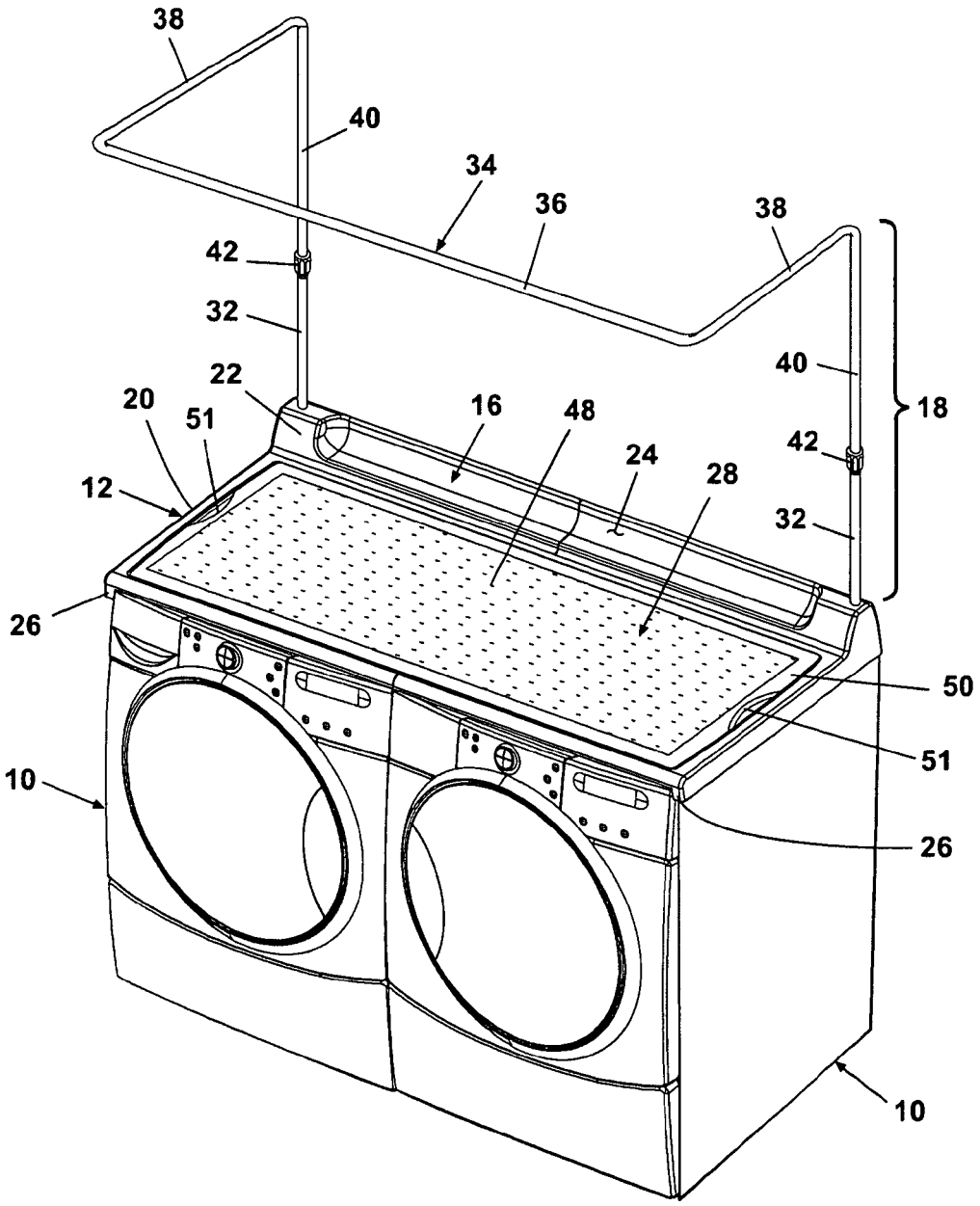
FIG. 33A is a perspective view of another embodiment of the modular laundry system shown in FIG. 30, wherein the worksurface extends across a pair of horizontally-disposed laundry appliances, and a hanging area is associated with the modular laundry system and extends through the worksurface, whereby the worksurface provides a base for the hanging area.
Figure 33B:
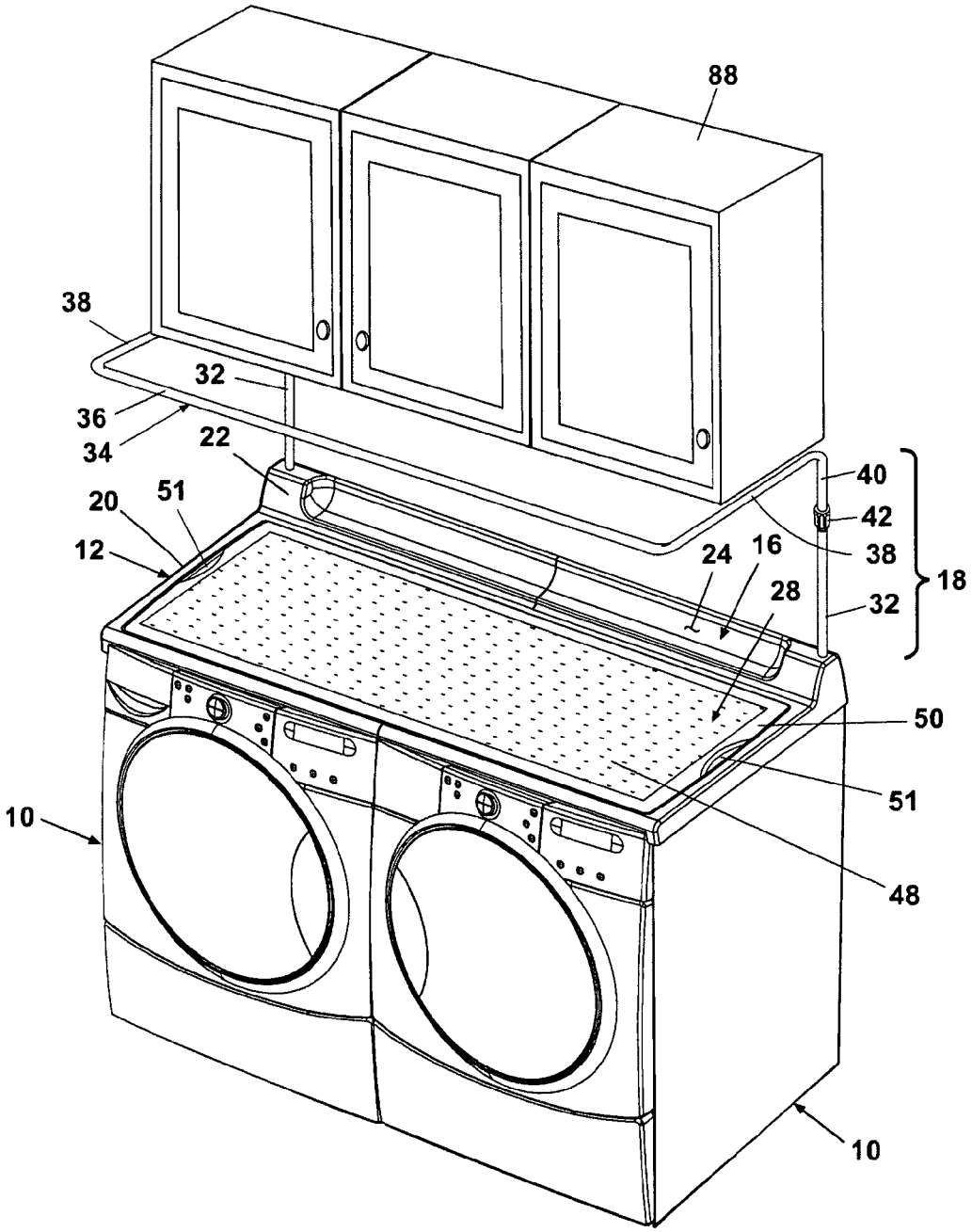
FIG. 33B is a perspective view of the embodiments of the modular laundry system shown in particular in FIG. 33A and also with respect to FIGS. 30-32 in which the vertical adjustability of the hanging area is shown to be useful when positioning the modular laundry system with respect to existing wall cabinets.

The adjustability of the elongated central rod 36 via the receipt of the extension rod 40 into the base rod 32 can also assist a user in repositioning the elongated central rod 36 when various obstructions are present in the laundry area in which the modular laundry system resides. For example, FIG. 33A is a perspective view of the embodiment of the modular laundry system shown in FIG. 10, wherein the worksurface 12 extends across a pair of horizontally-disposed laundry appliances 10 and a hanging area 18 is associated with the modular laundry system and extends through the worksurface 12, whereby the worksurface 12 provides a base for the hanging area 18. FIG. 33B is a perspective view of the embodiments of the modular laundry system shown in particular in FIG. 33A, and also with respect to FIGS. 30-32, in which the vertical adjustability of the hanging area 18 is shown to be useful when positioning the modular laundry system with respect to existing wall cabinets, shown by example with reference numeral 88.

Figure 34A:
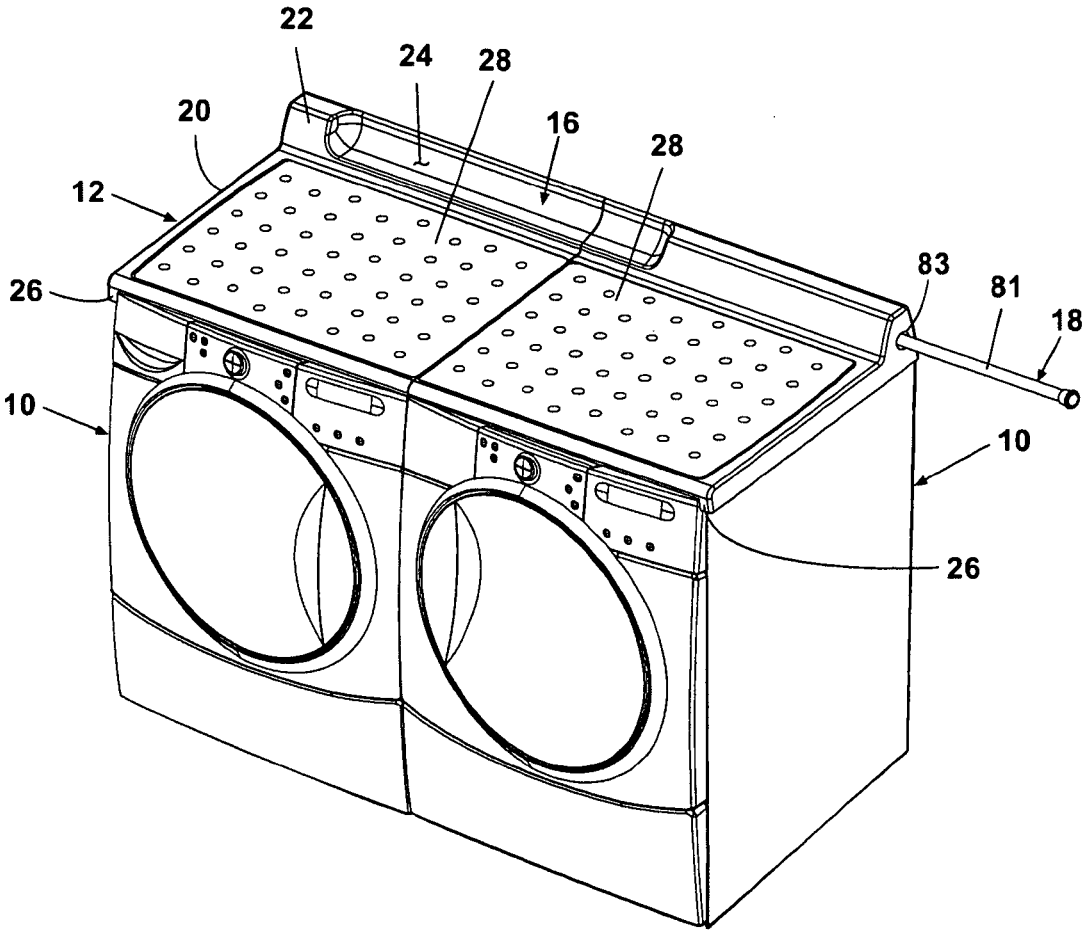
FIG. 34A is a perspective view of another embodiment of the modular laundry system shown in FIG. 10, wherein a worksurface extends across a pair of horizontally-disposed laundry appliances, and a hanging area is associated with the modular laundry system to allow articles of holding to be hung on a laterally extended hanging rod.
Figure 34B:
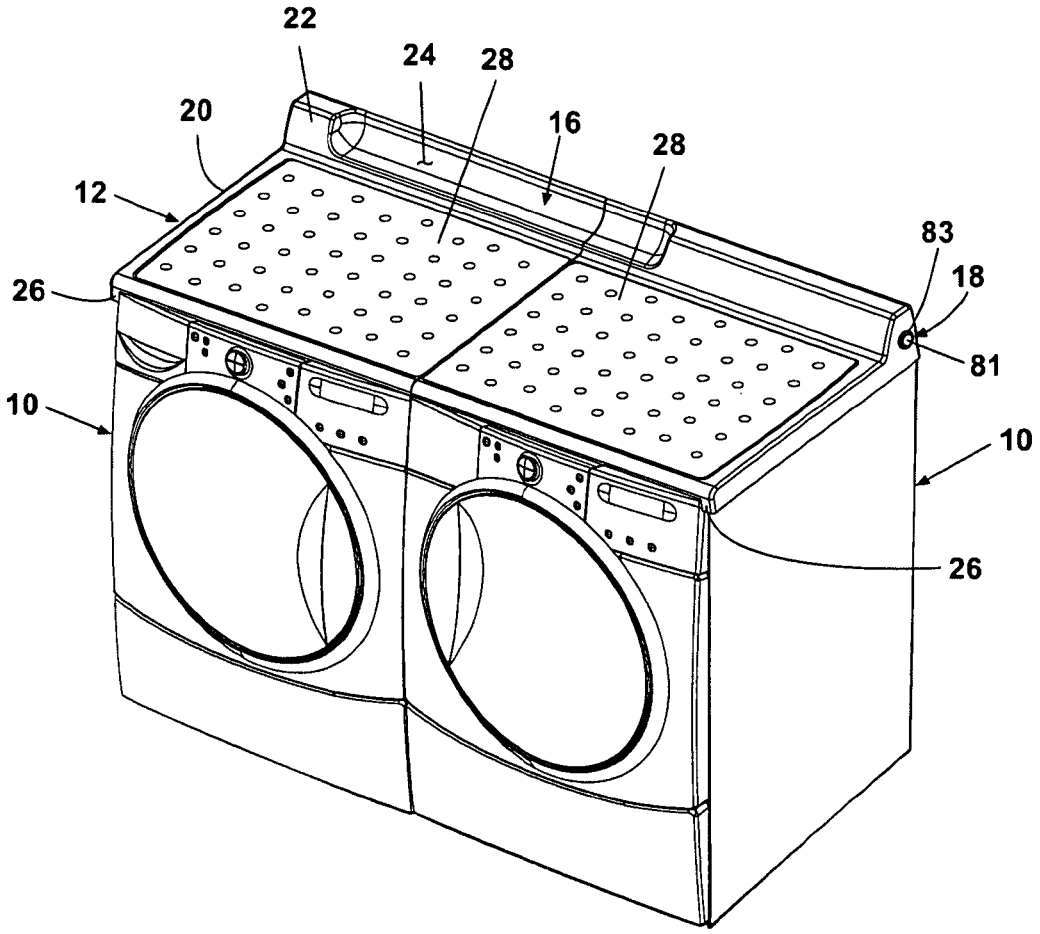
FIG. 34B is a perspective view of the embodiment of the modular laundry system shown in FIG. 34A with the hanging rod retracted into the worksurface.

FIG. 34A is a perspective view of another embodiment of the modular laundry system shown in FIG. 10, wherein a worksurface 12 extends across a pair of horizontally-disposed laundry appliances 10, and a hanging area 18 is associated with the modular laundry system. As opposed to the embodiment of the hanging area 18 shown by example in FIG. 10, which extends upward from the worksurface 12, the hanging area 18 comprises a hanging rod 81 that extends laterally from the worksurface 12. The hanging rod 81 is slidably mounted to the worksurface 12 through an opening 83 such that the hanging rod 81 can be extended laterally from the worksurface 12, as shown in FIG. 34A, for hanging items, such as on a hanger, or retracted into the worksurface 12, as shown in FIG. 34B, when not in use. In the illustrated embodiment, the hanging rod 81 is stored within the backsplash 22 when in the retracted position. The hanging rod 81 can be manually moved between the extended and retracted positions, or any type of actuator, such as a push-push type actuator, can be utilized to facilitate movement of the hanging rod 81. More details of exemplary hanging rods 81 are provided in application Ser. No. 11/322,503, filed concurrently herewith, and titled "Retractable Hanging Element," which is incorporated herein by reference in its entirety. Furthermore, it is within the scope of the invention for the hanging rod 81 to be mounted to the worksurface 12 in another manner, such as in a pivotable fashion, and to extend from the worksurface 12 in another direction, such as a forward direction.

Figure 35A:
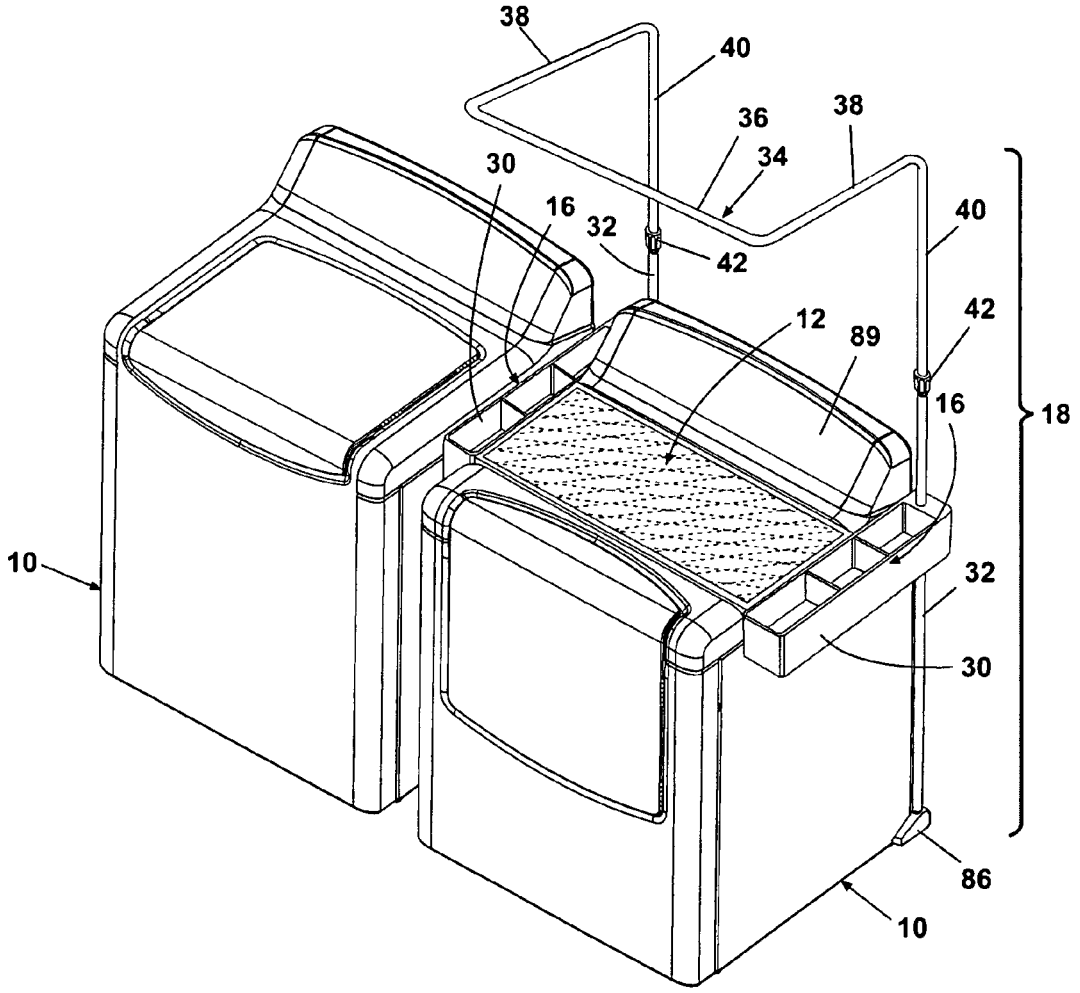
FIG. 35A is a perspective view of another embodiment of the modular laundry system, wherein the worksurface extends across a single horizontally-disposed laundry appliance and a single-width hanging area is associated with the worksurface of this embodiment.

FIG. 35A is another embodiment of the modular laundry system, wherein the worksurface 12 extends across a laundry appliance 10 and a single-width hanging area 18 is associated with the modular laundry system of this embodiment. The worksurface 12 is sized to accommodate a backsplash 89 of the laundry appliance 10 and includes a pair of the saddle-bad staging bins 30 arranged on opposite sides of the worksurface 12.

Figure 35B:
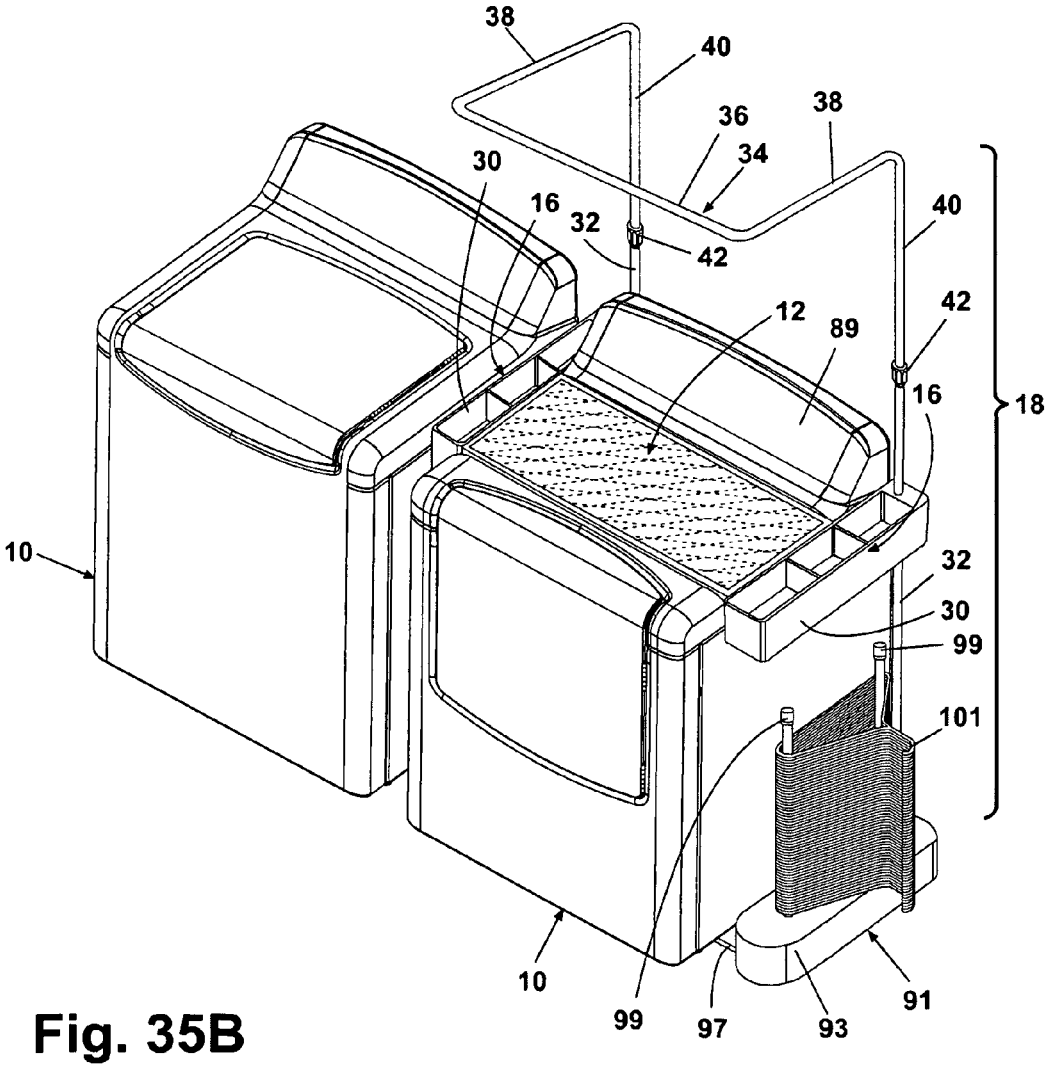
FIG. 35B is a perspective view of another embodiment of the modular laundry system similar to the embodiment of FIG. 35A and comprising a hanger staging area.
Figure 35C:
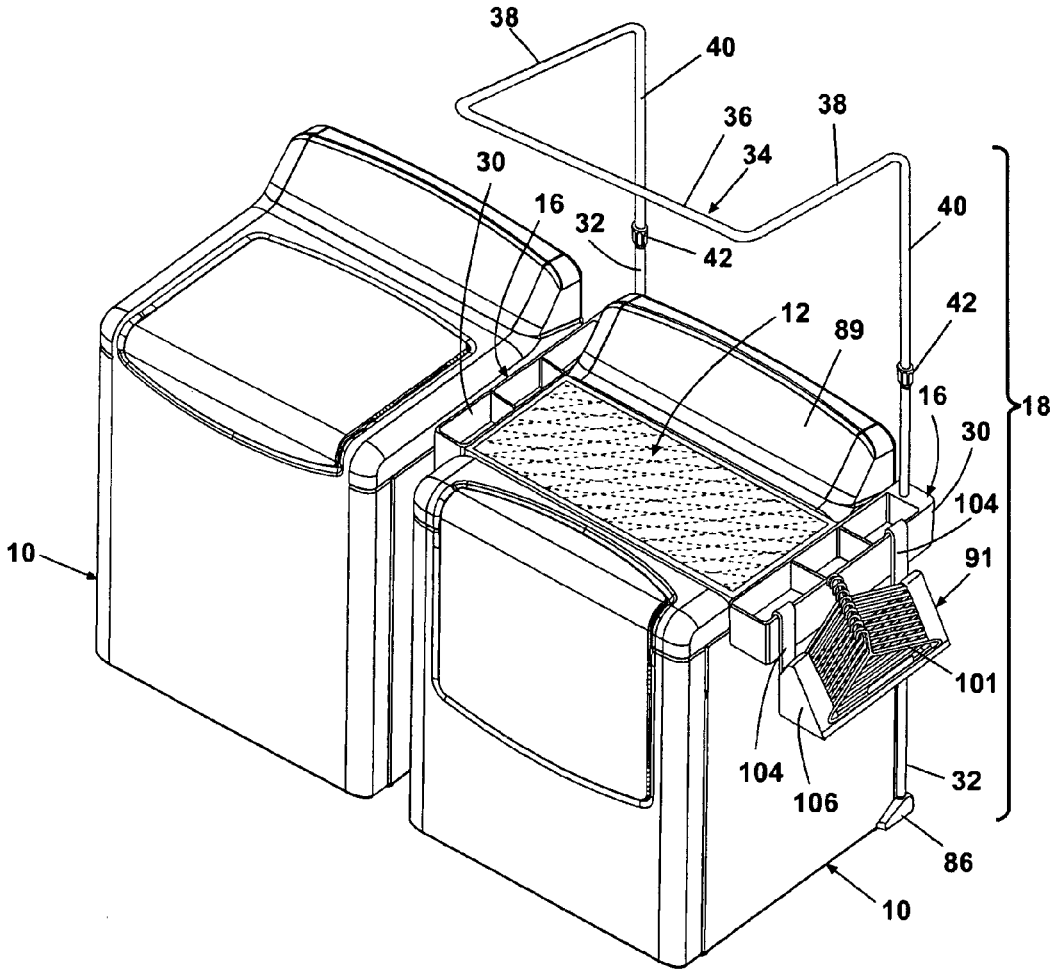
FIG. 35C is a perspective view of another embodiment of the modular laundry system similar to the embodiment of FIG. 35B and comprising an alternative hanger staging area.

FIG. 35B is a perspective view of another embodiment similar to that of FIG. 35A, but the worksurface 12 further comprises a hanger staging area 91. The hanger staging area 91 comprises a base 93 with a laterally extending flange 97 that can be slid under the laundry appliance 10 or integrally formed with the feet 86 of the hanging area 18 such that the hanger staging area 91 is disposed on one side of the worksurface 12. A pair of hanger rods 99 project upwardly from the base 93 and are spaced from one another a distance sufficient to support a plurality of hangers 101. Another embodiment of the hanger staging area 91 is illustrated in FIG. 35C. The hanger staging area 91 in FIG. 35C is supported by one of the staging bins 30 and comprises a pair of support hooks 104 to hang the hanger staging area 91 from the staging bin 30. The support hooks 104 terminate at a generally triangular shaped open-face hanger container 106 sized to receive a plurality of hangers 101 that can be easily accessed.

Figure 36:
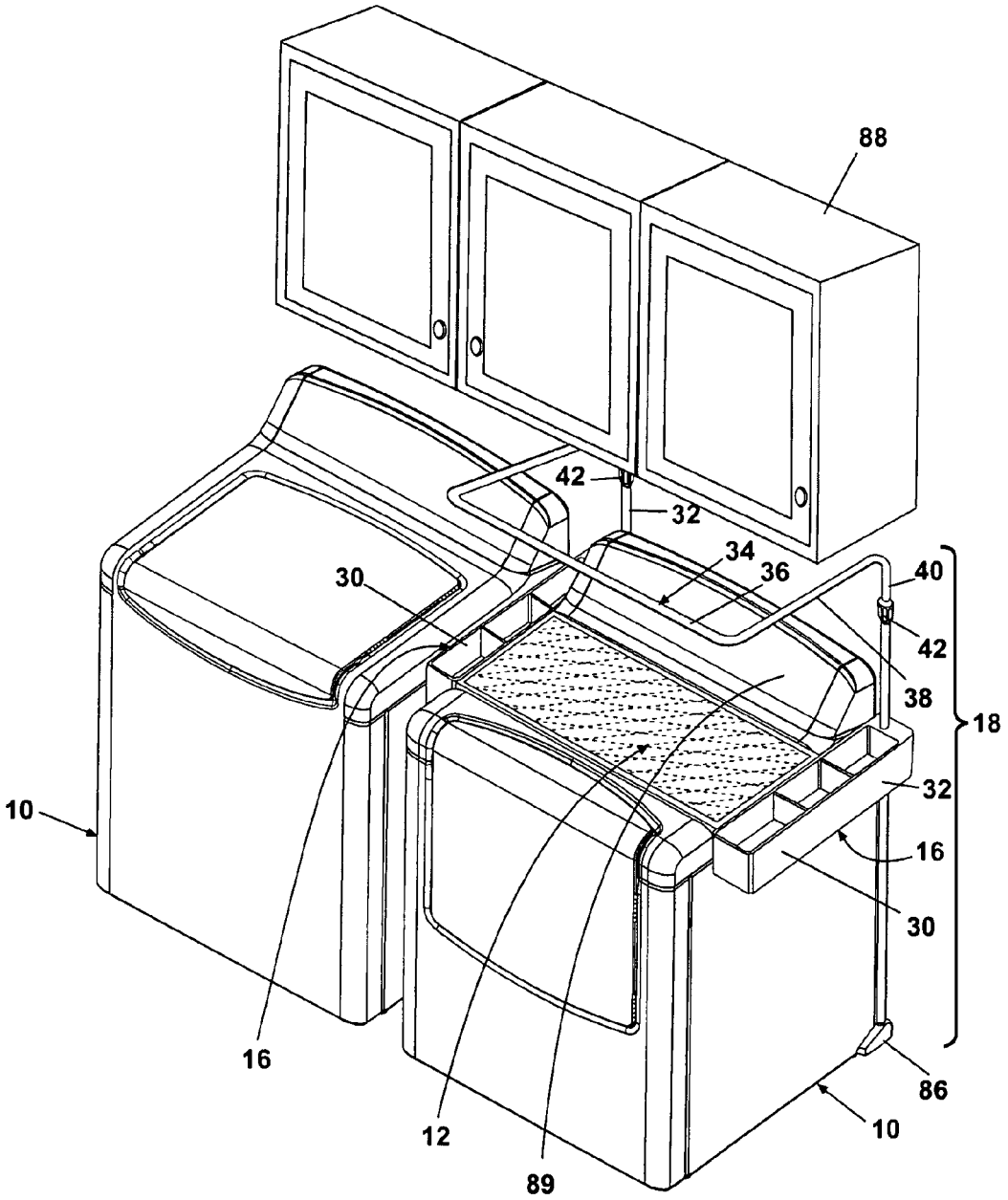
FIG. 36 is a perspective view of the embodiment of the modular laundry system shown in FIG. 35A in which the vertical adjustability of the hanging area is shown to be useful when positioning the modular laundry system with respect to existing wall cabinets.

FIG. 36 is a perspective view of the embodiment of the modular laundry system shown in FIG. 35A in which the vertical adjustability of the hanging area 18 is shown to be useful when positioning the modular laundry system with respect to existing wall cabinets 88. The worksurface 12 is also shown as an embodiment placed across the width of a single laundry appliance 10 and having saddle-bag staging bins 30 attached thereto, useful for organization and presentation of laundry-related items stored therein.

Figure 37A:
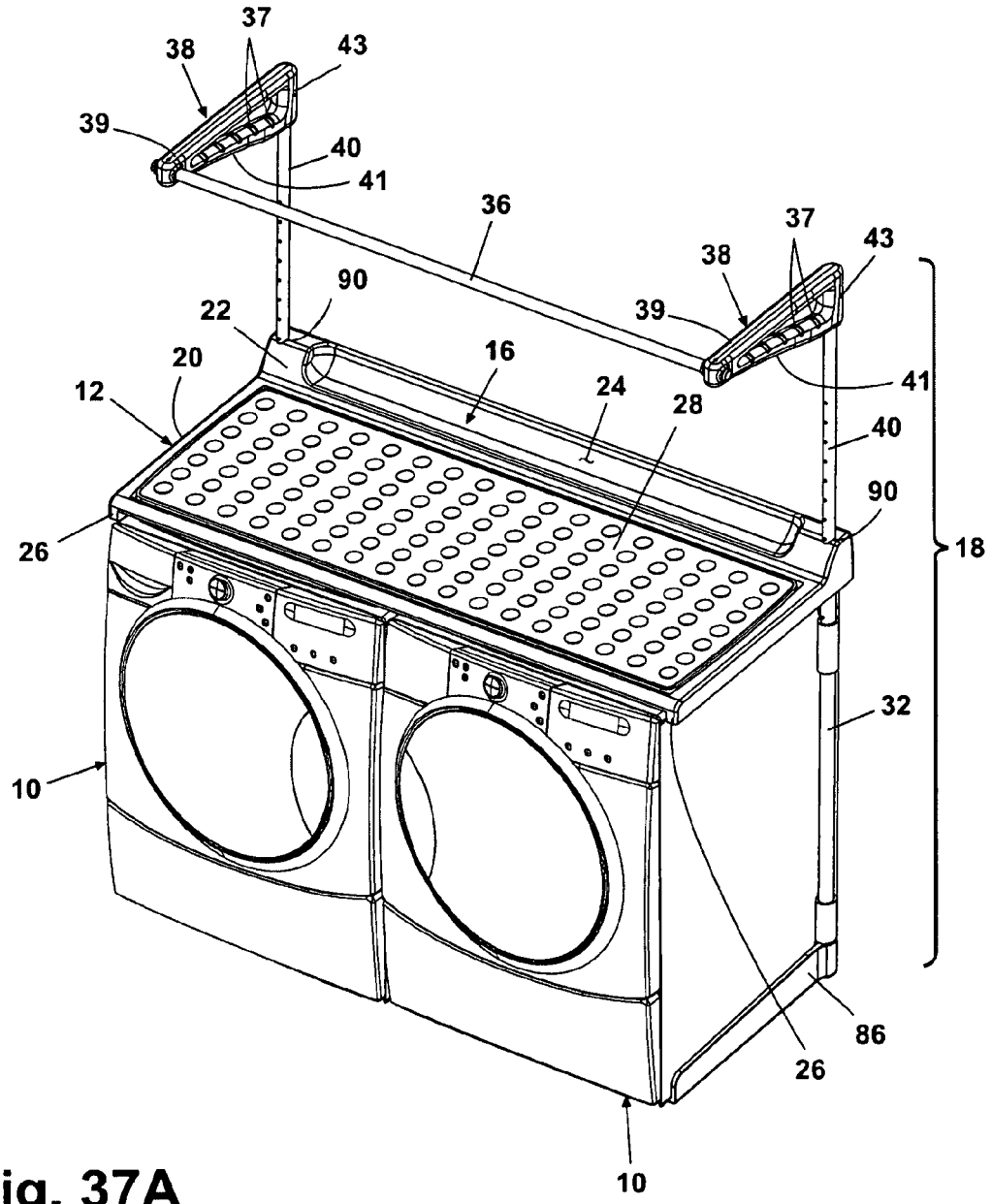
FIG. 37A is a perspective view of another embodiment of the modular laundry system shown in FIG. 10 in which the worksurface and hanging area are provided on a stand which can rest on a floor surface, and wherein the worksurface and hanging area are shown as, by example, a double-width across a pair of horizontally-disposed laundry appliances.

FIG. 37A is a perspective view of another embodiment of the modular laundry system in which the worksurface 12 and hanging area 18 are provided on a stand which can rest on a floor surface, and wherein the worksurface 12 and hanging area 18 are shown as, by example, a double-width across a pair of horizontally-disposed laundry appliances 10. The hanging area 18 rests on a floor surface via a foot 86, and the extension rod 40 is received within the base rod 32 and held in place by a clamp mount as previously described. In this embodiment, at least one of the base rod 32 and the extension rod 40 extends through an aperture 90 in the worksurface 12, and the elongated central rod 36 and the extension rods 40 of the hanging area 18 can be raised and lowered relative to the base rods 32 to achieve a desired vertical position of the central rod 36. Furthermore, the spacer rods 38 are generally triangular shaped and formed by an upper rod 39 and a lower rod 41 that intersect at their front ends and are joined at their rear ends by a vertical rod 43 that receives the extension rod 40. Items to be hung can be hung on the lower rod 41 of the spacer rod 38 in addition to on the central rod 36. To facilitate hanging the items on the lower rod 41, the lower rod 41 can comprise a plurality of notches 37 sized to each receive a hanger.

Figure 37B:
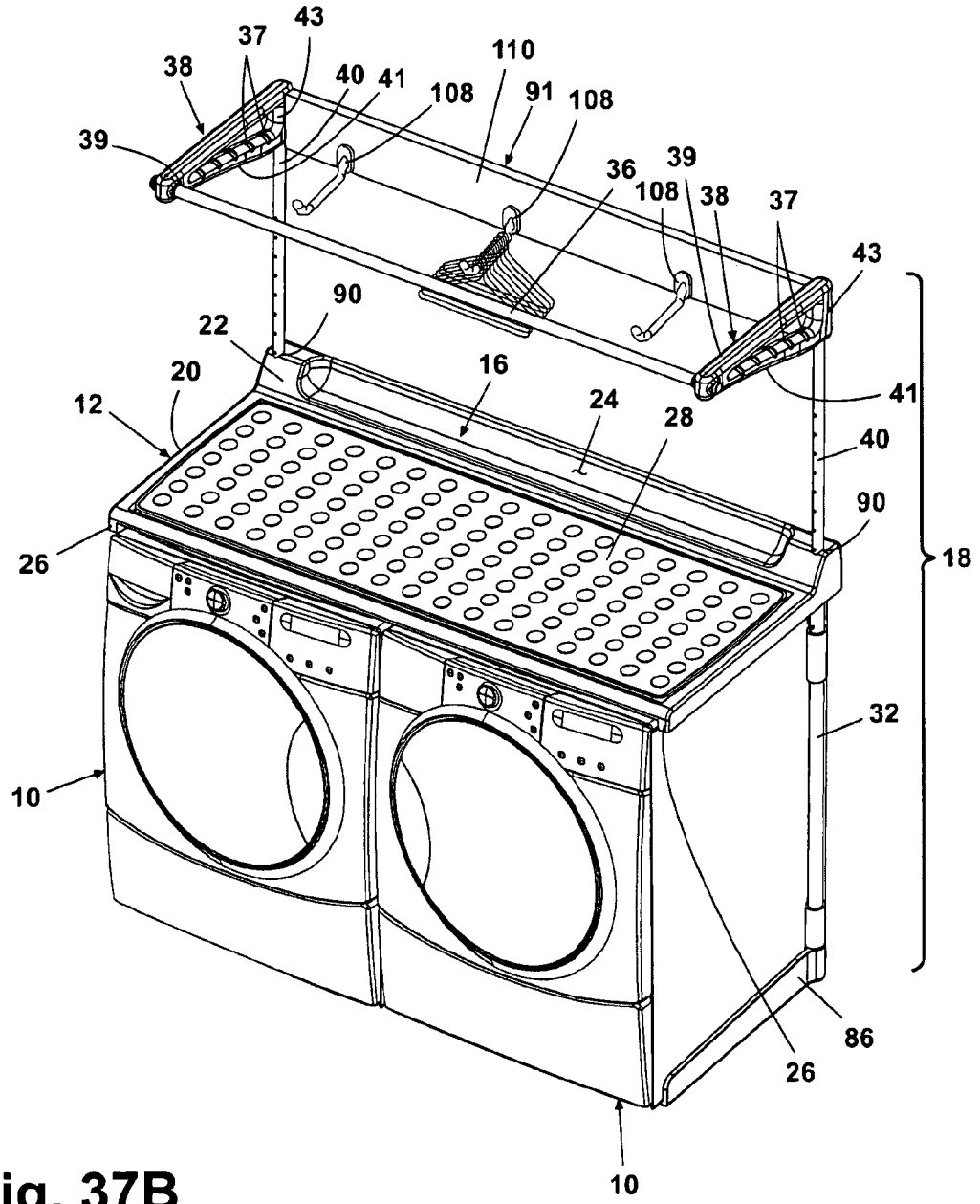
FIG. 37B is a perspective view an embodiment similar to the embodiment of FIG. 37A and further comprising a hanger staging area.

FIG. 37B is a perspective view of an embodiment of the modular laundry system similar to that of FIG. 37A, but the worksurface 12 further comprises the hanger storage area 91 in the form of hanger hooks 108 provided on a panel 110 that extends between rear ends of the spacer rods 38.

Figure 38:
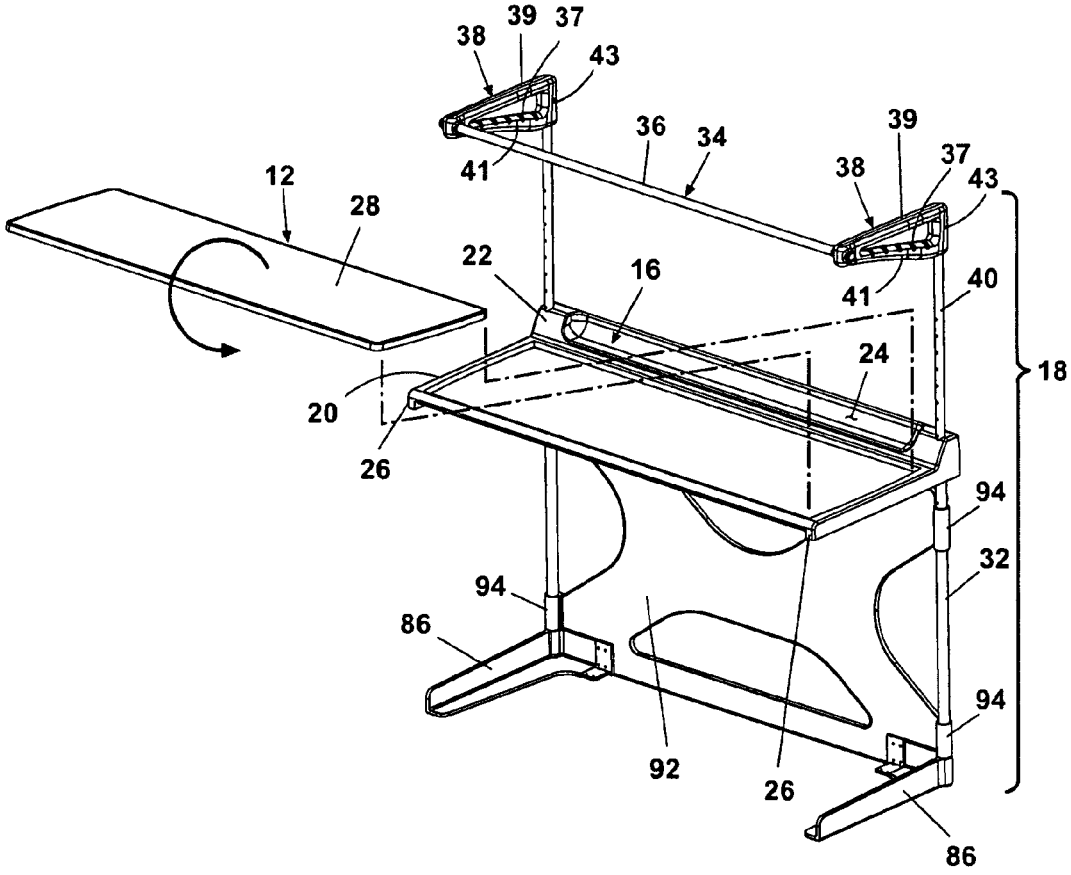
FIG. 38 is a perspective view of the worksurface from the embodiment of the modular laundry system shown in FIG. 37A in which the worksurface and hanging area are provided on a floor standing stand and at an insert of the worksurface is reversible to provide for a plurality of laundry-related functions to be performed on the worksurface depending upon which side of the insert is exposed.

FIG. 38 shows the embodiment of the modular laundry system in FIG. 37A in greater detail in which the worksurface 12 and hanging area 18 are provided on a floor standing stand, and a functional insert 28 provided on the worksurface 12 is reversible to provide for a plurality of functions to be performed on the worksurface 12 depending upon which side of the functional insert 28 of the worksurface 12 is exposed. As can be seen from FIG. 38, the feet 86 of the hanging area 18 can be formed as right-angle channels to allow for a portion of the laundry appliance 10 to rest thereon and provide a stabilizing force by sitting on at least a portion of the feet 86. A cross brace 92 can be provided at a lower rear vertical area of the hanging area 18 which supports the opposing base rods 32 in bearings 94. The cross brace 92 can assist the hanging area 18 in resisting torque forces applied on the hanging area 18 when a large amount of clothing is hung on the elongated central rod 36 and/or the spacer rods 38 of the hanging area 18 during use of the hanging area 18.

Figure 39:
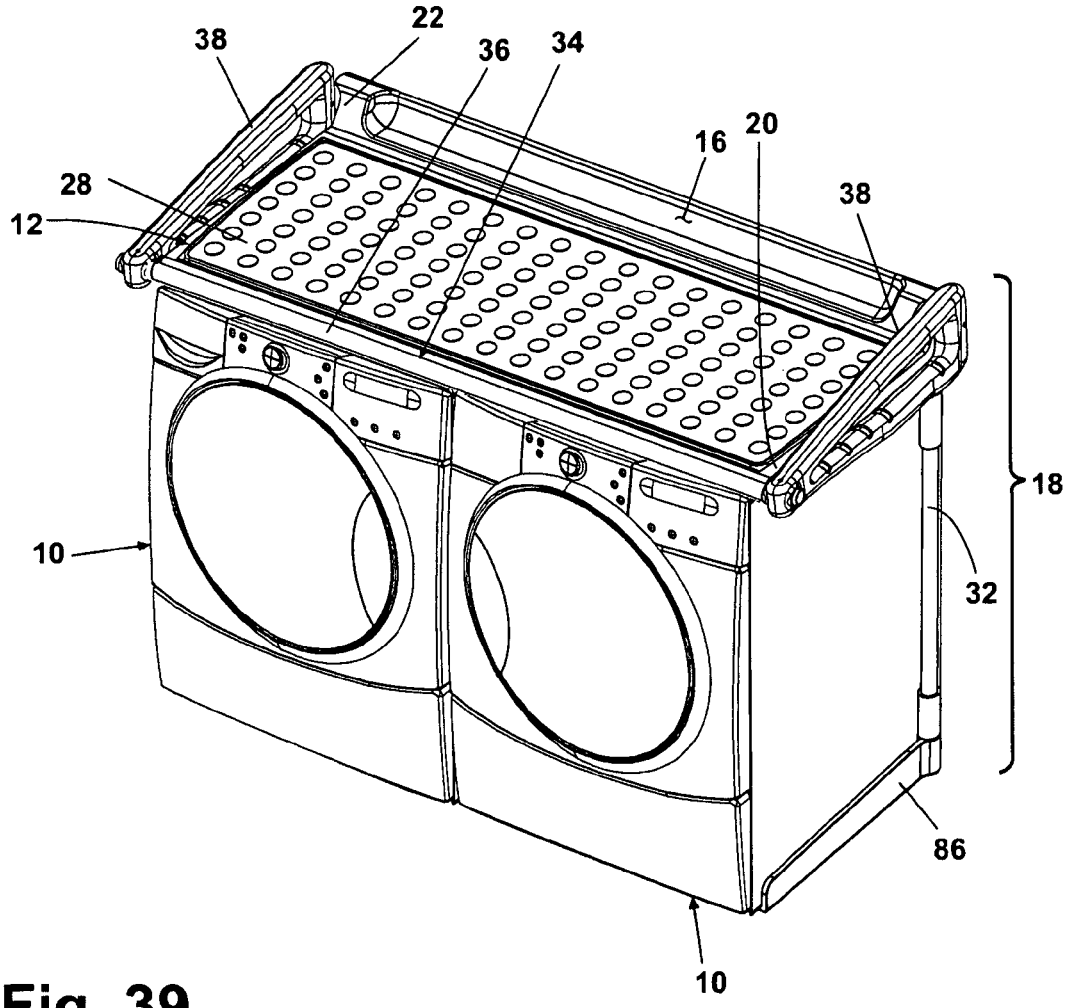
FIG. 39 is a perspective view of another embodiment of the modular laundry system similar to that shown in FIG. 37A in which the hanging area associated with the worksurface can be vertically adjusted down to a lowered position whereby a hanging rod provided on the hanging area is located adjacent to the worksurface.

FIG. 39 is a perspective view of an embodiment of the modular laundry system similar to FIG. 37A, except that the worksurface 12 is adapted to locate a portion of the hanging area 18 directly adjacent to the worksurface 12 when the hanging area 18 is fully retracted and not employed for hanging clothes. In this manner, the central rod 36 and the spacer rods 38, which, according to the illustrated embodiment, are generally triangular, can be retracted and stored in a flush manner adjacent to the worksurface 12, thereby, providing an aesthetically pleasing appearance to the modular laundry system.

Figure 40:
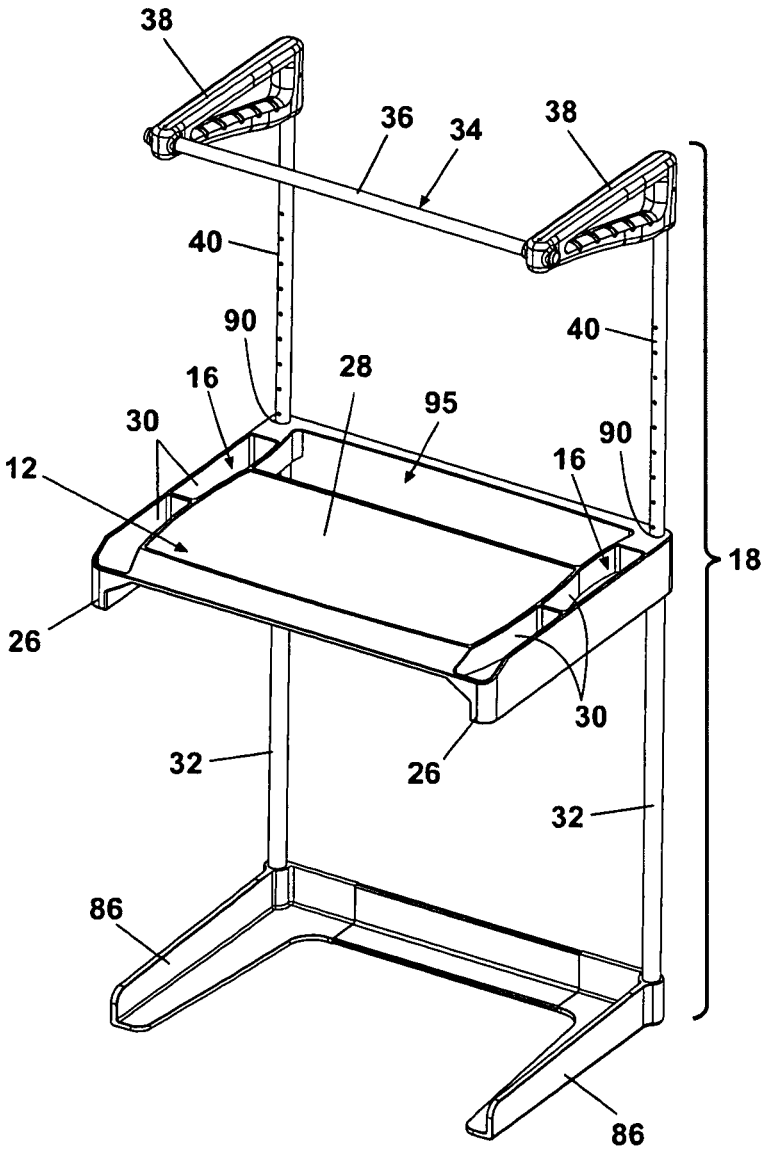
FIG. 40 is a perspective view of another embodiment of the modular laundry system similar to that shown in FIG. 38 in which a worksurface and hanging area are provided on a floor standing stand, and wherein the worksurface is provided with a saddle-bank-type staging area associated with the worksurface and an aperture to accommodate a backsplash of a laundry appliance.
Figure 41:
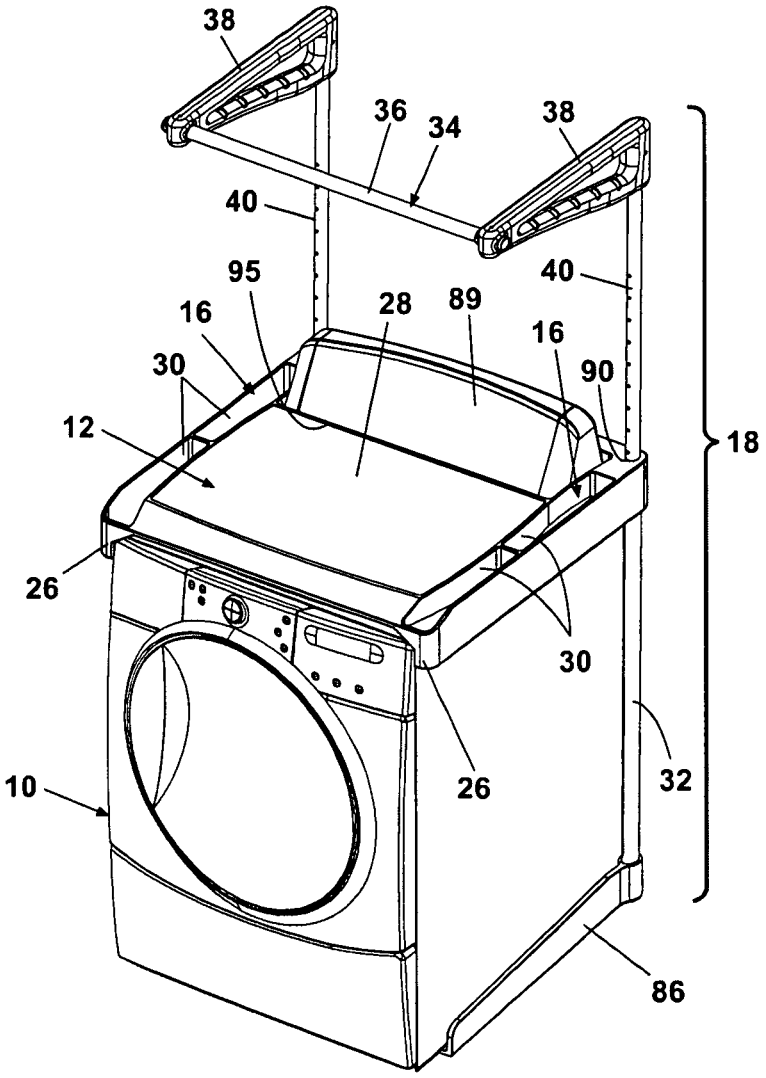
FIG. 41 is a perspective view of the embodiment of the modular laundry system shown in FIG. 40 in which a single horizontally-disposed laundry appliance is located within a recess created by the stand and the worksurface.
Figure 67:
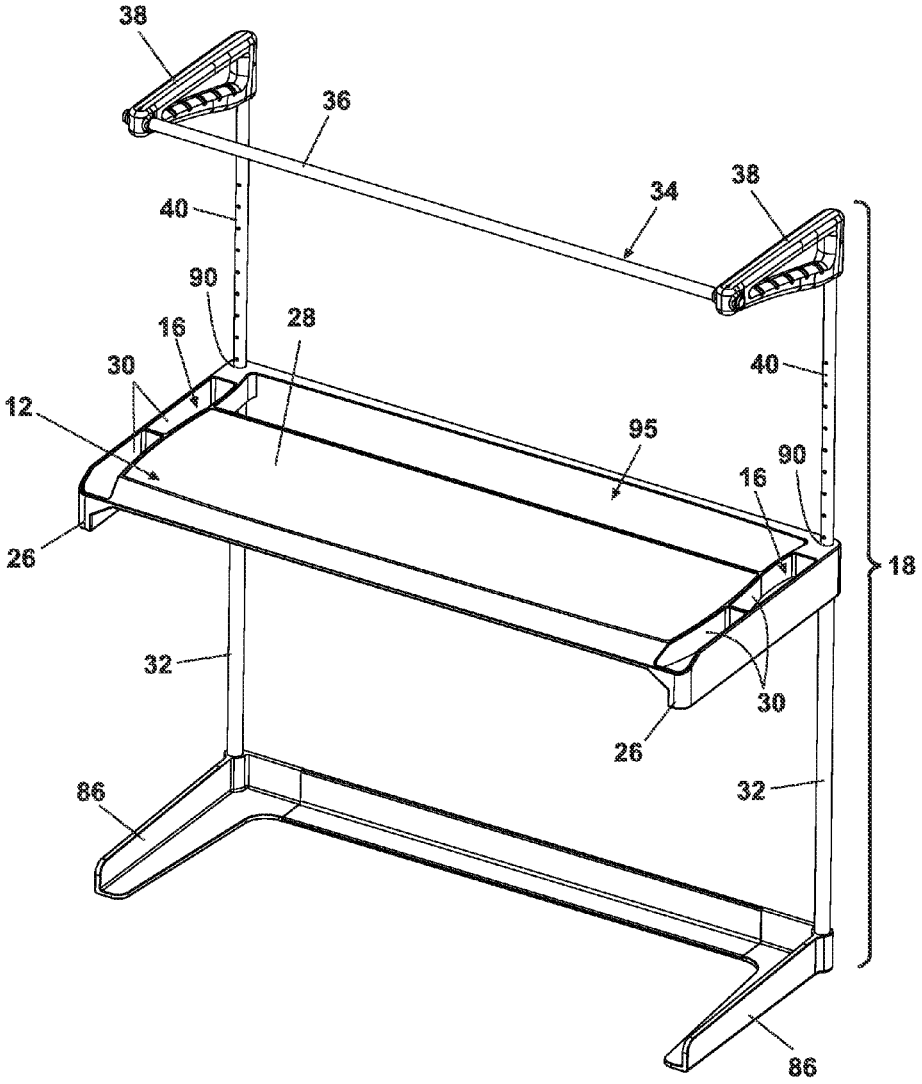
FIG. 67 is a perspective view of another embodiment of the modular laundry system similar to that shown in FIG. 40 in which a worksurface and hanging area now provided on a floor standing stand, and wherein the worksurface is provided with a saddle-bank-type staging area associated with the worksurface and an aperture to accommodate the backsplashes of two laundry appliances.
Figure 68:
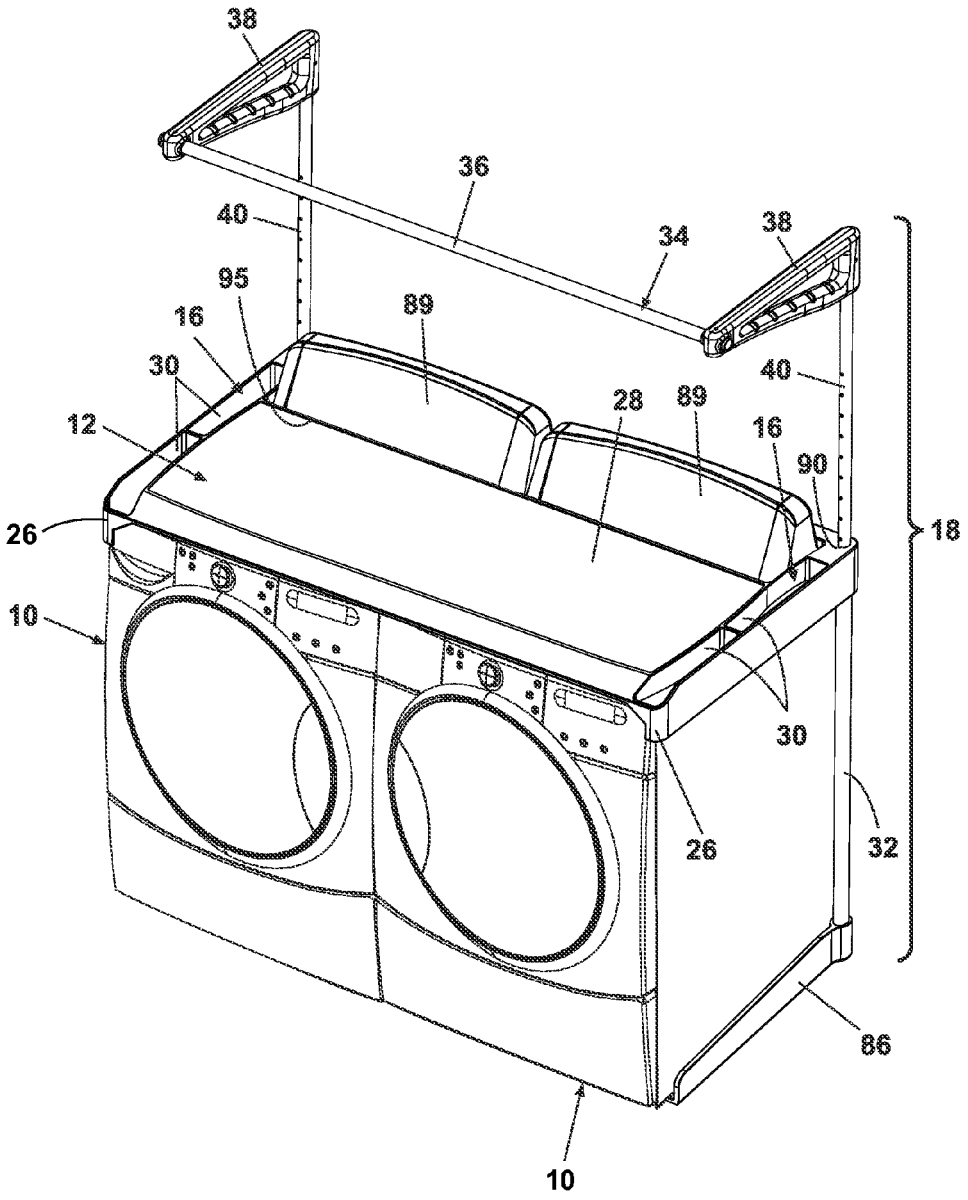
FIG. 68 is a perspective view of the embodiment of the modular laundry system shown in FIG. 67 in which two horizontally-disposed laundry appliances are located within a recess created by the stand and the worksurface.

FIG. 40 is a perspective view of another embodiment of the modular laundry system similar to that shown in FIG. 38 in which a worksurface 12 and hanging area 18 are provided on a freestanding stand and a functional insert 28 of the worksurface 12 is optionally reversible to provide for a plurality of laundry-related functions, and wherein the worksurface 12 is provided with saddle-bag staging bins 30 forming a storage/staging area 16 on the worksurface 12. The worksurface 12 further includes an elongated aperture 95 positioned and sized to receive a corresponding backsplash 89 of the laundry appliance 10, as illustrated in FIG. 41. When the worksurface 12 is supported by a plurality of laundry appliances 10 and/or modules as shown in FIGS. 67-68, such as two of the laundry appliances 10, the aperture 95 can be sized to accommodate the backsplashes of the plurality of laundry appliances 10 and/or modules.

FIG. 41 is a perspective view of the embodiment of the modular laundry system shown in FIG. 40 in which a single horizontally-disposed laundry appliance 10 is located within a recess created by the feet 86 and the worksurface 12. The weight of the laundry appliance 10 can transmit a stabilizing force to the hanging area 18 via the feet 86. Additionally, it can be seen in FIG. 41 that the staging bins 30 are located beyond a width of the laundry appliance 10 that is located in the recess created by the feet 86 and the worksurface 12.

Figure 42:
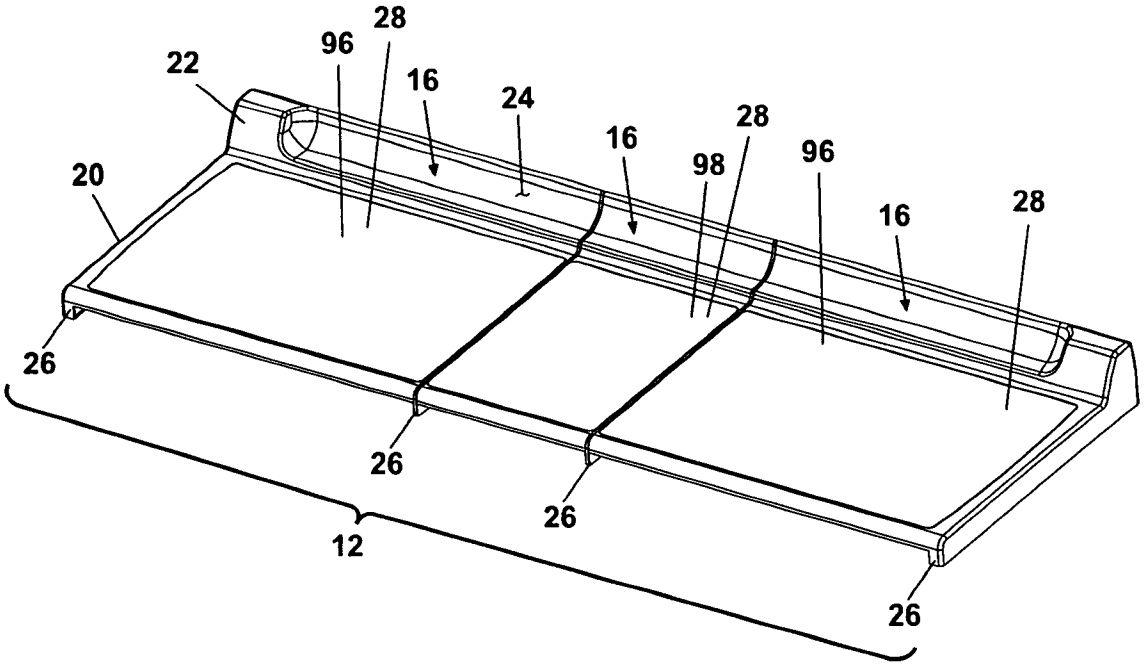
FIG. 42 is a perspective view of another embodiment of the modular laundry system similar to that shown in FIG. 8 in which the worksurface is provided as a leaf-type structure, generally comprised of end structures corresponding generally to the width of a single laundry appliance and an optional intermediate leaf for extending the overall length of the worksurface to selectively extend across at least two horizontally-disposed laundry appliances and a shelf module or other structure disposed between the horizontally-disposed laundry appliances.

As described earlier, the worksurface 12 can be provided as a contiguous integral structure, or as a leaf-type structure having multiple interconnected pieces connected laterally to one another as shown by example in FIG. 42. FIG. 42 is a perspective view of another embodiment of the modular laundry system in which the worksurface 12 is provided as a leaf-type structure, generally comprised of end structures or pieces 96, each corresponding generally to the width of a single laundry appliance 10, and at least one intermediate leaf or piece 98 for extending the overall length of the worksurface 12 to selectively extend across at least two horizontally-disposed laundry appliances 10 and a shelf module 14 and/or third laundry appliance 10 and/or other modules disposed between the horizontally-disposed laundry appliances 10. Examples of the other modules that can be disposed between the laundry appliances 10 are disclosed in the aforementioned and incorporated modular laundry system and module patent applications. The worksurface 12 can include any suitable number and sizes of the intermediate leafs 98 to achieve a desired longitudinal length (i.e., width) of the worksurface 12. Furthermore, the worksurface 12 need not incorporate the intermediate leaf 98 when the modular laundry system comprises only the two laundry appliances 10 and the worksurface 12. It is also within the scope of the invention for the worksurface 12 to comprise any size or number of segments or pieces that can be connected together laterally to form the worksurface 12 and to define the width of the worksurface 12.

Figure 43:
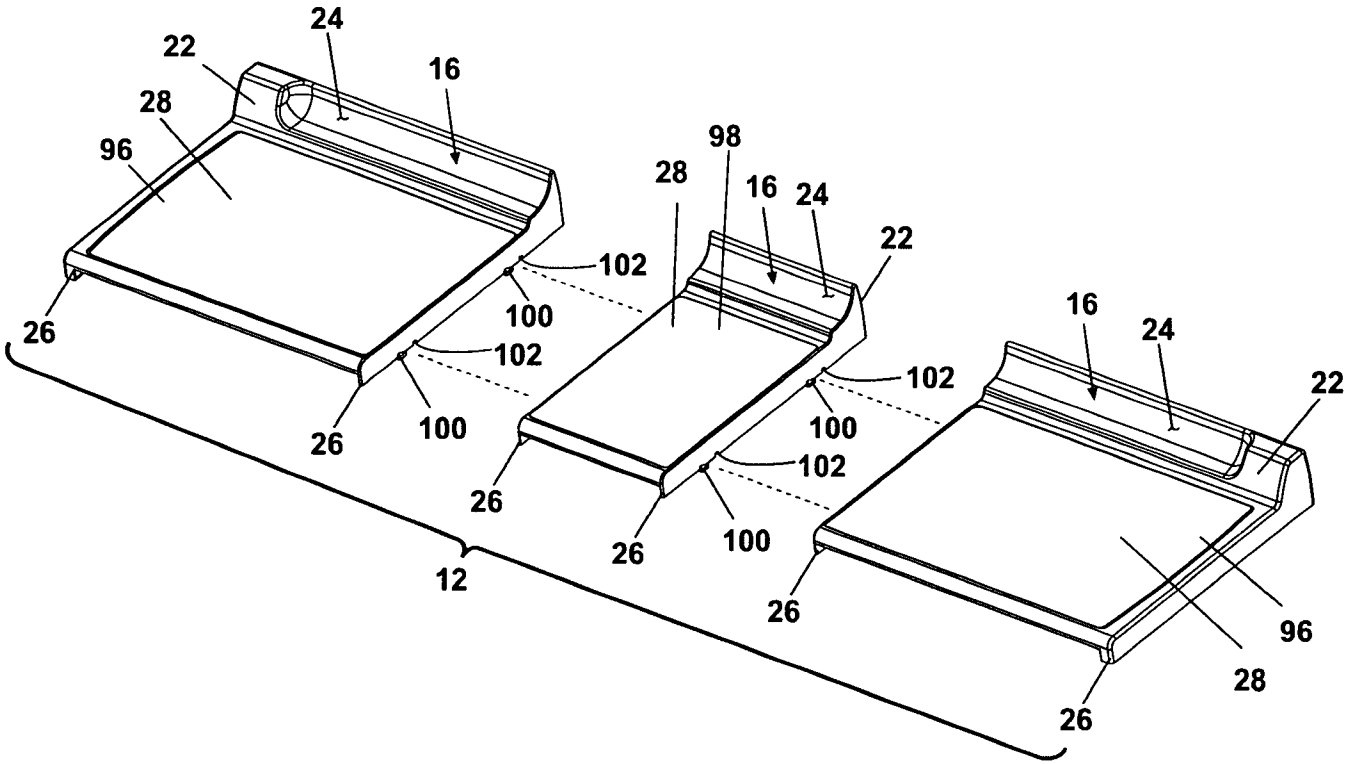
FIG. 43 is an exploded, perspective view of the leaf-type worksurface shown in FIG. 42.

FIG. 43 is an exploded, perspective view of the leaf-type worksurface 12 shown in FIG. 42 in which the interconnection between one of the end structures 96 and either the intermediate leaf 98 or another end structure 96 is shown as an interconnection between mating detents 100 and sockets 102. Of course, another attachment method can be employed, including, but not limited to, conventional fasteners or other mechanical attachment implements that do not require the use of tools to perform the interconnection and disassembly between adjacent portions of the worksurface 12.

Additionally, it can be seen in FIG. 43 that the end structures 96 and the intermediate leaf 98 can each comprise a portion of the backsplash 22, and the portions of the backsplash 22 mate or abut when the end structures 96 and the intermediate leaf 98 are connected together to form the unitary backsplash 22, as shown in FIG. 42. Similarly, the portions of the backsplash 22 can each include a portion of the staging recess 24, which mate or abut to form the unitary staging recess 24 when the end structures 96 and the intermediate leaf 98 are connected together.

Figure 44:
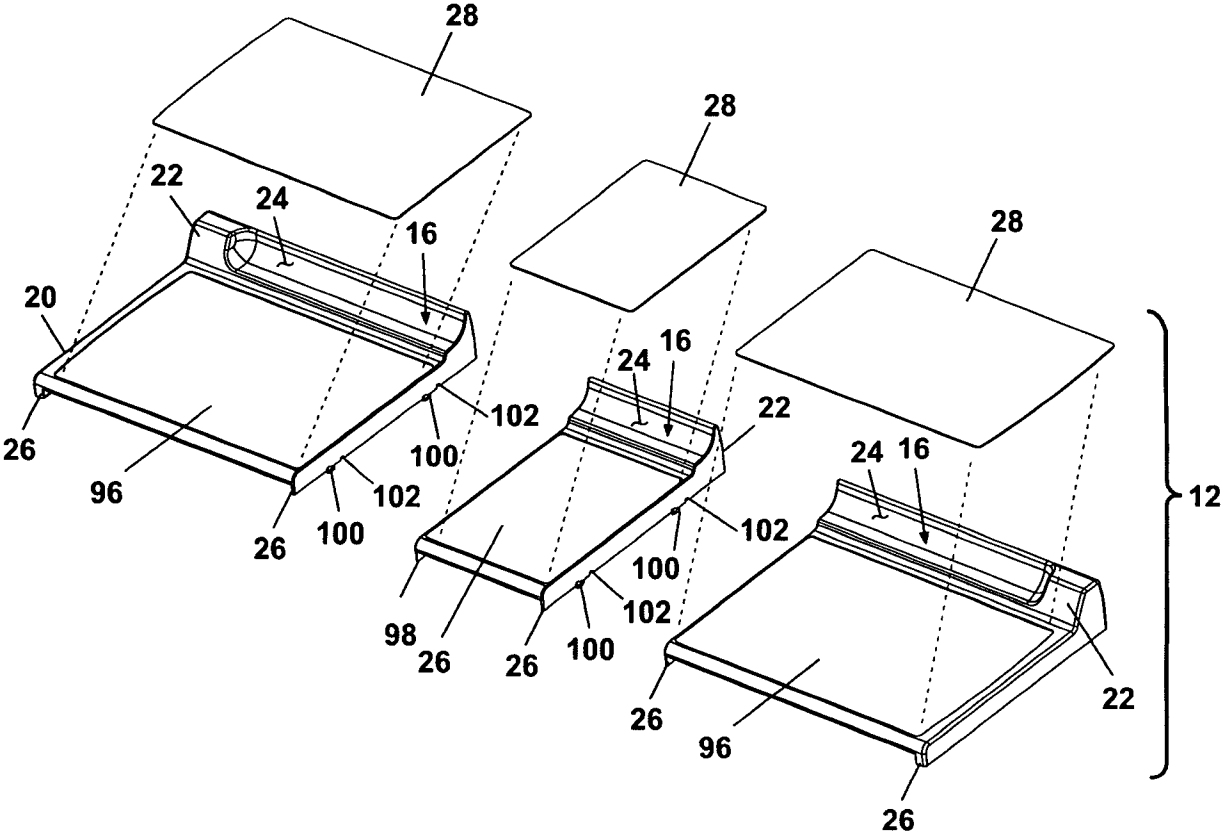
FIG. 44 is an exploded, perspective view of the leaf-type worksurface shown in FIGS. 42-43, and wherein the worksurface as shown having a removable and reversible functional insert provided thereon.
Figure 45:
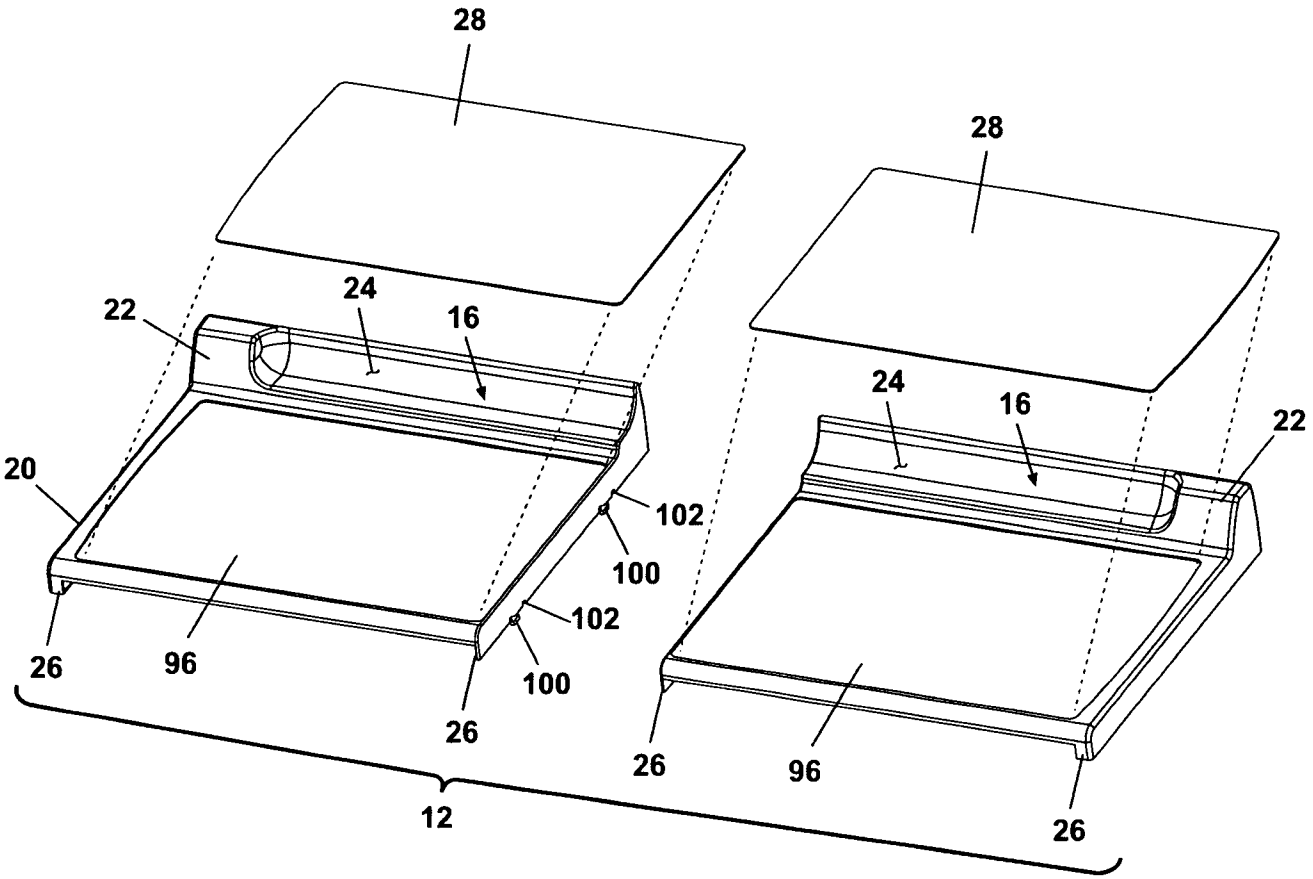
FIG. 45 is an exploded, perspective view of the leaf-type worksurface shown in FIGS. 42-44, wherein the intermediate leaf has been removed to illustrate the interconnectability of the end structures directly to one another.

As can be seen from FIGS. 43-44, the flanges 26 and functional insert 28 of the worksurface 12 can be formed on each of the components of the worksurface 12 (i.e., the end structures 96 and the intermediate leaf 98) to perform the functions as described earlier herein. The flanges 26 can be formed on both longitudinal ends of each of the components of the worksurface 12, as shown in FIGS. 43 and 44, or the flanges 26 can be formed only on one longitudinal end of each of the end structures 96 so that the worksurface 12 comprises only two of the flanges 26, with one flange 26 at each longitudinal end of the worksurface 12. The functional insert 28 can be formed by a plurality of adjacent individual functional inserts 28, wherein each of the components of the worksurface 12 has one of the individual functional inserts 28, as illustrated in FIGS. 43 and 44, or the functional insert 28 can be a unitary functional insert that extends across all of the components of the worksurface 12. FIG. 44 is an exploded, perspective view of the leaf-type worksurface 12 shown in FIGS. 42-43, and wherein the worksurface 12 is shown having a removable and reversible functional inserts 28 on each portion of the worksurface 12 provided thereon. FIG. 45 is an exploded, perspective view of the leaf-type worksurface 12 shown in FIGS. 42-44, wherein the intermediate leaf 98 has been removed to illustrate the interconnectability of the end structures 96 directly to one another.

Figure 46:
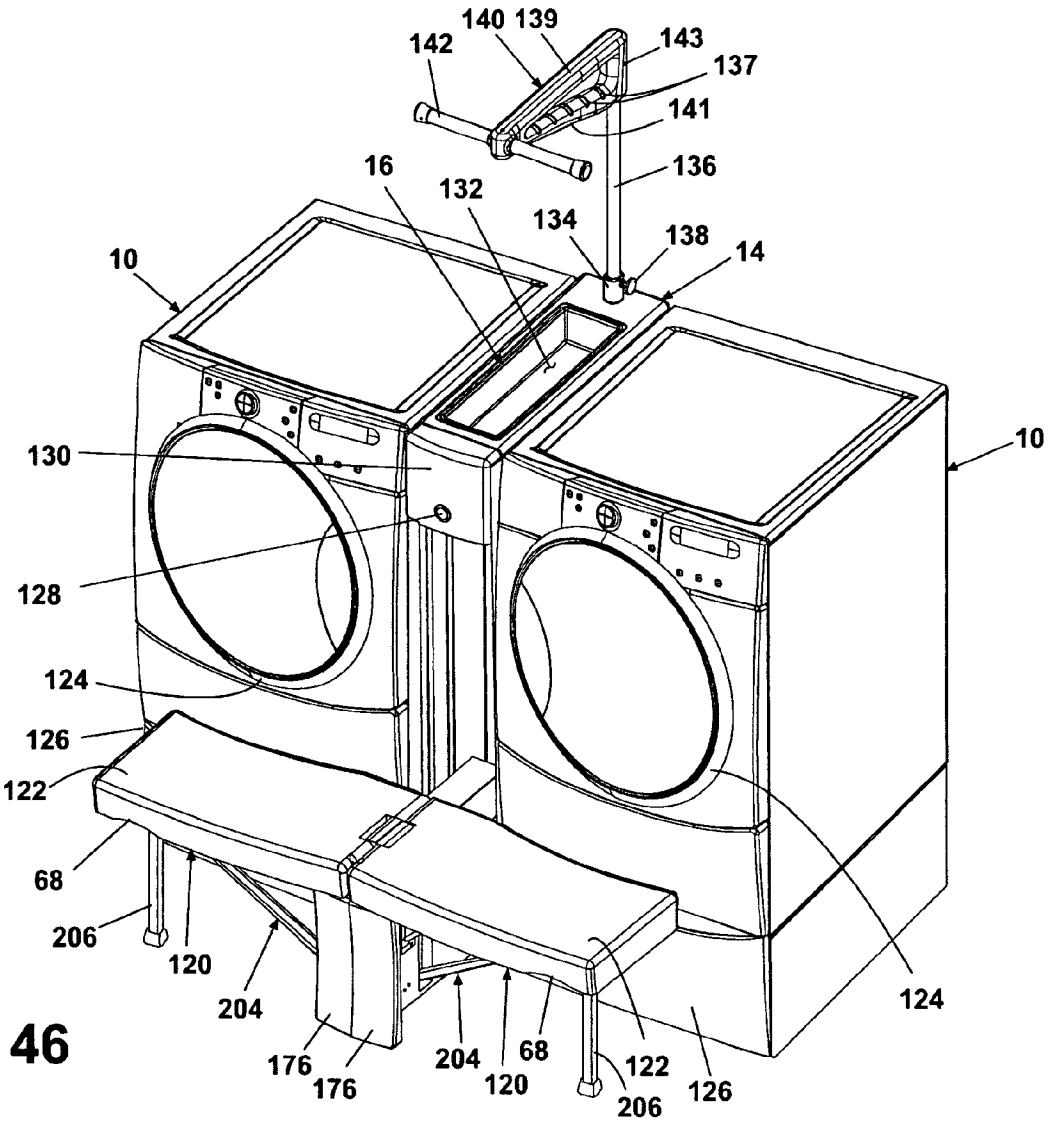
FIG. 46 is a perspective view of another embodiment of the modular laundry system of FIG. 1 and arranged in a configuration similar to that shown in FIG. 4, wherein a shelf module is disposed between a pair of laundry appliances, and which a pair of shelf assemblies of the shelf module has been extended to a use position.
Figure 47:
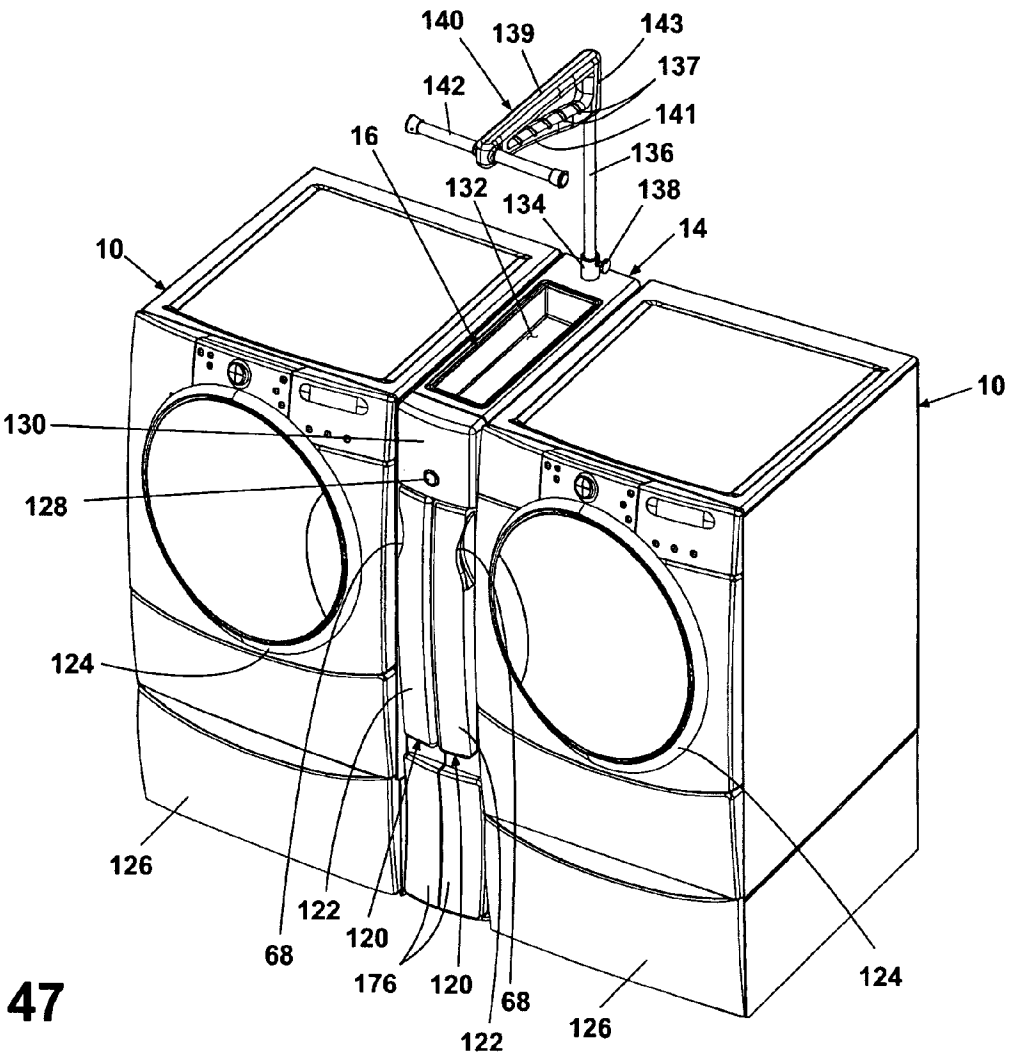
FIG. 47 is a perspective view of the embodiment of the modular laundry system of FIG. 46 wherein the pair of shelf assemblies has been retracted to a stored position, located generally in a flush retracted position between the laundry appliances.

In another embodiment, a shelf module 14 can be arranged adjacent to one of the laundry appliances 10 or between a pair of horizontally arranged laundry appliances 10 and includes at least one shelf mounted therein. For example, FIG. 46 shows an embodiment of the modular laundry system of FIG. 1 and arranged in a configuration similar to that shown in FIG. 4, wherein a shelf module 14 is disposed between a pair of horizontally arranged laundry appliances 10, which are both front-loading. The shelf module 14 comprises a pair of shelf assemblies 120, each having a shelf 122, which are shown in FIG. 46 in an extended, use position. Each of the shelf assemblies 120 provides a shelf for one of the laundry appliances 10 and can be moved to the extended, use position independently of one another. FIG. 47 shows the embodiment of the modular laundry system of FIG. 46 wherein the shelf assemblies 120 have been retracted to a stored position, located within the shelf module 14 generally in a flush retracted position between the laundry appliances 10. A user-graspable handle 68 is provided on each shelf assembly 120 to assist the user in moving the respective shelf 122 between the retracted and extended positions.

In the extended position of FIG. 46, the shelf 122 is in a generally horizontal orientation and, according to one embodiment, is located below a front opening 124 of the corresponding laundry appliance 10. The shelf assembly 120 in this position can be employed to perform various laundry-related activities thereon. For example, the shelf 122 can support a laundry basket to facilitate loading and unloading of clothes from the laundry appliances 10. When both of the shelves 122 are in the extended position, as shown in FIG. 46, the shelves 122 form a generally continuous horizontal surface so that the laundry basket can be slid from a position in front of one of the laundry appliances 10, such as a clothes washer, to a position in front of the other of the laundry appliances 10, such as a dryer. In this fashion, the clothes can easily be transferred from one laundry appliance 10 to another.

In the retracted position of FIG. 47, the shelf 122 is in a generally vertical orientation and is stored in a non-obstructive fashion within the shelf module 14, and the shelf assembly 120 frees up area within the area in which the modular laundry system resides. For example, when the shelf assembly 120 is in the stored position of FIG. 47, the shelf assembly 120 is out of the path of movement of a pair of lower storage drawers 126 upon which the laundry appliances 10 rest, so that the lower storage drawers 126 can be moved between retracted and extended positions in a manner which would be apparent to one skilled in the art. The lower storage drawers 126 can also be replaced with horizontal modules described in the aforementioned and incorporated modular laundry system and modules applications.

Figure 48:
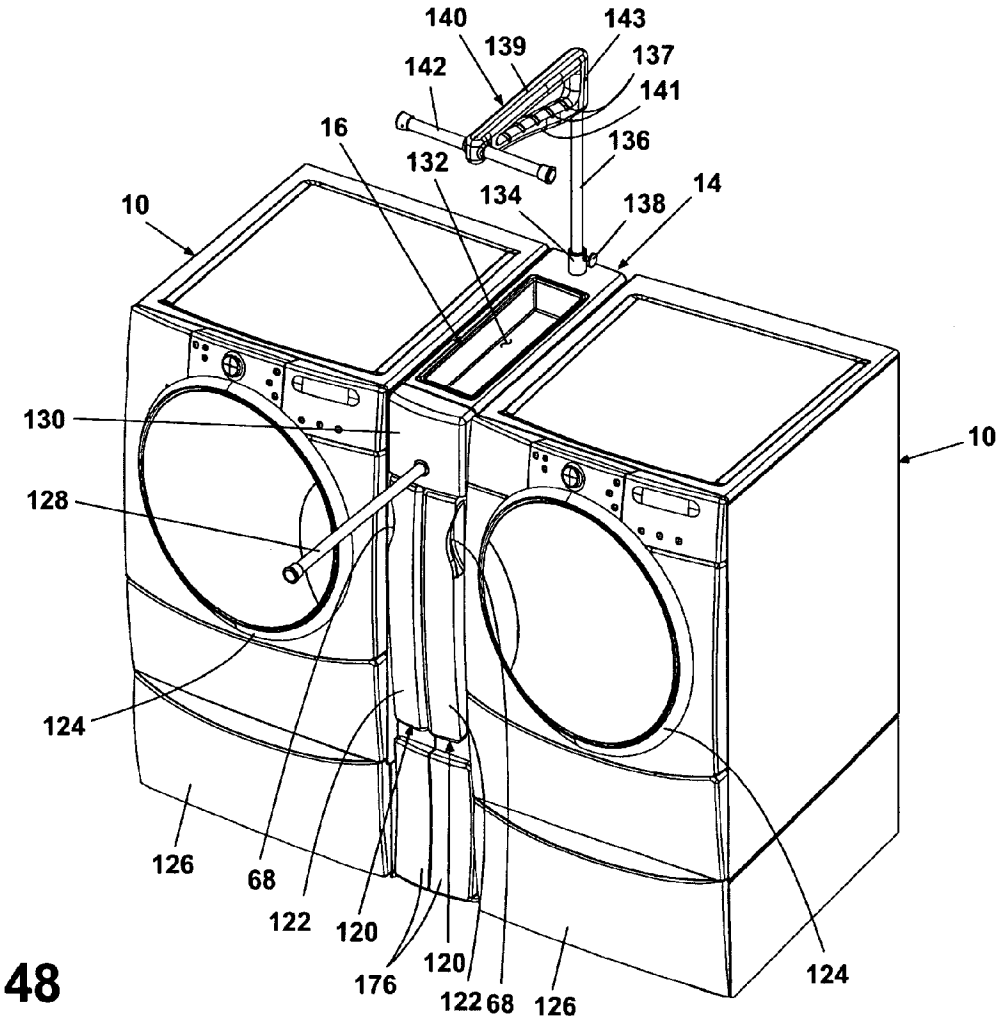
FIG. 48 is a perspective view of the embodiment of the modular laundry system of FIG. 46 wherein the pair of shelf assemblies has been retracted to the stored position, and wherein a hanging post has been extended from the shelf module to a use position.

Other functional features of the shelf module 14 are also contemplated. For example, FIG. 48 is a perspective view of the embodiment of the modular laundry system of FIG. 46 wherein the shelves 122 have been retracted to the stored position, and wherein a hanging post 128 has been extended from the shelf module 14 to a use position. In the extended use position, the hanging post 128 can be used as a rod for hanging clothes thereon. In one embodiment, the hanging post 128 can be an "antenna"-type device which collapses upon itself in discrete segments, so that it takes up very little space within the interior of the shelf module 14. In another embodiment, the hanging post 128 can be a solid rod member which simply extends and retracts into a chamber within the shelf module 14. Other embodiments of the hanging post 128 would be apparent to one skilled in the art, and the particular embodiment of the hanging post 128 illustrated in the drawings shall not be interpreted as limiting upon the scope of this invention. More detailed descriptions of the hanging post 128 are presented in the aforementioned and incorporated "Retractable Hanging Element" patent application.

Figure 49:
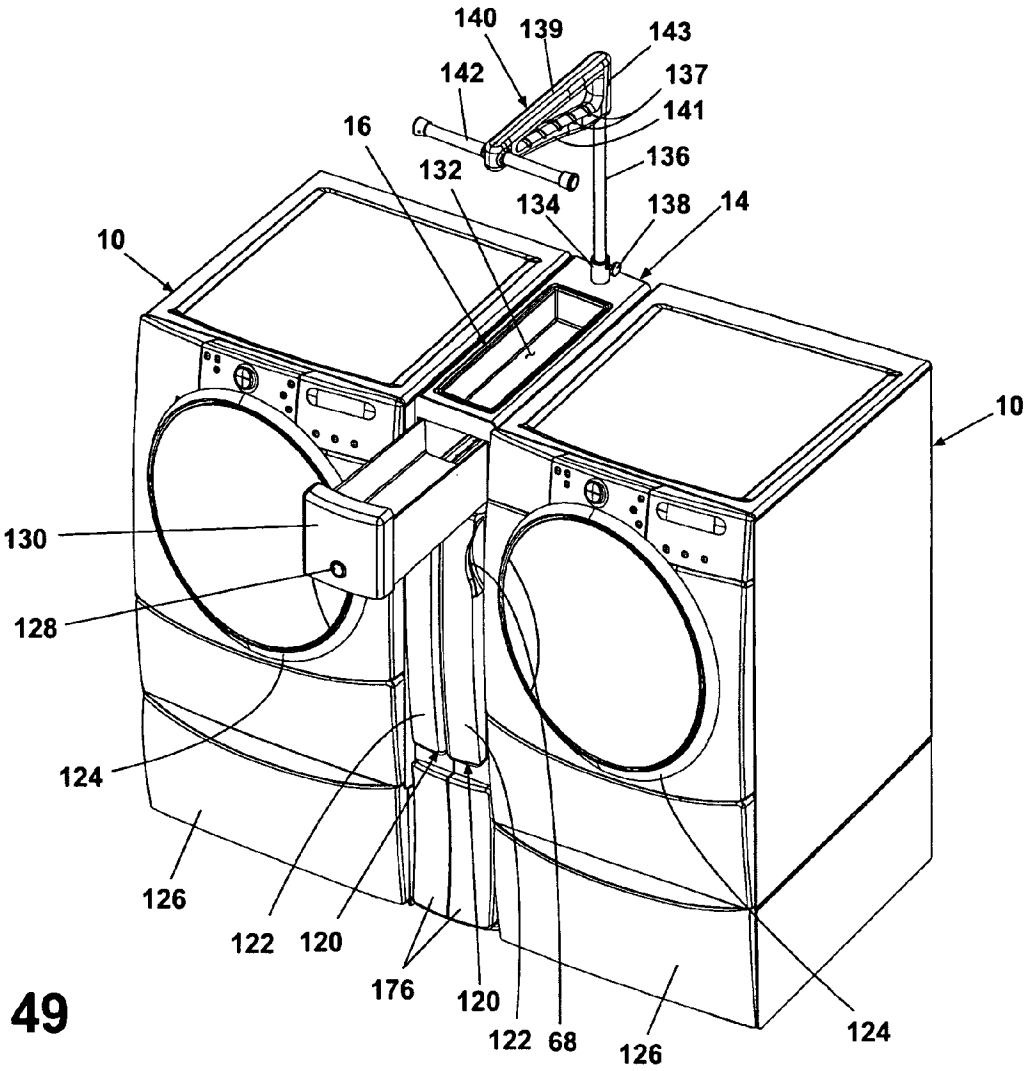
FIG. 49 is a perspective view of the embodiment of the modular laundry system of FIG. 46 wherein the pair of shelf assemblies has been retracted to the stored position, and wherein a storage drawer has been extended from the shelf module to a use position.

Another optional feature of the shelf module 14 of FIGS. 46-47 is the storage/staging area 16 in the form of a storage drawer 130. FIG. 49 is a perspective view of the embodiment of the modular laundry system of FIGS. 46-47 wherein the shelves 122 have been retracted to the stored position, and wherein the storage drawer 130 has been extended from the shelf module 14 to a use position. The storage drawer can incorporate the hanging rod 128, as shown in FIG. 49, or can be provided without the hanging rod 128. The storage drawer 130 can be mounted to the shelf module 14 via conventional drawer slides, in a tongue-in-groove manner, or any other known manner by which to slidably mount one component to another to perform slidable movement between the components. The particular examples shown herein shall not be limiting on the scope of this invention. The storage drawer 130 can provide a beneficial storage function for small items used in laundry-related operations, but which can be unsightly when simply strewn about an upper surface of a laundry appliance 10 (such as is typically done with conventional appliances not provided with the system described herein).

Figure 50:
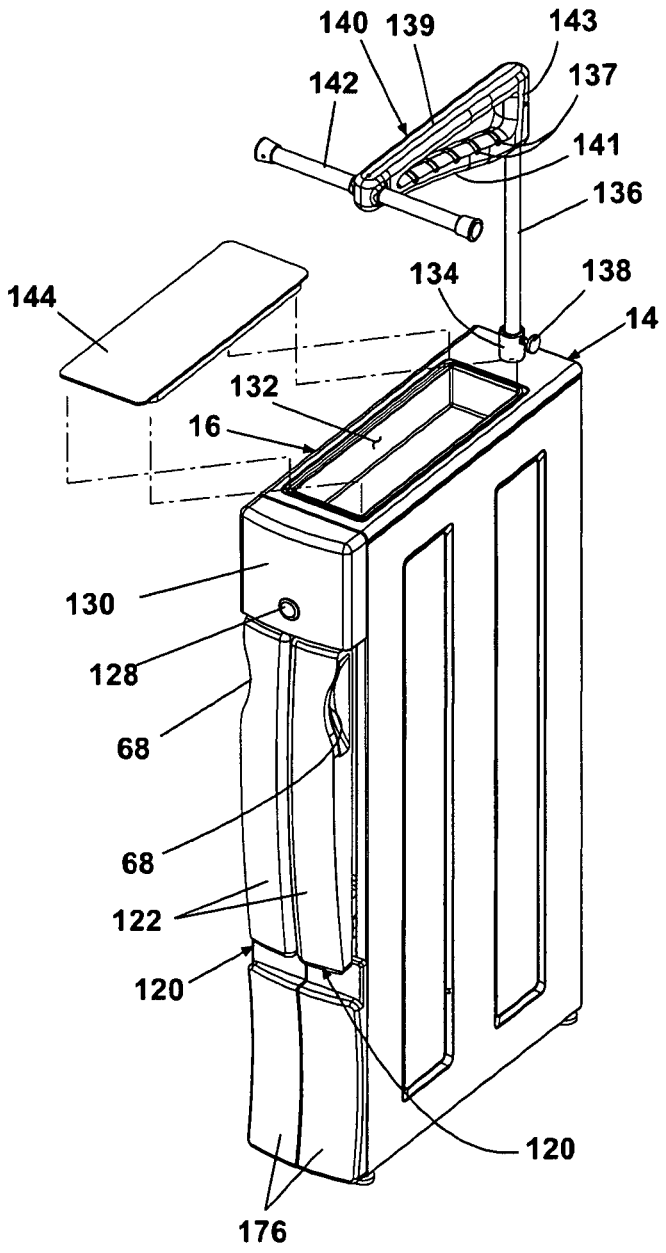
FIG. 50 is a perspective view of the shelf module illustrated in FIGS. 46-47 with the pair of shelf assemblies located in the retracted position and showing a removable cover for a staging area for accessing the contents therein from an upward location.

In addition, the shelf module 14 set forth in FIGS. 46-47 can also have an additional storage/staging area 16 comprising a convenient well area 132 provided as an open-top recess extending downwardly into an upper surface of the shelf module 14 as seen in FIGS. 46-49. The well area 132 can provide an additional staging option to the modular laundry system set forth herein. FIG. 50 is a perspective view of the shelf module 14 of FIGS. 46-47 with the shelves 122 located in the retracted position and showing a removable cover 144 which can optionally be employed to selectively close the well area 132 and thereby conceal the contents of the well area 132 of the storage/staging area 16.

Figure 51:
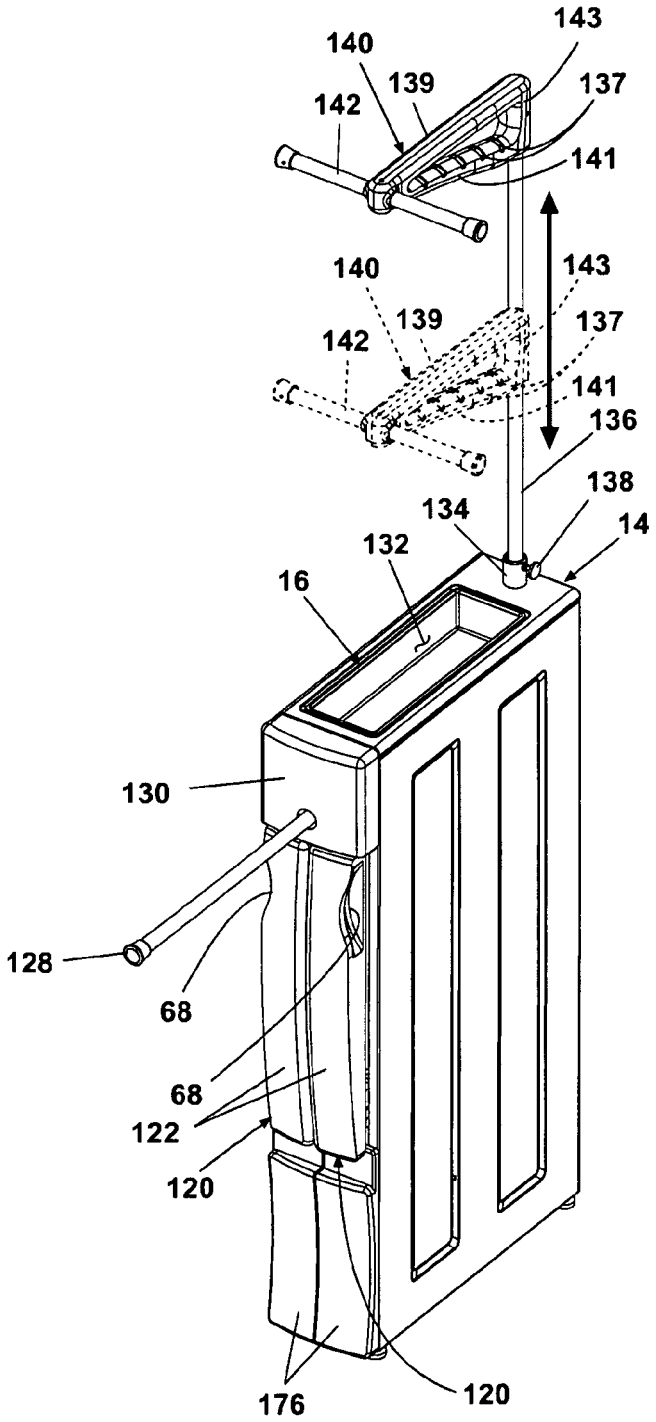
FIG. 51 is a perspective view of the shelf module illustrated in FIGS. 46-47 showing a forward hanging post extended and with phantom lines illustrating the adjustability of an upwardly-extending hanging rod.

The shelf module 14 can also have a hanging area 18, supplementary to the hanging rod 128 previously described. The hanging area 18 comprises a base 134 which has an extension rod 136 mounted thereto by a conventional mounting member, such as a clamp mount 138. An upper portion of the extension rod 136 has a spacer bracket 140 mounted thereto. The spacer bracket 140 is generally triangular shaped and is formed by an upper rod 139 and a lower rod 141 that intersect at their front ends and are joined at their rear ends by a vertical rod 143 that receives the extension rod 136. Items to be hung can be hung on the lower rod 141 of the spacer bracket 140. To facilitate hanging the items on the lower rod 141, the lower rod 141 can comprise a plurality of notches 137 sized to each receive a hanger. A centrally-mounted elongated hanging rod 142 which extends laterally from each side of the spacer bracket 140 provides another option for the user to hang clothes in the modular laundry system using the hanging area 18. Releasing the clamp mount 138 allows the extension rod 136 to be vertically adjusted with respect to the base 134 of the shelf module 14. FIG. 51 illustrates the various functionality and adjustability of the shelf module 14 of FIGS. 46-47 showing the hanging post 128 extended and with phantom lines illustrating the adjustability of the hanging area 18, which can vertically reposition the hanging rod 142 and the spacer rod 140.

Figure 52:
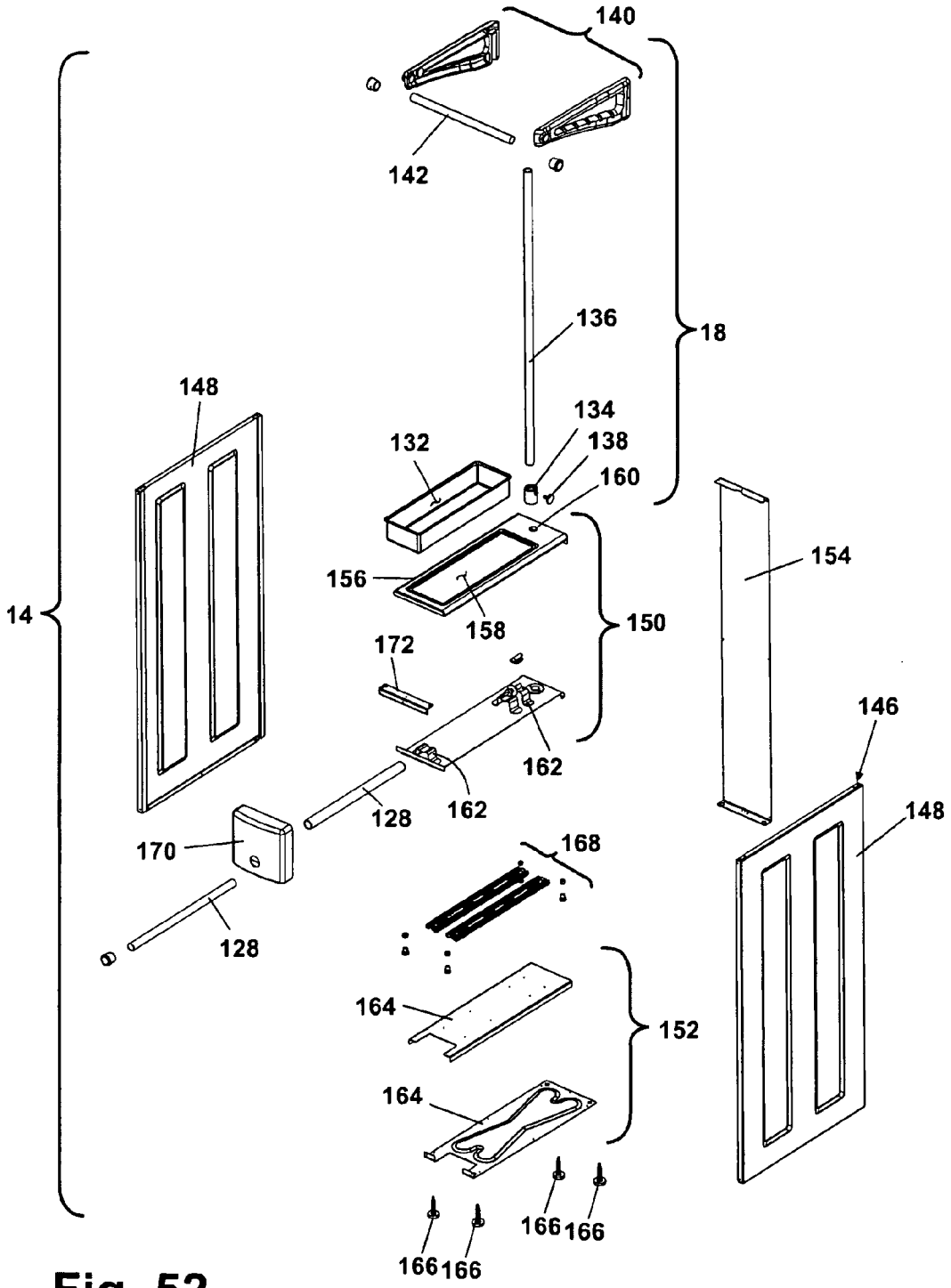
FIG. 52 is an exploded perspective view of a housing for the shelf module of FIGS. 46-47.
Figure 53:
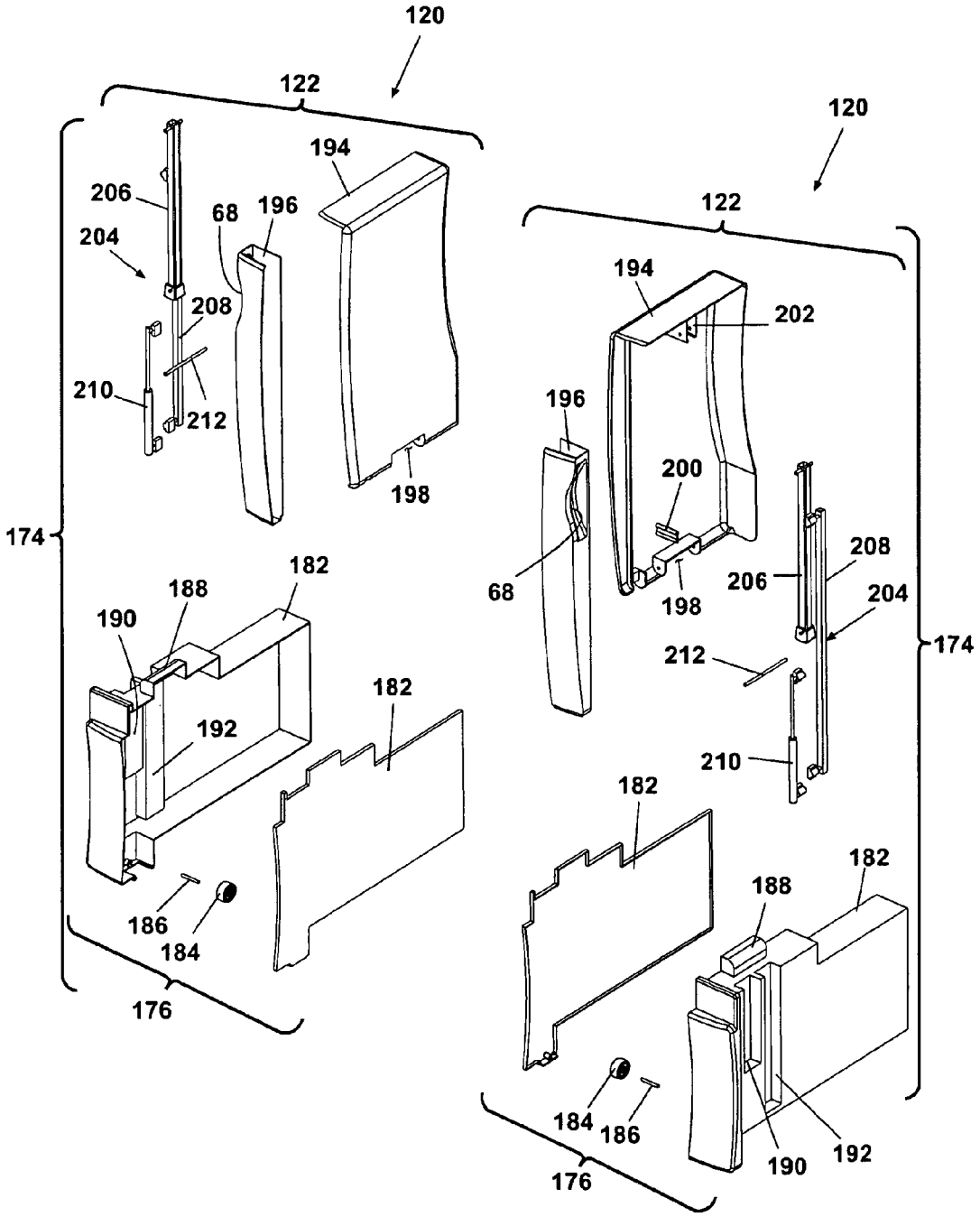
FIG. 53 is an exploded perspective view of the pair of shelf assemblies for the shelf module of FIGS. 46-47.

The components of the embodiment of the shelf module 14 shown in FIGS. 46-47 will be described in detail with respect to FIGS. 52-53. FIG. 52 is an exploded perspective view of a housing 146 for the shelf module 14 of FIGS. 46-47. FIG. 53 is an exploded perspective view of the shelf assemblies 120 for the shelf module 14 of FIGS. 46-47.

With reference to FIG. 52, the housing 146 of the shelf module 14 comprises a pair of sidewalls 148, which are interconnected at their respective upper and lower ends to an upper wall 150 and a lower wall 152, respectively. A rear wall 154 forms a rear surface of the housing 146. The upper, lower and rear walls 150, 152 and 154 cooperate to form an open-face chamber in which the shelf assemblies 120 are mounted. The upper wall 150 comprises a top plate 156 having an elongated forward aperture 158 for receipt of the well 132 in drop-in fashion and a rear aperture 160 that mounts the base 134 of the hanging area 18. The upper wall 156 also has a support plate mounted beneath the top plate 158 and including forward and rearward journals 162 for mounting the hanging post 128. Alternatively, the journals 162 can be provided as stamped spring members that retain the hanging post 128 thereagainst. The bottom wall 152 comprises a pair of bottom plates 164 mounted in juxtaposed relationship and provided with a plurality of glide feet 166 threadingly mounted thereto. A pair of slide tracks 168 is mounted to an interior surface of the bottom plate assembly 164 to provide for a low-friction method by which the shelf assemblies 120 can be moved between the retracted and the extended positions. A front fascia 170 is mounted to the housing 146 by a mounting bracket 172. The front fascia 170 provides a flush outer surface for the housing 146 above the shelf assemblies 120 when the shelf assemblies 120 are in the stored position. The front fascia 170 has an aperture therethrough which journals the hanging post 128 therein and provides a flush mounted seat when the hanging post 128 is located in the retracted position.

With respect to the shelf assemblies 120 shown in FIG. 53, the shelf assemblies 120 each comprise, in this embodiment, a pivotal assembly 174 comprising the shelf 122 pivotally connected to a base 176. The shelf 122 of each pivot assembly 174 can rotate relative to the base 176 about a generally horizontal axis when the shelf assembly 120 is extended from the interior chamber of the shelf module 14. The base 176 comprises a clamshell housing 182 having a wheel 184 on an axle 186 located at a lower forward portion of the clamshell housing 182. The wheel 184 is received on the axle 186 for rotational movement, and the axle 186 is mounted to the lower forward portion of the housing 182 via suitably-size and located bosses in the housing 182. Preferably, when the wheel 184 is so mounted, it extends beneath a lower surface of the base 176 so that the base 176 can travel over a supporting surface and provide a low-friction method of movement of the base 176.

An upper portion of the housing 182 is provided with a hinge mount 188, and an exterior side surface of each opposed outer face of each base 176 further comprises a first partial-height channel 190 and a second full-height channel 192 in generally parallel relationship. The partial height channel 190 and the full-height channel 192 each extend downwardly from an upper surface of the base 176, with the partial-height channel 190 having a vertical height less than the full-height channel 192.

The shelf 122 comprises a top panel 194 having a front fascia 196 attached thereto and forming an aesthetically-pleasing forward face of the shelf 122. The user-graspable handle 68 is preferably provided on the front fascia 196. The underside of the top panel 194 has a recess 198 extending inwardly from an interior side surface thereof in general registry with and sized to receive the hinge mount 188 on the base 176. A damper mount 200 is located adjacent the hinge recess 198 and depends downwardly from the underside of the top panel 194. Opposite the hinge recess 198 and the damper mount 200 is provided a leg mount 202. It will be understood that the particular embodiments of the mounts 198, 200, 202 shown in the drawings are by example only, and other suitable mountings could be substituted therefor without departing from the scope of this invention.

A leg assembly 204 is provided for supporting the top panel 194 above a floor surface and comprises a leg 206, a brace 208 and a damper 210. An upper end of the brace 208 is pivotally mounted to an upper region of the leg 206. The damper 210 is a conventionally-known fluid damper, such as the shock absorber/piston-type device shown in FIG. 53.

The assembly of the shelf module 14 and the shelf assemblies 120 will now be described with reference to FIGS. 52-53. It will be understood that any suitable attachment method can be employed to attach the components together as described including, but not limited to, conventional fasteners, snap-fit components, detents, and the like.

The upper, lower and rear walls 150, 152 and 154 are assembled together to form the rectangular housing 146 with an open front. The housing 146 is vertically oriented in that its height is greater than its width. The glide feet 166 are mounted within the bottom plate 164 of the bottom wall 152 to support the shelf module 14 on a floor surface. The hanging post 128 is received within the retainers 162 on the top plate 150 and is passed through the central aperture on the front fascia 170 so that the hanging post 128 can be extended and retracted with respect to its retention on the top wall 152. The front fascia 170 is mounted to the top wall 152 by the mounting bracket 172. The well 132 is dropped into place within the forward aperture 158 in the top wall 152. The base 134 of the hanging area 18 is mounted to the top wall 152, the extension rod 136 is mounted to the base 134 via the clamp mount 138, and the spacer bracket 140 is mounted atop the extension rod 136 with the hanging rod 142 attached thereto.

To assemble each of the shelf assemblies 120, the base 176 is assembled by mounting the clamshell housings 182 together with the axle 186 and wheel 184 subassembly located therebetween to rotatably mount the wheel 184 to the housing 182. The top panel 194 (with the front fascia 196 attached thereto) is attached to the base 176 by inserting the hinge mount 188 into the hinge recess 198 and rotatably mounting it thereto, such as by a hinge rod 212, which passes generally coaxially though each component to create a rotatable pivot mounting therebetween. An upper end of the leg 206 is pivotally mounted within the leg mount 202 on the underside of the top panel 194. An upper end of the brace 208 is mounted to the leg 206 adjacent to, but spaced longitudinally from, the upper end of the leg 206. An opposite end of the brace 208 is mounted within the full-height channel 192 of the base 176. Opposite ends of the damper 210 are mounted respectively to the damper mount 200 on the underside of the top panel 194 and adjacent to a lower end of the partial-height channel 190 of the base 176.

A pair of shelf assemblies 120 are constructed as described herein and arranged in opposed relationship to one another, and a lower surface of each base 176 rearward of the wheel 184 on each base 176 is mounted upon a corresponding slide 168 located within the interior of the housing 146. The slides 168 assist the forward and rearward sliding of each base 176 and, thereby, each shelf 122 with respect to the housing 146 as assisted by each wheel 184 on the base 176.

Figure 54:
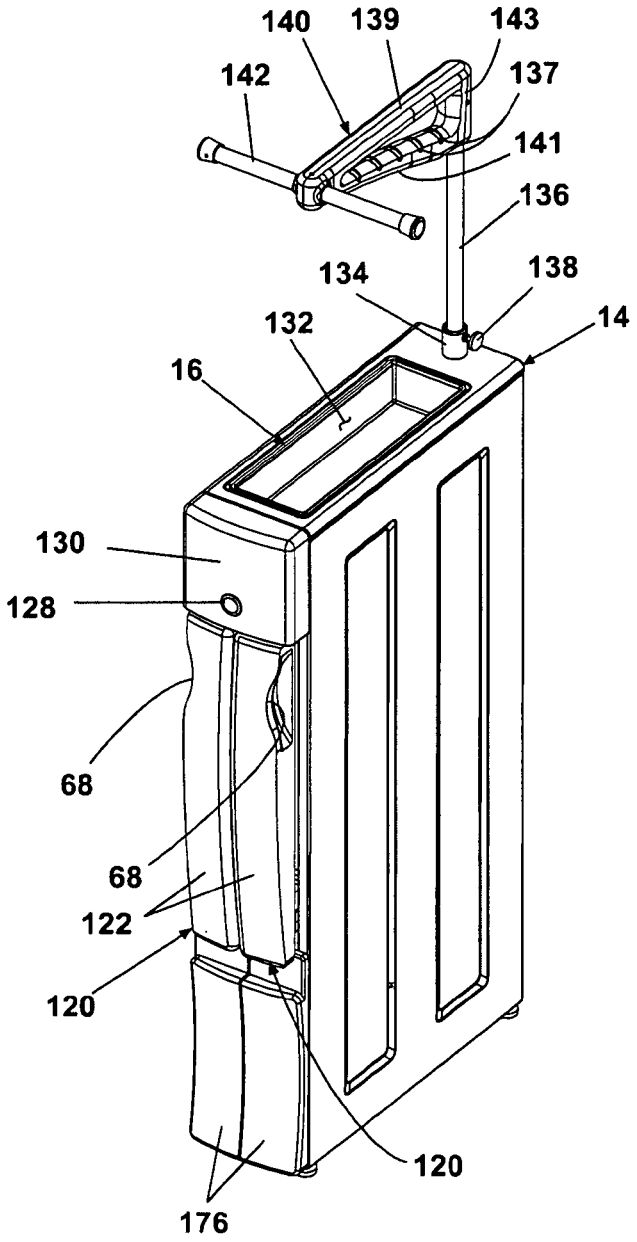
FIG. 54 is a perspective view of the shelf module illustrated in FIGS. 46-47 with the pair of shelf assemblies positioned in the retracted position.
Figure 55:
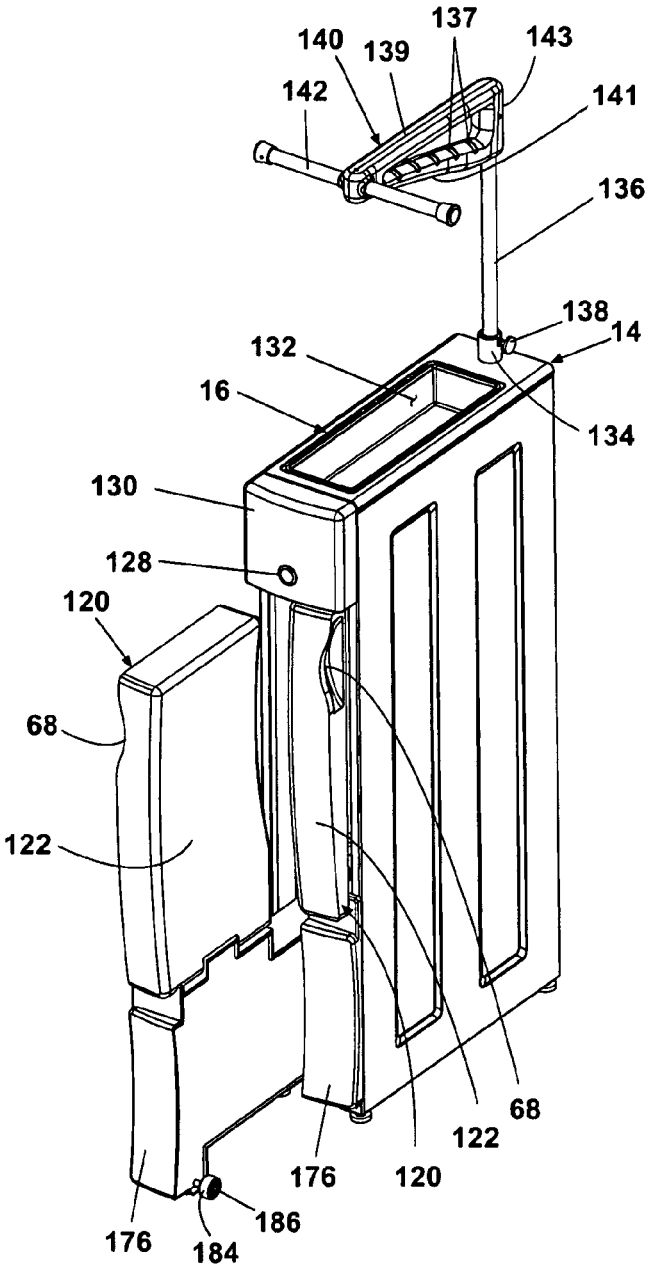
FIG. 55 is a perspective view of the shelf module of FIG. 54 showing one of the shelf assemblies in an intermediate position and the other of the shelf assemblies retracted.
Figure 56:
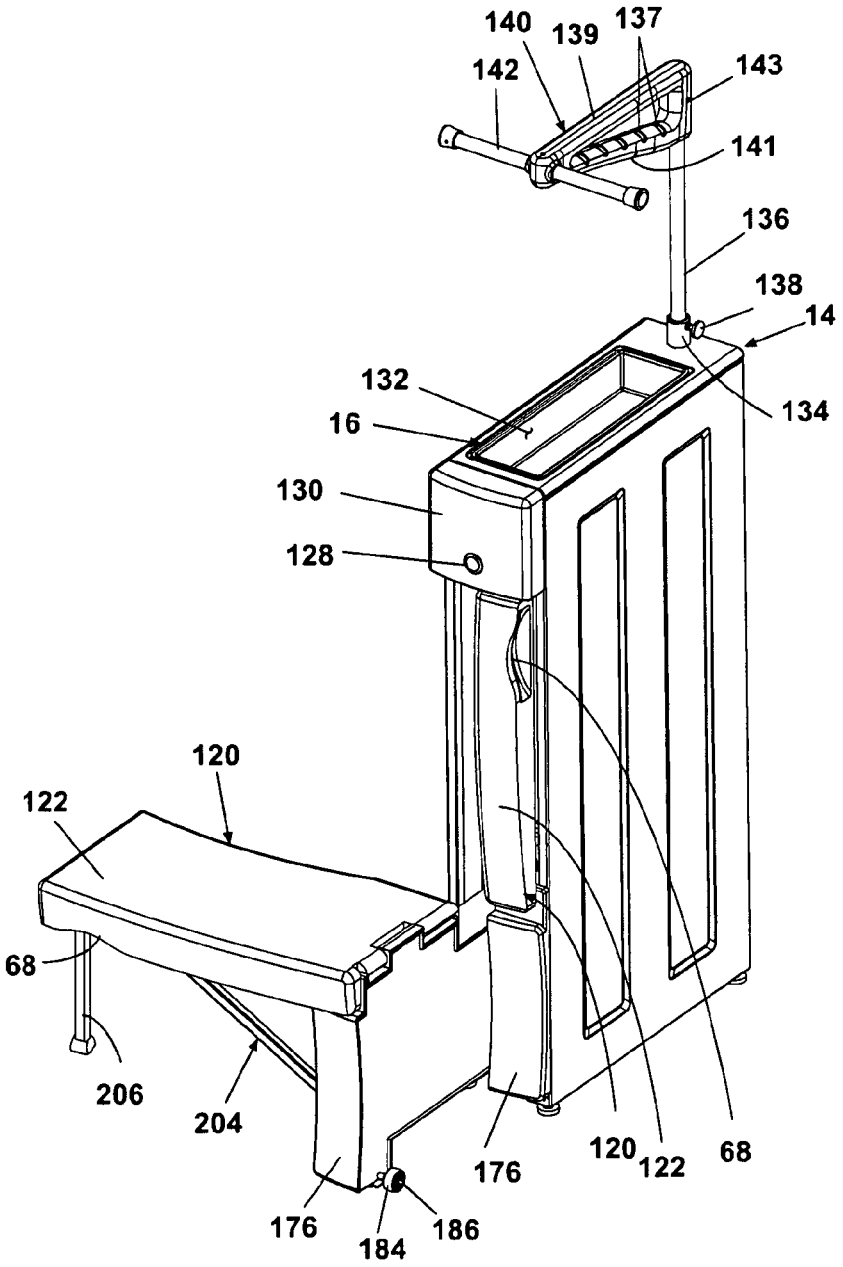
FIG. 56 is a perspective view of the shelf module of FIG. 54 showing one of the shelf assemblies fully extended to the use position and the other of the shelf assemblies retracted.

The shelves 122 of the shelf module 14 can be moved individually or simultaneously between the retracted and extended positions. The process of moving one of the shelves 122 is illustrated in FIGS. 54-56. When the shelf 122 is in the retracted position of FIG. 54, the shelf 122 is received within the housing 146 and is in a generally vertical orientation.

To move one of the shelves 122 from the retracted position of FIG. 54, the shelf 122 is grasped, such as by the handle 68, and the shelf assembly 120 is pulled outwardly. During sliding movement of the shelf assembly 120 from the retracted position, the shelf 122 and the base 176 extend beyond the front opening of the housing 146. At this point, the shelf assembly 120 achieves an intermediate position, as shown in FIG. 55, where the shelf 122 is located exteriorly of the housing 146 and is in a generally vertical orientation.

Next, the shelf 122 pivots about the hinge mount 188 to the extended use position shown in FIG. 56, where the shelf 122 is located exteriorly of the housing and is in a generally horizontal position. Pivotal movement of the shelf 122 relative to the base 176 can be accomplished by gravity acting on the shelf 122. As the gravity pivots the top panel 194 of the shelf 122, the leg 206 pivots about the leg mount 202 and drops into a generally vertical position as restricted by the damper 210 acting on the top panel 194. Once the top panel 194 has dropped from a generally vertical position into a generally horizontal position, the leg 206 supports an outboard end of the top panel 194 as reinforced by the brace 208. Alternatively, the shelf 122 can be manually pivoted relative to the base 176. The other shelf 122 is placed in the extended position in the same manner, and when both of the shelves 122 are extended, as shown in FIG. 46, the shelves 122 form a generally continuous horizontal surface.

When the shelf assemblies 120 are to be returned to the stored position within the shelf module 14, the user grasps the handles 68 on each front fascia 196 and pivots the shelves 122 upwardly about the hinge mount 188 to the intermediate position, where the shelves 122 are generally vertically oriented. As each top panel 194 approaches the generally vertical orientation, the leg 206 pivots back against the underside of the top panel 194, and the damper 210 and the brace 208 also pivot vertically and are countersunk within the partial-height channel 190 and the full-height channel 192, respectively. Then, the shelf assemblies 120 can be pushed rearwardly so that the base 176 travels rearwardly into the front opening of the housing 146 through the action of the slides 168 and the wheels 184. The shelves 122 are thereby stored in a convenient manner.

The modular laundry system shown in FIGS. 46-47 can further be modified by adding a worksurface 12 across the top of the laundry appliances 10 and the shelf module 14, similar to the configuration shown in FIG. 3. For example, the leaf-type worksurface 12 of FIG. 42 is especially suited for use with the modular laundry system of FIGS. 46-47. The worksurface 12 can be adapted to accommodate the upwardly extending hanging area 18, or the upwardly extending hanging area 18 can be removed or modified to accommodate the worksurface 12, such as by being mounted to the rear wall 154 of the housing 146. Furthermore, the relative arrangement of the laundry appliances 10 and the shelf module 14 can differ from that shown in the figures; the shelf module 14 can be positioned at the far ends of the laundry appliances 10 rather than between the laundry appliances 10 or can be utilized with just one of the laundry appliances 10. When the shelf module 14 is utilized with just one of the laundry appliances 10, it is within the scope of the invention for the shelf module 14 to comprise only one of the shelf assemblies 120 or the pair of the shelf assemblies 120.

The modular laundry system according to one embodiment of the invention can be designed to incorporate lighting into the worksurface 12, such as directly into the worksurface 12 or into the storage/staging area, the hanging area 18, and/or the shelving area 19, or into the shelf module 14. The lighting provides illumination to the laundry area and can replace or supplement lighting already present in the laundry area. The lighting can be general lighting that illuminates a general space in which the modular laundry system resides or task lighting that illuminates a specific area for performing one or more particular tasks. For task lighting, the lighting can comprise conventional white illumination sources or a task-specific illumination source, such as black lights that can be used for detecting spots on clothing items. Examples of worksurfaces 12 that incorporate lighting are illustrated in FIGS. 57-62.

Figure 57:
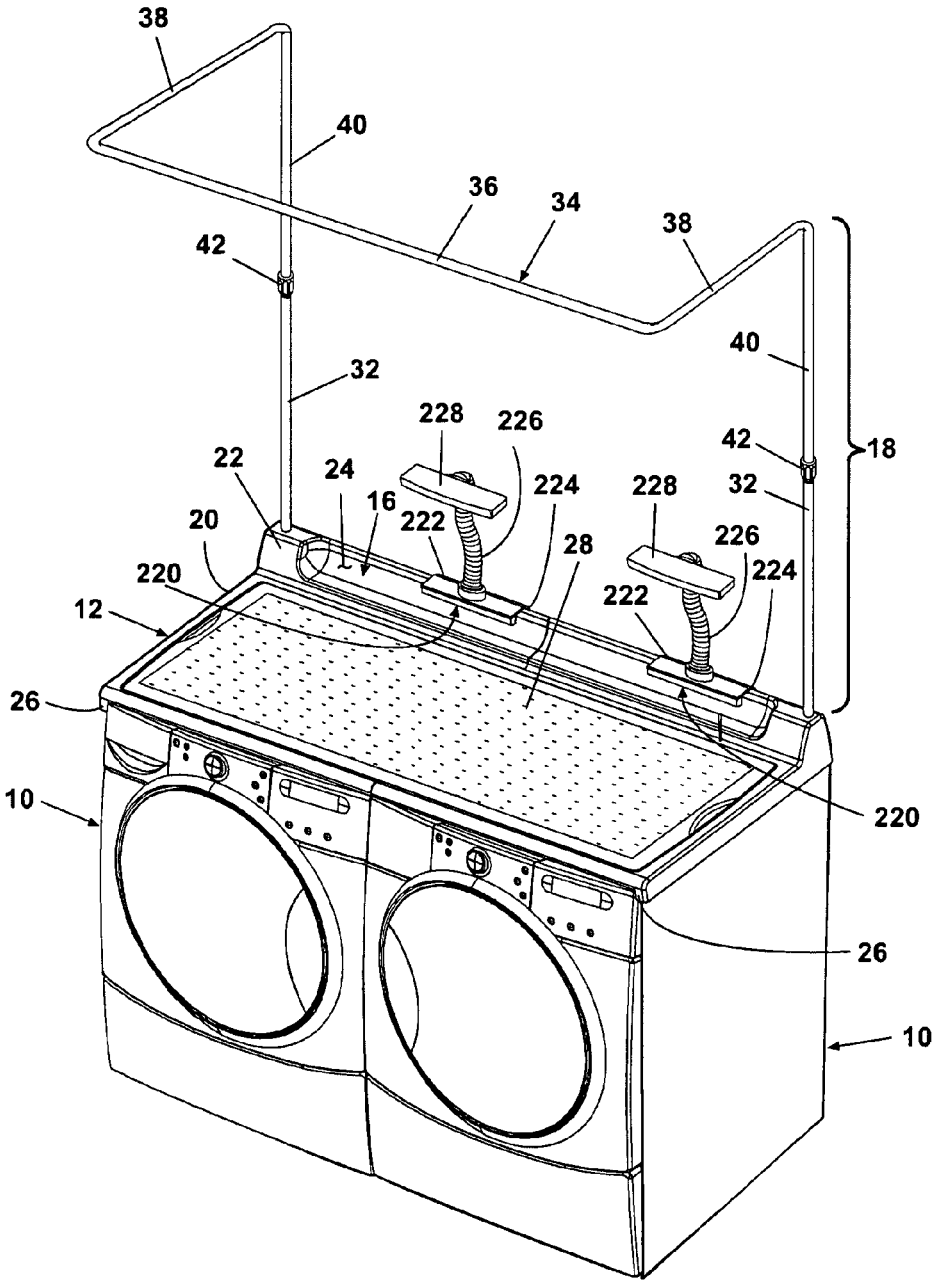
FIG. 57 is a perspective view of another embodiment of the modular laundry system similar to that shown in FIG. 12 in which lighting is incorporated into the worksurface.

FIG. 57 shows an embodiment of a worksurface 12 similar to that illustrated in FIG. 12, except that the bins 30 are replaced with illumination sources 220. Each of the illumination sources 220 comprises a base 222 with a rearwardly extending flange 224. The base 222 is sized for receipt within the staging recess 24 on the backsplash 22, and when the base 222 is received by the staging recess 24, the flange 224 hooks over an upper rear surface of the backsplash 22 located behind the staging recess 24 to mount the illumination source 220 to the worksurface 12. The illumination source 220 further comprises an adjustable neck 226 extending upward from the base 222 and terminating in a light support 228 that supports a source of light (not shown) and directs the light from the light source toward the worksurface 12. The particular illumination source 220 shown in FIG. 57 is provided for exemplary purposes only and can be replaced or modified in any suitable manner. For example, the neck 226 can be elongated so that a user can position the light source over a specific location on the worksurface 12. Additionally, the illumination source 220 can be mounted to an upper surface of the backsplash 22 if the backsplash 22 does not include the staging recess 24. Alternatively, the illumination source 220 can be mounted to other locations of the worksurface 12, such as to the staging bins 30 shown in FIGS. 7, 35A, and 40.

Figure 58:
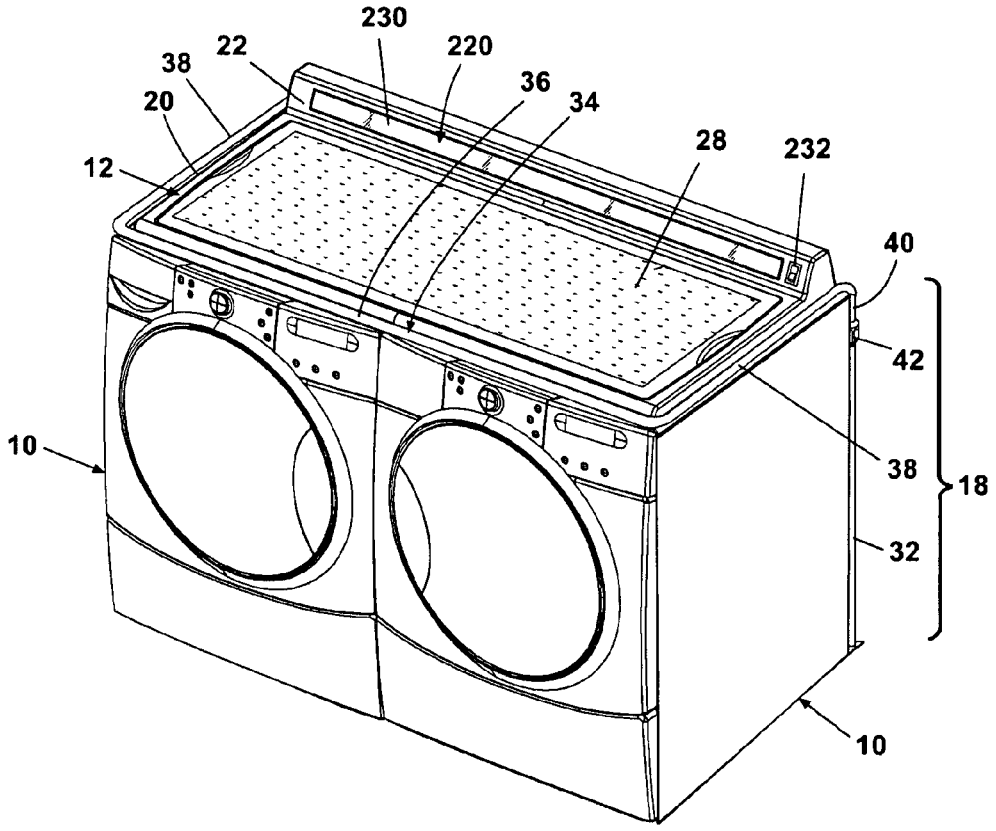
FIG. 58 is perspective view of another embodiment of the modular laundry system similar to that shown in FIG. 32 in which lighting is incorporated into a backsplash of the worksurface.

FIG. 58 illustrates another embodiment of a worksurface 12, which is similar to that illustrated in FIG. 32, wherein the lighting is incorporated into the worksurface 12. In this example, an illumination source 220 in the form of an elongated light 230 is mounted within the backsplash 22 of the worksurface 12. A switch 232 for controlling operation of the elongated light 230 is located adjacent to the elongated light 230 in the backsplash 22.

Figure 59:
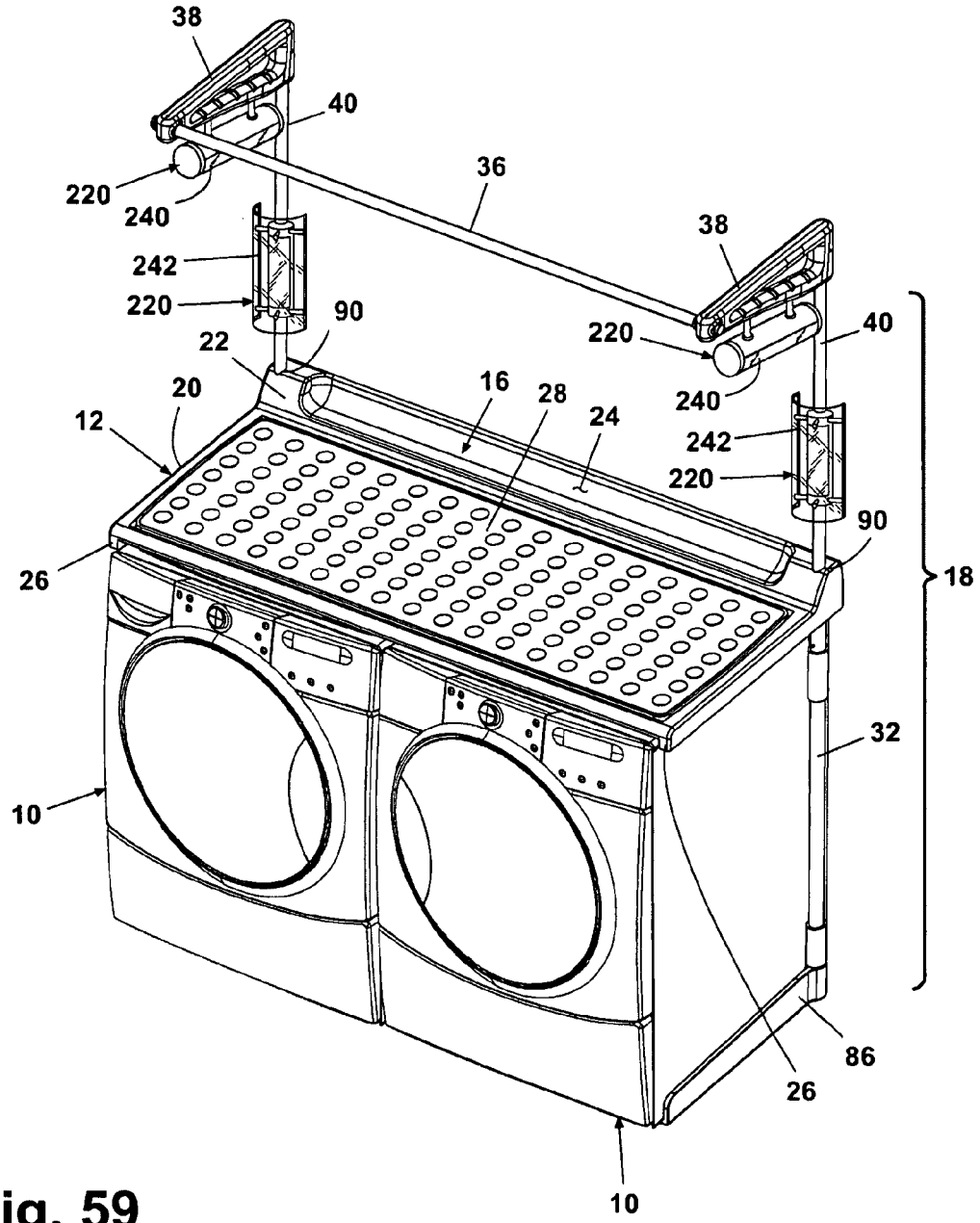
FIG. 59 is another embodiment of the modular laundry system similar to that shown in FIG. 37A in which lighting is incorporated into the hanging area of the worksurface in the form of horizontal and vertical lamps.
Figure 60:
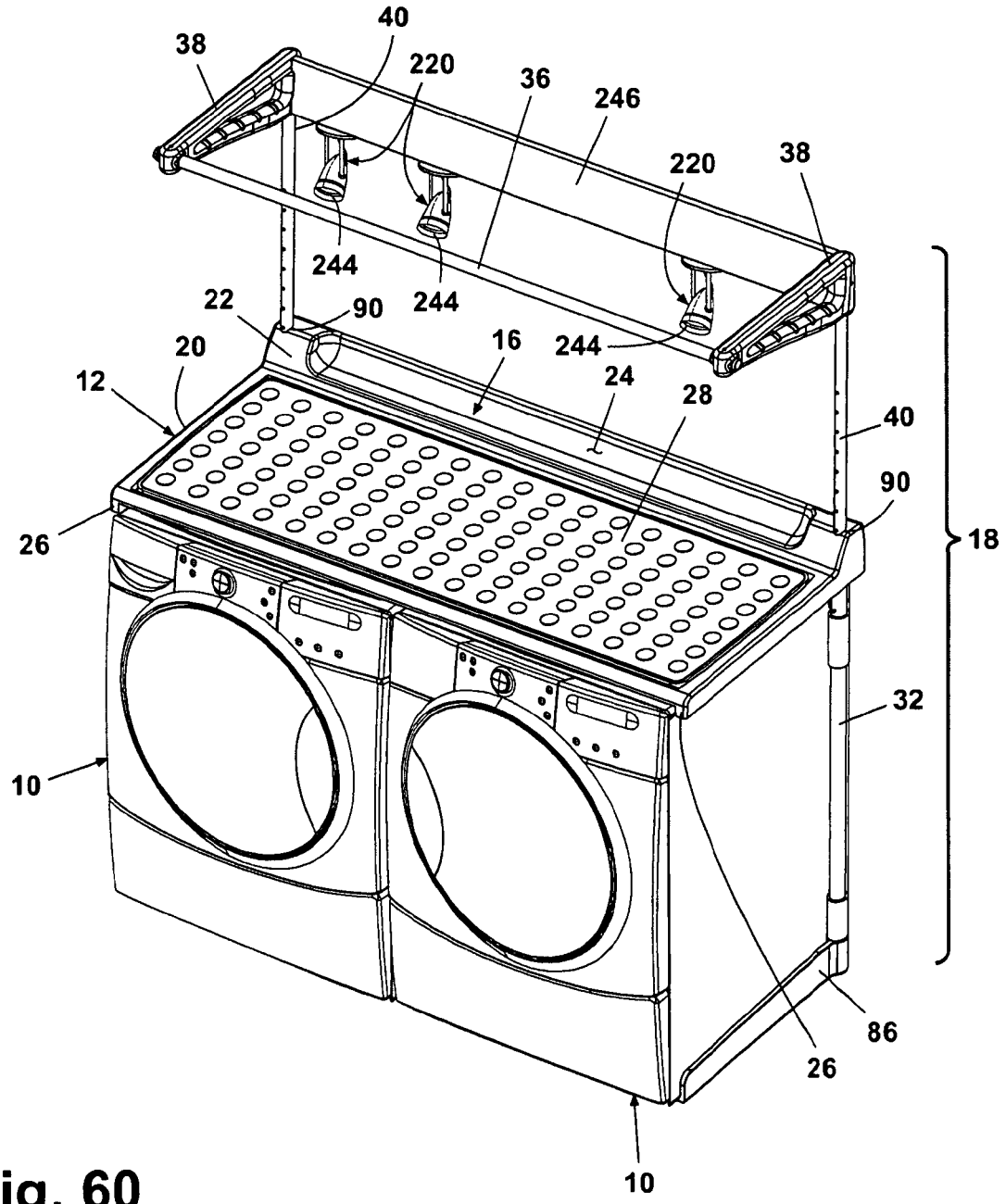
FIG. 60 is another embodiment of the modular laundry system similar to that shown in FIG. 37A in which lighting is incorporated into the hanging area of the worksurface in the form of a plurality of spotlights.
Figure 61:
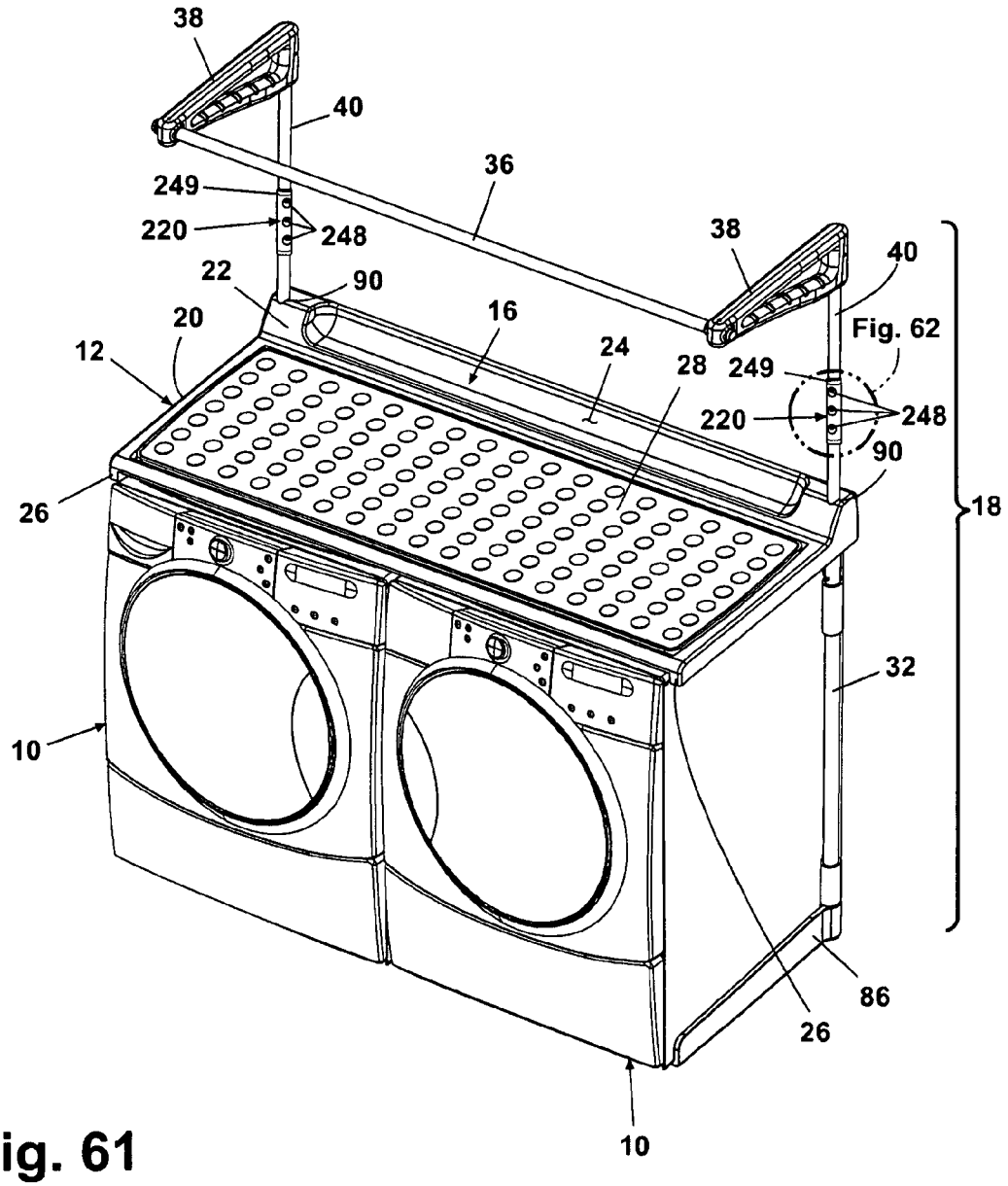
FIG. 61 is another embodiment of the modular laundry system similar to that shown in FIG. 37A in which lighting is incorporated into the hanging area of the worksurface in the form of a plurality of vertically spaced lights.
Figure 62:
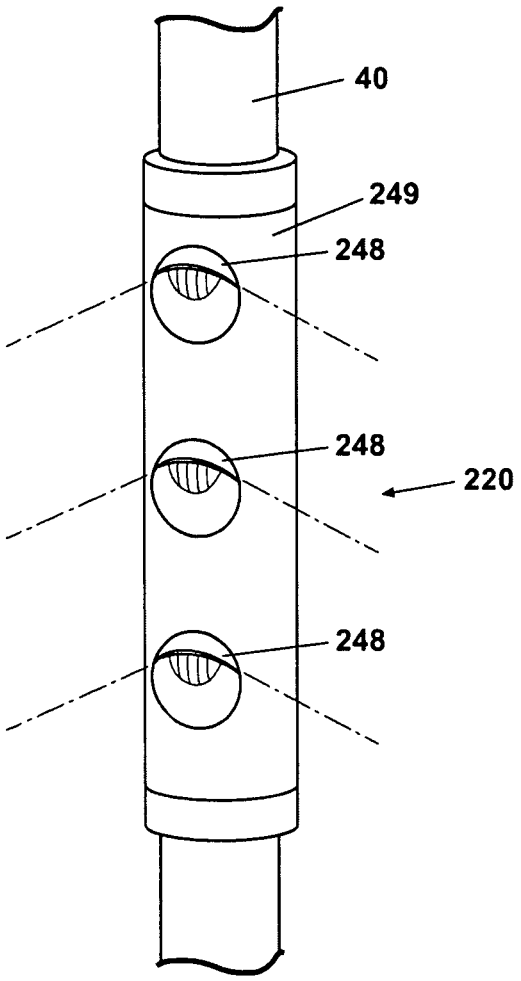
FIG. 62 is an enlarged view of the vertically spaced lights of FIG. 61.

FIGS. 59-62 present embodiments of worksurfaces 12 with an associated hanging area 18, and the lighting is incorporated into the hanging area 18. For example, in FIG. 59, which is similar to the embodiment shown in FIG. 37A, the lighting comprises several illumination sources 220 in the forms of horizontal lamps 240 depending from the spacer rods 38 and vertical lamps 242 mounted to the extension rods 40. FIG. 60 shows an embodiment similar to that of FIG. 59, except that the illumination sources 220 are in the form of a plurality of spotlights 244 mounted along a rear panel 246 that spans between the spacer rods 38. The spotlights 244 can be individually adjusted, such as by swiveling or pivoting, to direct the light to desired areas of the worksurface 12. In the embodiment of FIG. 61, the illumination sources 220 are in the form of a plurality of vertically spaced lights 248 mounted along the extension rods 40. The vertically spaced lights 248 of the illustrated embodiment are mounted in a sleeve 249 that surrounds the corresponding extension rod 40. FIG. 62 presents an enlarged view of the vertically spaced lights 248 from the embodiment of FIG. 61.

When the hanging area 18 includes the illumination sources 220, the adjustable nature of the hanging area 18 can be removed or modified for the type of the illumination sources 220, or the illumination sources 220 can be removable from the hanging area 18 so that the hanging area 18 can be adjusted or stored when not in use. Additionally, the illumination sources 220 in the hanging areas 18 can be battery powered or powered via a wired connection that can be hidden within the hanging area 18, such as, for example, by running wires though the extension rods 40, spacer rods 38, and central rod 34.

As previously mentioned, the worksurface 12 can be adapted to prevent transference of vibration between the laundry appliance 10 and the worksurface 12 and/or between adjacent laundry appliances 10. Consequently, the worksurface 12 remains relatively stationary during operation of the laundry appliance 10, and any items supported by the worksurface 12 will not shake or fall from the worksurface 12 during operation of the laundry appliance 10. The worksurface 12 can incorporate any suitable means for damping vibration or preventing transference of vibration from the laundry appliance 10 to the worksurface 12. For example, vibration dampening or isolation pads can be positioned between the worksurface 12 and the laundry appliance 10. The isolation pads physically space the worksurface 12 from the laundry appliance 10 and can be made of a material that dampens vibrations. Exemplary embodiments of the worksurface 12 incorporating the vibration isolation pads are illustrated in FIGS. 63-65.

Figure 63:
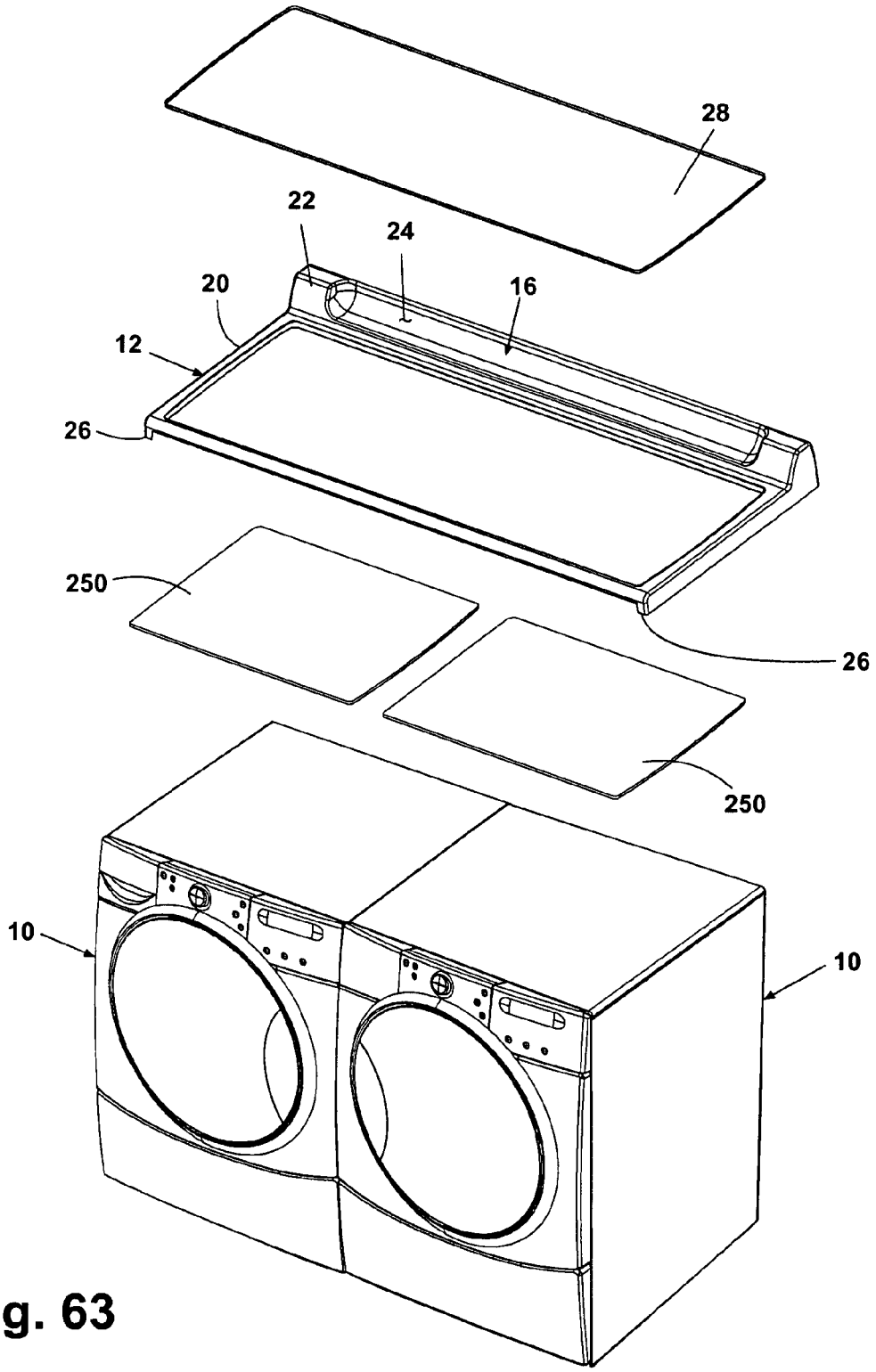
FIG. 63 is an exploded perspective view of another embodiment of the modular laundry system similar to that shown in FIG. 6 in which vibration isolation pads are located between the worksurface the laundry appliances.

FIG. 63 shows a worksurface 12 similar to that illustrated in FIG. 6, except that the worksurface 12 is formed by a unitary body 20, and the worksurface 12 includes a pair of horizontally juxtaposed isolation pads 250 between a lower surface of the worksurface 12 and the laundry appliances 10. The isolation pads 250 can be made as a unitary isolation pad rather than separate, if desired. Additionally, the isolation pads 250 can be mounted to the bottom of the worksurface 12 so that the isolation pads 250 move with the worksurface 12 when the worksurface 12 is mounted to or removed from the laundry appliances 10. Alternatively, the isolation pads 250 can be separate from the worksurface 12, whereby the isolation pads 250 are mounted to the laundry appliances 10 before the worksurface 12 is positioned on the laundry appliances 10. The isolation pads 250 are composed of a material that vibrationally isolates the worksurface 12 from the laundry appliances 10. Examples of suitable materials include, but are not limited to, rubber and polymeric foams. The isolation pads 250 can have any suitable thickness, depending on the material of the isolation pads 250. For example, the thickness of the isolation pads 250 can range from about one-eighth of an inch to about one inch.

Figure 64:
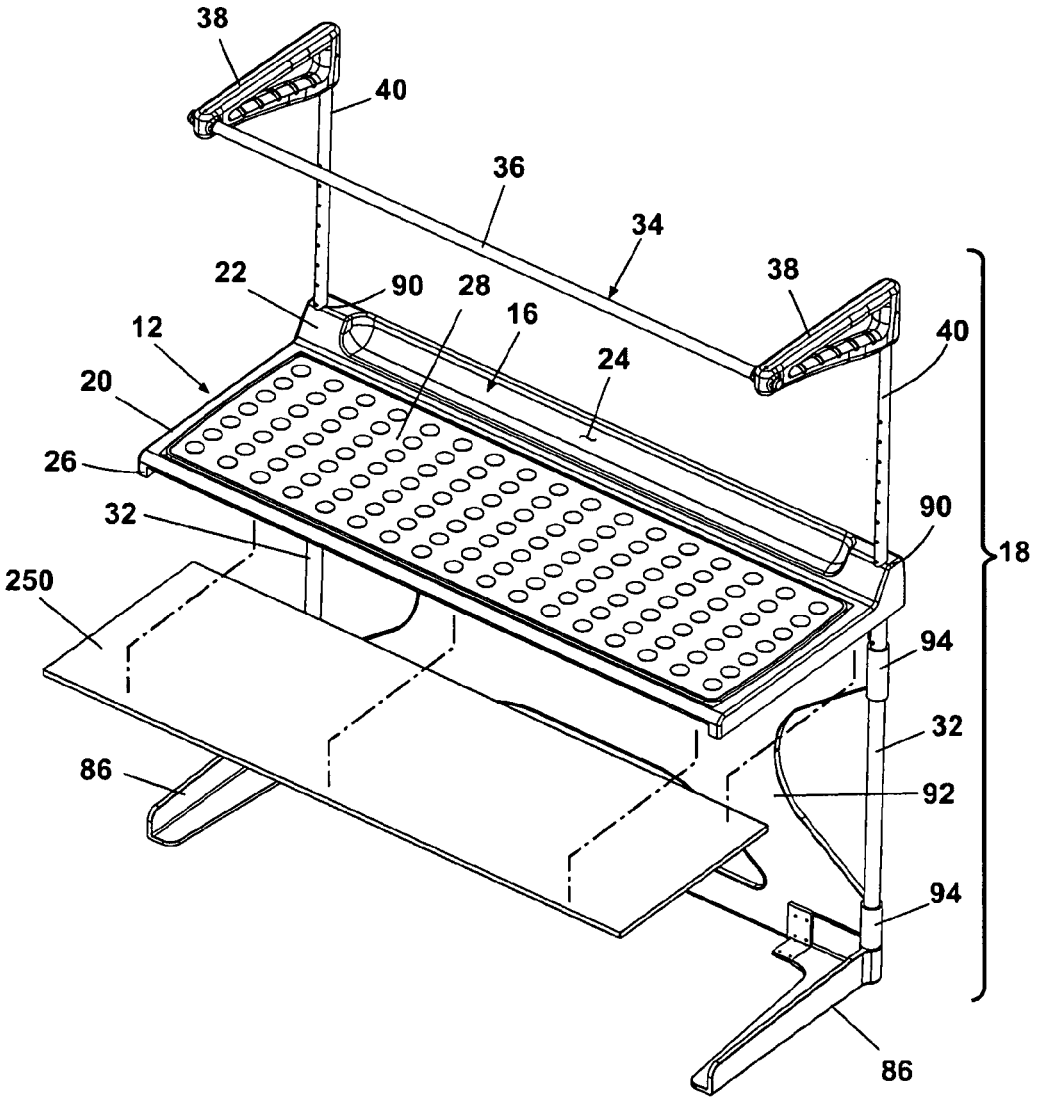
FIG. 64 is a perspective view of another embodiment of the modular laundry system similar to that shown in FIG. 38 with the addition of a vibration isolation pad.

Another embodiment of the worksurface 12 with the isolation pad 250 is shown in FIG. 64. The worksurface 12 in FIG. 64 is similar to that shown in FIG. 37A, except that the worksurface 12 in FIG. 64 includes a unitary isolation pad 250 positioned below the worksurface body 20.

Figure 65:
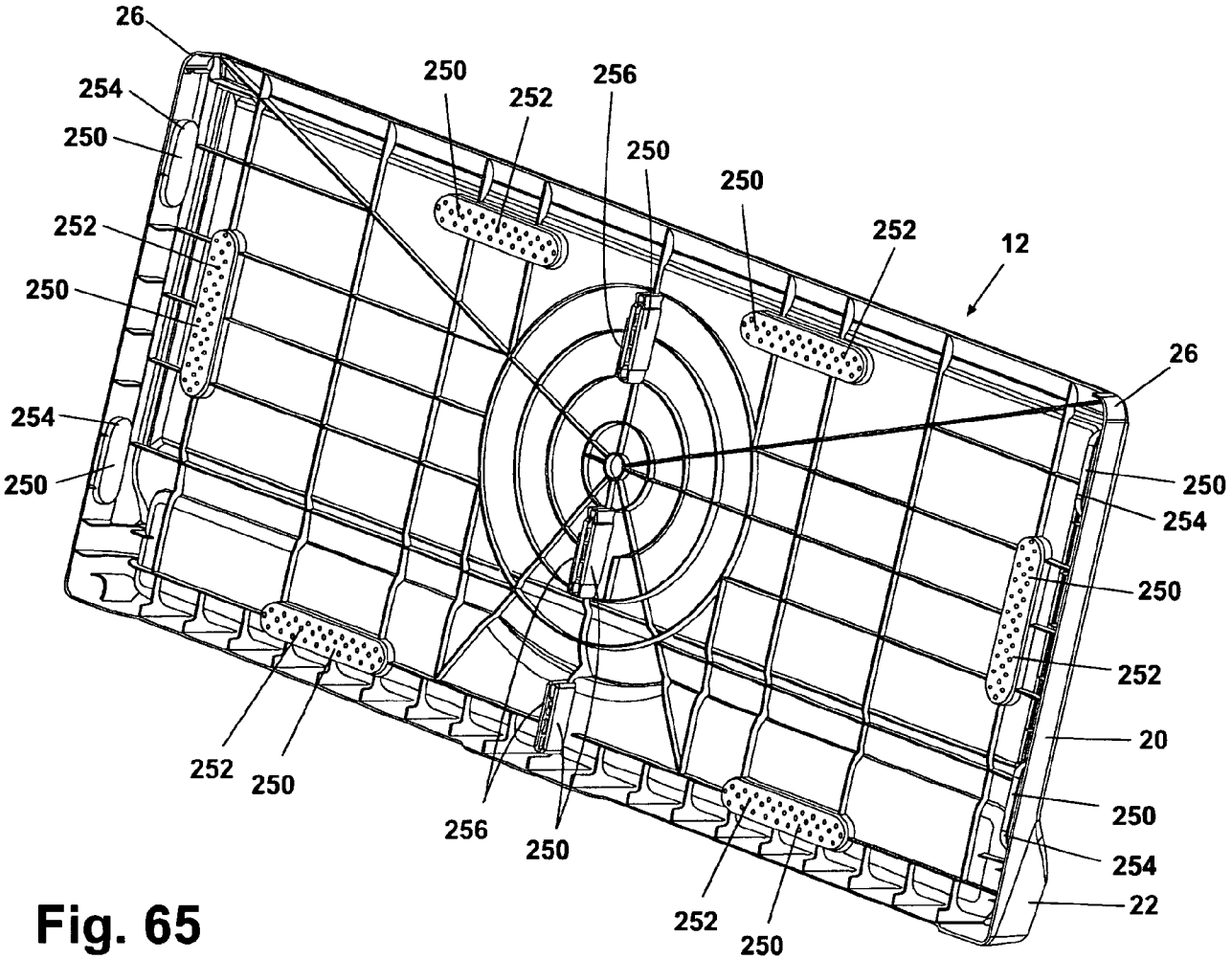
FIG. 65 is a bottom perspective view of the worksurface similar to that shown in FIG. 6 with a plurality of vibration isolation pads mounted to a bottom surface of the worksurface.

The vibration dampening and isolation means can alternatively comprise a plurality of relatively smaller isolation pads 250 mounted to the bottom of the worksurface 12, as illustrated in FIG. 65. The isolation pads 250 can be randomly positioned on the bottom of the worksurface 12 or strategically located. In the illustrated embodiment, the isolation pads 250 comprise a first set 252 of the isolation pads 250 in a horizontal orientation along the bottom of the body 20 to prevent transfer of vibration from the tops of the laundry appliances 10 to the worksurface 12, a second set 254 of the isolation pads in a generally vertical orientation along the depending flanges 26 to prevent transfer of vibration from the sides of the laundry appliances 10 to the worksurface 12, and a third set 256 of the isolation pads 250 in a generally vertical orientation and located centrally on the body 20 such that the isolation pads 250 of the third set 256 reside between the adjacent laundry appliances 10 that support the worksurface 12 to prevent transference of vibration therebetween.

Rather than utilizing the isolation pads 250, the worksurface 12 can be made such that natural resonating frequency of the worksurface 12 is a frequency that is quickly passed through during a spin operation of the laundry appliance 10 in the form of a clothes washer yet greater than the frequencies at which the laundry appliance 10 in the form of a clothes dryer operates. The natural resonating frequency of the worksurface 12 can be tailored by altering the mass of the worksurface 12, such as by altering the thickness of the body 20 or adding counterweights.

To add stability to the modular laundry system, the worksurface 12 can be attached to the laundry appliance 10 to create a physically interconnected structure. For example, the worksurface 12 and the laundry appliance 10 can be connected by interlocking components, such as a socket and detent, fasteners, or adhesives. The worksurface 12 and the laundry appliance 10 can also be joined together with a joining process, such as welding.

Figure 66:
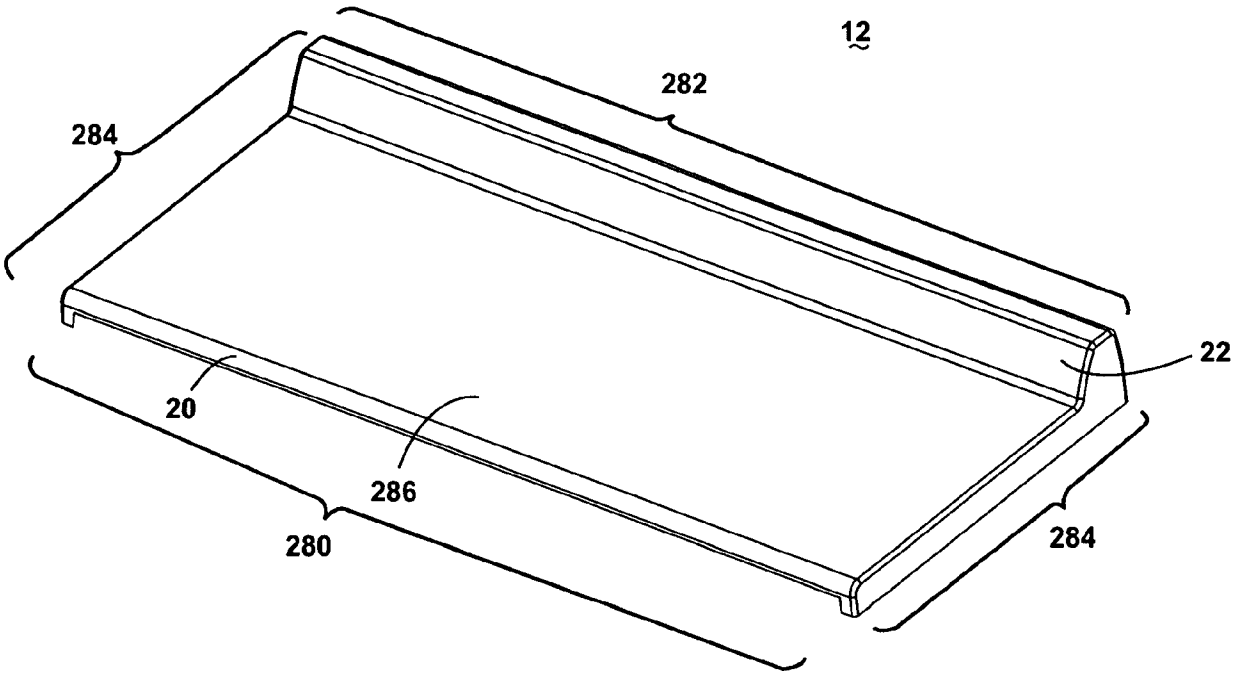
FIG. 66 is a perspective view of another embodiment of the modular laundry system similar to that shown in FIG. 6.

Many embodiments of the worksurface 12 have been described above and shown in the drawings. Several of these embodiments of the worksurface 12 include a functional element configured to provide an associated functionality. Examples of the functional elements include the hanging area 18, the storage/staging area 16, the shelving area 19, which includes the ironing board 52, the wrinkle removing press 80, the illumination source 220, the vibration isolation pads 250, the hinge 66, the power outlet 53, and the iron docking station 59 on the iron platform 61. While the functional elements can be provided in any suitable location on the worksurface 12, the functional elements in the illustrated embodiments have been shown as being located or accessed either along a perimeter of the worksurface 12 or below the upper surface of the worksurface 12 so that the functional element does not interfere with the portion of the upper surface of the worksurface 12 that the user would typically employ for performing functions or tasks. As shown in FIG. 66, the perimeter of the worksurface 12 defines a front 280, a back 282, and opposite sides 284. In the illustration of FIG. 66, the backsplash 22 is located at the back 282 of the perimeter. The upper surface of the worksurface is identified with the reference numeral 286 in FIG. 66. The upper surface 286 is formed by the uppermost surface of the worksurface 12. For example, the upper surface 286 can be defined by the upper surface of the functional insert 28 when the worksurface 12 comprises the functional insert 28, the upper surface of the cover 78 of the wrinkle removing press 80, or the upper surface of the body 20.

Examples of some of the functional elements provided on or accessed from the perimeter in the previously described embodiments include the staging recess 24 formed at the back 282 in the backsplash 22 (e.g., FIG. 6), the staging bins 30 at the opposite sides 284 (e.g., FIGS. 7 and 35), the hanging area located at the back 282 (e.g., FIGS. 10, 30, 37A, 41), the staging wells 44 located at the back 282 in the staging recess 24 (e.g., FIG. 12), the radio module 45 located at the back 282 in the staging recess 24 (e.g., FIG. 13), the shelving area 19 in the form of the ironing board 52 accessible through the front 280 (e.g., FIGS. 16 and 18), the power outlet 53 provided at the back 282 in the backsplash 22 (e.g., FIG. 16), the iron docking station 59 located at one of the opposite sides 284 (e.g., FIG. 17), the shelving area 19 located at the back 282 and mounted to the hanging area 18 at the back 282 (e.g., FIGS. 20-22), the clothing-retaining clips 84 located at the front 280 (e.g., FIG. 28), the hanging area 18 extending laterally from one of the opposite sides 284 (e.g., FIG. 34A), the hanger staging area 91 located at one of the opposite sides 284 (e.g., FIG. 35C), the hanger staging area 91 located at the back 282 and mounted to the hanging area 18 at the back 282 (e.g., FIG. 37B), the illumination source 220 provided at the back 282 on the backsplash 22 (e.g., FIGS. 57 and 58), and the illumination source 220 provided at the back 282 on the hanging area 18 at the back 282 (e.g., FIGS. 59-61).

Examples of some of the functional elements provided below the upper surface 286 of the worksurface 12 in the previously described embodiments include the shelving area 19 in the form of the ironing board 52 stored below the upper surface 286 when not in use (e.g., FIGS. 16 and 18), the hinge 66 for moving the worksurface 12 relative to the laundry appliances 10 (e.g., FIG. 24), the wrinkle removing press 80 (e.g., FIG. 25), and the vibration isolation pads 250 located below the upper surface 286 (e.g., FIGS. 63-65).

In addition to the current application, the modular laundry system is also described in the following related applications: application Ser. No. 11/322,773, filed concurrently herewith, and titled "Modular Laundry System with Segmented Work Surface," application Ser. No. 11/322,741, filed concurrently herewith, and titled "Modular Laundry System with Work Surface Having a Functional Insert," application Ser. No. 11/322,740, filed concurrently herewith, and titled "Modular Laundry System with Work Surface Having a Functional Element," and application Ser. No. 11/323,658, filed concurrently herewith, and titled "Modular Laundry System with Shelf Module," which are incorporated herein by reference in their entirety.

As can be seen from the numerous embodiments of this invention, a modular laundry system having an integrated worksurface 12 and/or an optional shelf module 14 can have beneficial effects on a user's ability to organize the workspace surrounding one or more laundry appliances 10.

While the invention has been specifically described in connection with certain specific embodiments thereof, it is to be understood that this is by way of illustration and not of limitation, and the scope of the appended claims should be construed as broadly as the prior art will permit.

What is claimed is:

1. A modular laundry system comprising:

a first laundry appliance having a housing with a closed top;

a second laundry appliance having a housing with a closed top, and horizontally arranged in an adjacent relationship with the first laundry appliance to form a gap between the closed tops such that the closed tops collectively define a discontinuous upper surface having a width and depth; and a worksurface comprising a single-piece rigid body having a width and depth commensurate with the width and depth of the discontinuous upper surface and mountable to the first and second laundry appliances to rest on the closed tops and span the gap to form a continuous surface above the discontinuous upper surface;

wherein the first and second laundry appliances each have a backsplash, and the worksurface has an opening that receives the backsplashes.

2. The modular laundry system according to claim 1, wherein the worksurface comprises a functional insert having a first surface configured for performing a first function and a second surface configured for performing a second function different from the first function.

3. The modular laundry system according to claim 1, wherein the worksurface comprises a removable insert and a recess formed in the body that is sized to receive the insert.

4. The modular laundry system according to claim 3, wherein the insert comprises a first surface configured for performing a first function and a second surface configured for performing a second function different from the first function.

5. The modular laundry system according to claim 1, wherein the worksurface comprises a storage area located beyond the width of the discontinuous upper surface.

6. The modular laundry system according to claim 3, wherein the insert comprises a hygienic material.

7. The modular laundry system according to claim 3, wherein the insert is configured to be washed in a dishwasher.

8. The modular laundry system according to claim 1, wherein the worksurface comprises a stowable shelf.

9. The modular laundry system according to claim 8, wherein the stowable shelf comprises an ironing board.

10. The modular laundry system according to claim 1, wherein the worksurface comprises a hanging area.

11. The modular laundry system according to claim 1, wherein the worksurface further comprises movement preventers defining a space that is comparable to one of a width and a depth of the discontinuous upper surface.

12. The modular laundry system according to claim 11, wherein the movement preventers comprise flanges formed at opposite sides of the body.

13. The modular laundry system according to claim 12, wherein the movement preventers depend from opposite lateral sides of the body.

14. The modular laundry system according to claim 1, wherein the worksurface is movably mounted to the first and second laundry appliances between a first use position, in which the worksurface overlies the first and second laundry appliances, and a second use position different than the first use position.

15. The modular laundry system according to claim 14, wherein the body is positioned in front of the first and second laundry appliances in the second use position.

16. The modular laundry system according to claim 1, wherein the worksurface comprises a backsplash extending upwardly from a rear portion of the body.

17. The modular laundry system according to claim 16, wherein the worksurface further comprises a staging area formed in the backsplash.

18. The modular laundry system according to claim 1, wherein the worksurface comprises a wrinkle removing appliance.

19. The modular laundry system according to claim 1, wherein the worksurface comprises lighting illuminating the body.

20. The modular laundry system according to claim 19, wherein the worksurface further comprises a backsplash extending upwardly from a rear portion of the body, and the lighting is provided in the backsplash.

21. The modular laundry system according to claim 1, wherein the worksurface comprises a vibration dampener mounted between at least one of the closed tops and the body to prevent transference of vibration between the first and second laundry appliances and the worksurface.

22. The modular laundry system according to claim 1, wherein the first and second laundry appliances are front-loading laundry appliances.

23. A modular laundry system comprising:

a first laundry appliance having a housing with a closed top defining a first side;

a second laundry appliance having a housing with a closed top defining a second side, and horizontally arranged with the first laundry appliance such that the first and second sides abut to define a collective upper surface having a width, a depth and a discontinuity at the abutting first and second sides; and a worksurface comprising a single-piece rigid body having a width and depth commensurate with the width and depth of the collective upper surface and mountable to the first and second laundry appliances to rest on the closed tops and overlies the discontinuity to form a continuous surface above the collective upper surface;

wherein the first and second laundry appliances each have a backsplash, and the worksurface has an opening that receives the backsplashes.

* * * * *